US009617626B2

(12) United States Patent
Yamamoto et al.

(10) Patent No.: US 9,617,626 B2
(45) Date of Patent: Apr. 11, 2017

(54) HIGH-STRENGTH STEEL SHEET EXHIBITING EXCELLENT STRETCH-FLANGE FORMABILITY AND BENDING WORKABILITY, AND METHOD OF PRODUCING MOLTEN STEEL FOR THE HIGH-STRENGTH STEEL SHEET

(75) Inventors: Kenichi Yamamoto, Tokyo (JP); Hideaki Yamamura, Tokyo (JP); Yuzo Takahashi, Tokyo (JP); Osamu Kawano, Tokyo (JP); Kohsuke Kume, Tokyo (JP); Junji Haji, Tokyo (JP); Daisuke Maeda, Tokyo (JP); Yoshihiro Suwa, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 926 days.

(21) Appl. No.: 13/817,042

(22) PCT Filed: Feb. 23, 2012

(86) PCT No.: PCT/JP2012/054384
§ 371 (c)(1),
(2), (4) Date: Feb. 14, 2013

(87) PCT Pub. No.: WO2012/115181
PCT Pub. Date: Aug. 30, 2012

(65) Prior Publication Data

US 2013/0142688 A1 Jun. 6, 2013

(30) Foreign Application Priority Data

Feb. 24, 2011 (JP) ..... 2011-038956
Mar. 10, 2011 (JP) ..... 2011-053458
(Continued)

(51) Int. Cl.
*C22C 38/58* (2006.01)
*C22C 38/00* (2006.01)
(Continued)

(52) U.S. Cl.
CPC ..... *C22C 38/58* (2013.01); *C21C 7/06* (2013.01); *C21C 7/0645* (2013.01); *C22C 1/00* (2013.01);
(Continued)

(58) Field of Classification Search
CPC ... C22C 38/001; C22C 38/002; C22C 38/005; C22C 38/02; C22C 38/04;
(Continued)

(56) References Cited

U.S. PATENT DOCUMENTS 7,226,493 B2 * 6/2007 Grong ..... B22D 11/0405 148/637
9,238,848 B2 * 1/2016 Suwa ..... C21D 6/005
(Continued)

FOREIGN PATENT DOCUMENTS

CA 2727224 12/2009
CA 2768825 2/2011
(Continued)

OTHER PUBLICATIONS

International Search Report dated May 29, 2012 issued in corresponding PCT Application No. PCT/JP2012/054384.
(Continued)

*Primary Examiner* — Jessee Roe
*Assistant Examiner* — John Hevey
(74) *Attorney, Agent, or Firm* — Birch, Stewart, Kolasch & Birch, LLP

(57) ABSTRACT

The present invention provides a high-strength steel sheet including: C: 0.03 to 0.25 mass %, Si: 0.1 to 2.0 mass %, Mn: 0.5 to 3.0 mass %, P: not more than 0.05 mass %, T.O:
(Continued)

not more than 0.0050 mass %, S: 0.0001 to 0.01 mass %, N: 0.0005 to 0.01 mass %, acid-soluble Al: more than 0.01 mass %, Ca: 0.0005 to 0.0050 mass %, and a total of at least one element of Ce, La, Nd, and Pr: 0.001 to 0.01 mass %, with a balance including iron and inevitable impurities, in which the steel sheet contains a chemical component on a basis of mass that satisfies $0.7<100\times([Ce]+[La]+[Nd]+[Pr])/[\text{acid-soluble Al}]\leq 70$ and $0.2\leq([Ce]+[La]+[Nd]+[Pr])/[S]\leq 10$, the steel sheet contains compound inclusion including a first inclusion phase containing at least one element of Ce, La, Nd, and Pr, containing Ca, and containing at least one element of O and S, and a second inclusion phase having a component different from that of the first inclusion phase and containing at least one element of Mn, Si, and Al, the compound inclusion forms a spherical compound inclusion having an equivalent circle diameter in the range of 0.5 μm to 5 μm, and a ratio of the number of the spherical compound inclusion relative to the number of all inclusions having the equivalent circle diameter in the range of 0.5 μm to 5 μm is 30% or more.

26 Claims, 4 Drawing Sheets

(30) Foreign Application Priority Data

Jan. 18, 2012 (JP) ..... 2012-007784
Jan. 18, 2012 (JP) ..... 2012-007785

(51) Int. Cl.

| | |
|---|---|
| ***C22C 38/02*** | (2006.01) |
| ***C22C 38/26*** | (2006.01) |
| ***C22C 38/32*** | (2006.01) |
| ***C22C 38/38*** | (2006.01) |
| ***C22C 1/00*** | (2006.01) |
| ***C22C 38/04*** | (2006.01) |
| ***C22C 38/08*** | (2006.01) |
| ***C22C 38/12*** | (2006.01) |
| ***C22C 38/16*** | (2006.01) |
| ***C22C 38/42*** | (2006.01) |
| ***C22C 38/06*** | (2006.01) |
| ***C22C 38/18*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C21C 7/064*** | (2006.01) |
| ***C21C 7/06*** | (2006.01) |

(52) U.S. Cl.
CPC ..... *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/16* (2013.01); *C22C 38/18* (2013.01); *C22C 38/26* (2013.01); *C22C 38/32* (2013.01); *C22C 38/38* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01)

(58) Field of Classification Search
CPC ..... C22C 38/06; C22C 38/08; C22C 38/12; C22C 38/16; C22C 38/18; C22C 38/26; C22C 38/32; C22C 38/38; C22C 38/42; C22C 38/44; C22C 38/46; C22C 38/50; C22C 38/54; C22C 38/58
See application file for complete search history.

(56) References Cited

U.S. PATENT DOCUMENTS

| | | | | |
|---|---|---|---|---|
| 2009/0047166 | A1* | 2/2009 | Tomomatsu | C21D 6/002 420/83 |
| 2009/0238714 | A1* | 9/2009 | Arai | C21D 8/10 420/83 |
| 2009/0277545 | A1* | 11/2009 | Yamasaki et al. | 148/598 |
| 2011/0076512 | A1* | 3/2011 | Yamamoto | C21C 7/0006 428/639 |

FOREIGN PATENT DOCUMENTS

| | | |
|---|---|---|
| CN | 1875124 | 12/2006 |
| CN | 101490295 | 7/2009 |
| JP | 11-199973 | 7/1999 |
| JP | 2001-026842 | 1/2001 |
| JP | 2001-200331 | 7/2001 |
| JP | 2002-363694 | 12/2002 |
| JP | 2008-274336 | 11/2008 |
| JP | 2009-299136 | 12/2009 |
| JP | 2009-299137 | 12/2009 |
| JP | 4431185 | 3/2010 |
| JP | 2011-032572 | 2/2011 |
| WO | WO 2009/151140 | * 12/2009 |

OTHER PUBLICATIONS

Office Action dated Jul. 2, 2014 issued in corresponding Chinese Application No. 201280002655.1 [with English Translation of Search Report].
Office Action dated Aug. 14, 2014 issued in corresponding Canadian Application No. 2808458.

* cited by examiner $Al_2O_3$

10μm

100μm $CaOAl_2O_3$

100μm $CaS(Fe,Mn,Al_2O_3)$

50μm

HIGH-STRENGTH STEEL SHEET EXHIBITING EXCELLENT STRETCH-FLANGE FORMABILITY AND BENDING WORKABILITY, AND METHOD OF PRODUCING MOLTEN STEEL FOR THE HIGH-STRENGTH STEEL SHEET

TECHNICAL FIELD

The present invention relates to a high-strength steel sheet suitable for use, for example, in underbody components of transportation devices, and a method of producing molten steel for the high-strength steel sheet. In particular, the present invention relates to a high-strength steel sheet exhibiting excellent stretch-flange formability and bending workability, and a method of producing molten steel for the high-strength steel sheet.

This application is a national stage application of International Application No. PCT/JP2012/054384, filed Feb. 23, 2012, which claims priority to Japanese Patent Application No. 2011-038956 filed in Japan on Feb. 24, 2011, Japanese Patent Application No. 2011-053458 filed in Japan on Mar. 10, 2011, Japanese Patent Application No. 2012-007784 filed in Japan on Jan. 18, 2012, and Japanese Patent Application No. 2012-007785 filed in Japan on Jan. 18, 2012, the disclosures of which are incorporated herein by reference in their entirety.

BACKGROUND ART

In recent years, there are growing demands for hot-rolled steel sheets for automobiles having enhanced strength and reduced weight from the viewpoint of improvement in safety of automobiles and reduction in fuel consumption, which leads to environmental conservation. Among the automobile parts, frame-related parts and arm-related parts, which are called an underbody system, occupy a large portion of the entire weight of the vehicle. Thus, the entire weight of the vehicle can be reduced by enhancing the strength of materials used for these parts, and reducing the thickness of these parts. Further, press forming is widely used for shaping materials into the underbody system. Thus, in order to prevent these materials from cracking during the press forming, these materials are required to have a high bending workability. For this reason, high-strength steel sheets are widely used. In particular, hot-rolled steel sheets are mainly used because of their price advantages. Yet further, for reinforcing members or underfloor members, in particular, for slide rails for seats or other small members subjected to the bending working, cold-rolled steel sheets or zinc-plated steel sheets are mainly used to reduce the thickness thereof and reduce the weight thereof through use of the high-strength steel sheets.

Of the steels described above, there are known a low-yield-ratio DP steel sheet containing a ferrite phase and a martensite phase, and a TRIP steel sheet containing a ferrite phase and a (retained) austenite phase, as a high-strength steel sheet having increased strength, improved workability and improved formability. However, although exhibiting increased strength and excellent workability and ductility, these steel sheets do not have excellent hole expandability, in other words, stretch-flange formability or bending workability. Thus, in general, although ductility is slightly inferior, bainite-based steel sheets are used for structural parts such as underbody components that are required to have the stretch-flange formability.

One of the reasons that a composite-structure steel sheet including the ferrite phase and the martensite phase (hereinafter, also referred to as "DP steel sheet") has lower stretch-flange formability is considered to be that, since this steel sheet is a composite formed by the soft ferrite phase and the hard martensite phase, stress concentrates on a boundary portion between both phases during the hole-expansion working, and the steel sheet cannot follow its deformation, whereby this boundary portion is likely to become a start point of breakage.

To solve the problems described above, several steel sheets are proposed on the basis of the DP steel sheet with the aim of achieving both the mechanical strength property and the bending workability or hole-expandability (workability). For example, as a technique for stress relaxation using fine dispersed particles, Patent Document 1 discloses a composite-structure steel sheet including a ferrite phase and a martensite phase (DP steel sheet) in which fine Cu precipitates or solid solutions are dispersed. In this technique disclosed in Patent Document 1, it is found that the bending workability can be significantly effectively improved without deteriorating the workability, by using Cu precipitates having a particle size of 2 nm or less and formed by Cu in solid solution or Cu alone, and on the basis of the findings, a composition ratio of contained components is defined.

As a technique for stress relaxation by reducing the difference in strength in composite phases, for example, Patent Document 2 discloses a technique relating to a bainite steel, in which the difference in hardness between ferrite and bainite is reduced by minimizing C as much as possible to make the bainite structure become the primary phase, and adjusting the ferrite structure, which has been subjected to solid solution strengthening or precipitation hardening, so as to have an appropriate volume ratio, and further, generation of coarsened carbides is eliminated.

Patent Document 3 discloses a technique of obtaining a high-strength steel sheet exhibiting excellent bending workability, by defining the size and the number of oxide-based inclusions on the assumption that the oxide-based inclusions cause cracking during the bending working.

Further, Patent Documents 4 and 5 disclose a technique of obtaining a high-strength steel sheet exhibiting excellent stretch-flange formability and fatigue characteristics, by reducing the size of elongated MnS-based inclusions existing in the steel and deteriorating the fatigue characteristics and the stretch-flange formability (hole expandability), to be fine spherical inclusions, which are less likely to be a starting point of the occurrence of cracking, and dispersing the fine spherical inclusions in the steel.

RELATED ART DOCUMENTS

Patent Documents

Patent Document 1: Japanese Unexamined Patent Application, First Publication No. H11-199973
Patent Document 2: Japanese Unexamined Patent Application, First Publication No. 2001-200331
Patent Document 3: Japanese Unexamined Patent Application, First Publication No. 2002-363694
Patent Document 4: Japanese Unexamined Patent Application, First Publication No. 2008-274336
Patent Document 5: Japanese Unexamined Patent Application, First Publication No. 2009-299136

DISCLOSURE OF THE INVENTION

Problems to be Solved by the Invention

Incidentally, although the steel sheet having fine Cu precipitates or solid solutions dispersed in the DP steel sheet as disclosed in Patent Document 1 has enhanced fatigue strength, it is not confirmed whether this steel sheet significantly improves the stretch-flange formability. Further, the high-strength hot-rolled steel sheet having the structure of the steel sheet formed mainly by a bainite phase and having a reduced number of coarsened carbides as disclosed in Patent Document 2 exhibits excellent stretch-flange formability. However, it cannot be said that the bending workability of this steel sheet is excellent as compared with the DP steel sheet containing Cu. Additionally, the occurrence of cracking in the case of severe hole-expanding working cannot be prevented only by suppressing the generation of the coarsened carbides.

Yet further, although the high-strength cold-rolled steel sheet having a reduced amount of coarsened oxide-based inclusions as disclosed in Patent Document 3 exhibits excellent bending workability, it is not confirmed whether the fatigue characteristics are improved and the stretch-flange formability is significantly improved. Additionally, this steel contains a predetermined amount of Mn and S. According to the present inventors' findings obtained from experiments, it is considered that containing these elements leads to generation of coarsened MnS-based inclusions. Thus, as described later, only the reduction in the amount of coarsened oxide-based inclusions generated is not sufficient to prevent the occurrence of cracking in the case of the severe hole-expanding working.

Yet further, the high-strength steel sheet having the MnS-based inclusions dispersed in the steel sheet as fine spherical inclusions as disclosed in Patent Document 4 exhibits excellent stretch-flange formability and fatigue characteristics. However, Al is not substantially used in melting and producing a steel, and a desulfurization process is performed under the condition where relatively high free oxide exists, which makes it difficult to reduce sulfur to the extremely low sulfur concentration. Besides, the desulfurization process is performed with Ce, La, or other elements while Al is not substantially used, which requires the larger amount of additives to be added. Additionally, the addition efficiency of Ce, La or other elements is low, and hence, the large amount of additives needs to be added.

Yet further, the high-strength steel sheet having MnS-based inclusions dispersed in the steel sheet as fine spherical inclusions as disclosed in Patent Document 5 is subjected to deoxidation with Al during a melting and producing stage in producing the steel, and further subjected to deoxidation with Ce, La, or the like. Thus, with this steel sheet, addition efficiency of Ce, La or other elements is high, sulfur can be reduced to the extremely low sulfur concentration, and excellent stretch-flange formability and fatigue characteristics can be obtained even with a relatively high S concentration. However, the large amount of $Al_2O_3$—$Ce_2O_3$-based oxide is generated. This causes clogging of a ladle nozzle or immersion nozzle during continuous casting processes in a steel-producing stage, and stops production of steels, which leads to a problem that products cannot be produced continuously. In the case where Ca is added to eliminate the above-described problem, there are generated CaO—$Al_2O_3$-based oxide having a low melting point as illustrated in FIG. 2A and FIG. 6, or coarsened CaS-based inclusions having Fe, Mn or O dissolved in solid solution or having CaO—$Al_2O_3$ combined therewith as illustrated in FIG. 2B and FIG. 7. The oxides or inclusions are elongated as with MnS-based inclusions, deteriorating the stretch-flange formability. Further, multiply-precipitated MnS-based inclusions also coarsen, and hence, are likely to be elongated, which leads to a problem that the stretch-flange formability is more likely to deteriorate. Additionally, in Patent Document 5, Ti is added, and hence, coarsened inclusions precipitate as TiS. CaS or TiS is heterogeneously nucleated in the complex oxide including CaO—$Al_2O_3$-based oxide having the low melting point or Ti oxide. This leads to generation of coarsened CaO—$Al_2O_3$Ti oxide or CaSTiS composite oxysulfide. The oxide or oxysulfide forms clusters, and further coarsens, which largely affects the hole expandability. Further, the oxide or oxysulfide expands or breaks during rolling, causing a deterioration in the material.

According to the study made by the present inventors, the problems that Patent Documents 1, 2, 3, 4, and 5 have result mainly from existence of elongated sulfide-based inclusions formed mainly by MnS in the steel sheet as illustrated in FIG. 1B and FIG. 4, CaO—$Al_2O_3$-based inclusions having a low melting point as illustrated in FIG. 2A and FIG. 6, and CaS-based inclusions having coarsened and elongated Fe, Mn and O dissolved in solid solution or CaO—$Al_2O_3$ combined therewith as illustrated in FIG. 2B and FIG. 7, although formation of alumina inclusions that have an effect on the stretch-flange formability as illustrated in FIG. 1A and FIG. 5 is suppressed. In other words, if the steel sheet receives repetitive deformation, the internal defect occurs in the vicinity of the elongated and coarsened MnS-based inclusions existing in the surface layer or near the surface layer, and expands as a crack. This crack leads to the deterioration in the fatigue characteristics, and is likely to serve as the starting point of the crack during hole-expanding work or bending work, causing the deterioration in the stretch-flange formability and bending workability.

Next, a detailed description will be made of the existence of the sulfide-based inclusions formed mainly by MnS as described in Patent Documents 1, 2, 3, 4, and 5. As with C and Si, Mn is an element that effectively strengthens the material. Thus, in general, the concentration of Mn in the high-strength steel sheet is set higher to secure the strength of the steel. Further, through normal steel-producing processes, the steel contains S in the range of 5 ppm to 50 ppm. Thus, casted steels usually contain MnS.

At the same time, with the increase in soluble Ti, the soluble Ti partially combines with coarsened TiS or MnS, and (Mn, Ti)S precipitates. When the casted steel is subjected to hot rolling or cold rolling, the MnS-based inclusions and TiS deform during the rolling, and become elongated inclusions, causing the deterioration in the fatigue characteristics and the stretch-flange formability (hole expandability).

To deal with this, the invention described in Patent Document 4 disperses the MnS-based inclusions as fine spherical inclusions in the steel sheet to obtain favorable stretch-flange formability (hole expandability) and fatigue characteristics. However, this invention does not substantially perform Al deoxidation, and the steel sheet has high oxygen potential, which makes a desulfurization reaction less likely to occur. Thus, extremal values of components or formation of the inclusions are obtained to improve the material properties in a state where the steel sheet has a relatively high S concentration. This makes it impossible to remove the sulfur to the extremely low sulfur concentration.

Next, a detailed description will be made of the oxygen potential, the sulfur potential, and components or formation of the inclusions for improving the steel properties. In general, the acid-soluble Al is more likely to coarsen because of clustering of oxide in the acid-soluble Al, which deteriorates the stretch-flange formability, the bending workability, and the fatigue characteristics. Thus, it is desirable to reduce the acid-soluble Al as much as possible. For this reason, a desulfurization process is performed in a state where the oxygen potential is relatively high, and the concentration of acid-soluble Al does not exceed 0.01%.

The desulfurization reaction is a reducing reaction, and proceeds easily under the low oxygen potential circumstances. However, the sulfur potential is high in the high oxygen potential circumstances, and thus, it is extremely difficult to reduce the sulfur to the extremely low sulfur state. To deal with this, Ce and La are excessively added to reduce the oxygen potential as much as possible. However, this does not sufficiently reduce the oxygen potential, and requires high cost. In other words, on the basis of the concept that the effect of S is removed in the relatively high S concentration, the stretch-flange formability and the fatigue characteristics are improved by excessively adding Ce and La to control the component or formation for the inclusions.

However, when the component or formation of the inclusions is controlled by excessively adding Ce and La in order to remove the effect of S in the state where the concentration of S is relatively high, the degree of removal of the effect of S is limited because of its relatively high S concentration. For these reasons, there is a demand for high-strength steel sheets having more favorable stretch-flange formability (hole expandability) and fatigue characteristics.

However, there is no proposal of a high-strength steel sheet exhibiting excellent stretch-flange formability, bending workability, and fatigue characteristics, and a method of producing molten steel for the high-strength steel sheet, from the viewpoint of systematically controlling the operability during a steel-producing process, the oxygen potential, the sulfur potential, and the components and formation of the inclusions.

As with C and Si, Mn is an element that contributes to effectively enhancing the strength of the material, and hence, the concentration of Mn is generally set higher to obtain the strength of the high-strength steel sheet. Further, the steel sheet contains S of approximately 50 ppm through normal steel-producing processes. For this reason, a cast slab usually contains MnS. When the cast slab is subjected to hot rolling and cold rolling, these MnS-based inclusions elongate, since these MnS-based inclusions are likely to deform. This causes the deterioration in the bending workability and the stretch-flange formability (hole expandability). However, conventionally, there is no proposal of a high-strength steel sheet exhibiting excellent stretch-flange formability and bending workability, and a method of producing molten steel for the high-strength steel sheet from the viewpoint of controlling precipitation and deformation of the MnS-based inclusions described above.

In the case where, in Patent Document 5, with the aim of improving the operability, Al deoxidation is performed to improve the oxygen potential, the sulfur potential, and the material properties, Ca needs to be added. This leads to generation of oxide having a low melting point, deteriorating the material properties. In the molten steel, Ca exists in the form of liquid or vaporizes, and hence, first forms oxide having the low melting point. If such oxide in the form of liquid is first generated in the molten steel, these inclusions in the form of liquid aggregate to form coarsened CaO—$Al_2O_3$-based oxide having the low melting point, or CaS containing Fe, Mn or O in solid solution or having CaO—$Al_2O_3$ combined therewith. Thus, even if an attempt is made to control the formation of inclusions by adding Ce, La or the like thereafter, such control cannot be achieved.

The CaO—$Al_2O_3$-based oxide having a low melting point, the CaS-based inclusion containing Fe, Mn or O in solid solution or having CaO—$Al_2O_3$ combined therewith, and the MnS-based inclusion inevitably formed due to the addition of Mn are likely to deform when the ingot is subjected to the hot rolling and the cold rolling, and become elongated CaO—$Al_2O_3$-based oxide, or coarsened CaS-based inclusion or MnS-based inclusion, causing the deterioration in the bending workability and the stretch-flange formability (hole expandability). However, conventionally, there is no proposal of a high-strength steel sheet exhibiting excellent stretch-flange formability and bending workability, and a method of producing molten steel for the high-strength steel sheet, from the view point of controlling the precipitation or deformation of the CaO—$Al_2O_3$-based oxide, the coarsened CaS-based inclusion containing coarsened Fe, Mn or O in solid solution or having CaO—$Al_2O_3$ combined therewith, or the MnS-based inclusion described above.

Further, Ti forms fine TiN or TiC as precipitates, and hence, has an effect of enhancing the strength of the material. However, Ti also has a problem that Ti is likely to form coarsened TiS that deforms during rolling as described above.

The present invention has been made in view of the problems described above, and a first object of the present invention is to provide a high-strength steel sheet exhibiting excellent stretch-flange formability and bending workability and a method of producing molten steel for the high-strength steel sheet, by applying multiple deoxidation to molten steel in a steel producing stage to prevent generation of CaO—$Al_2O_3$-based oxide and coarsened CaS in an ingot, to make MnS multiple-precipitated fine inclusions in the oxide or oxysulfide formation, and to make MnS dispersed in the steel sheet as a fine spherical inclusion, which does not deform during rolling and is less likely to be a starting point of the occurrence of cracking, thereby improving the stretch-flange formability and the bending workability.

Further, the present invention has been made in view of the problems described above, and a second object of the present invention is to provide a high-strength steel sheet exhibiting excellent stretch-flange formability, bending workability, and fatigue characteristics and a method of producing molten steel for the high-strength steel sheet, by applying multiple deoxidation to molten steel in a steel-producing stage to prevent generation of CaO—$Al_2O_3$-based oxide, and CaS containing coarsened Fe, Mn or O dissolved in solid solution or having CaO—$Al_2O_3$ combined therewith in the ingot, while controlling generation of coarsened TiS that has an adverse effect on the hole expandability, thereby improving the stretch-flange formability, the bending workability, and the fatigue characteristics while obtaining high operability without increasing the cost.

Means for Solving the Problems

Main points of the present invention are as follows:

(1) A first aspect of the present invention provides a steel sheet including C: 0.03 to 0.25 mass %, Si: 0.1 to 2.0 mass %, Mn: 0.5 to 3.0 mass %, P: not more than 0.05 mass %, T.O: not more than 0.0050 mass %, S: 0.0001 to 0.01 mass %, N: 0.0005 to 0.01 mass %, acid-soluble Al: more than 0.01 mass %, Ca: 0.0005 to 0.0050 mass %, and a total of at least one element of Ce, La, Nd, and Pr: 0.001 to 0.01 mass %, with a balance including iron and inevitable impurities, in which the steel sheet contains a chemical component on a basis of mass that satisfies $0.7<100\times([Ce]+[La]+[Nd]+[Pr])/[\text{acid-soluble Al}]\leq 70$ and $0.2\leq([Ce]+[La]+[Nd]+[Pr])/[S]\leq 10$, where [Ce] is an amount of Ce contained, [La] is an amount of La contained, [Nd] is an amount of Nd contained, [Pr] is an amount of Pr contained, [acid-soluble Al] is an amount of acid-soluble Al contained, and [S] is an amount of S contained. The steel sheet has a compound inclusion including a first inclusion phase containing at least one element of Ce, La, Nd, and Pr, containing Ca, and containing at least one element of O and S, and a second inclusion phase having a component different from that of the first inclusion phase and containing at least one element of Mn, Si, and Al, the compound inclusion forms a spherical compound inclusion having an equivalent circle diameter in the range of 0.5 μm to 5 μm, and a ratio of the number of the spherical compound inclusion relative to number of all inclusions having the equivalent circle diameter in the range of 0.5 μm to 5 μm is 30% or more.

(2) In the high-strength steel sheet according to (1) above, the spherical inclusion may be an inclusion having an equivalent circle diameter of 1 μm or more, and the ratio of the number of elongated inclusions having a major axis/minor axis of 3 or less relative to number of all inclusions having the equivalent circle diameter of 1 μm or more may be 50% or more.

(3) In the high-strength steel sheet according to (1) or (2) above, the spherical inclusion may contain at least one element of Ce, La, Nd, and Pr, a total of which is in the range of 0.5 mass % to 95 mass % in an average composition.

(4) In the high-strength steel sheet according to any one of (1) to (3) above, an average grain diameter of a crystal in a structure of the steel sheet may be 10 μm or less.

(5) The high-strength steel sheet according to any one of (1) to (4) above may further contain at least one element of Nb: 0.01 to 0.10 mass %, and V: 0.01 to 0.10 mass %.

(6) The high-strength steel sheet according to any one of (1) to (5) above may further contain at least one element of: Cu: 0.1 to 2 mass %, Ni: 0.05 to 1 mass %, Cr: 0.01 to 1 mass %, Mo: 0.01 to 0.4 mass %, and B: 0.0003 to 0.005 mass %.

(7) The high-strength steel sheet according to any one of (1) to (6) above may further contain Zr: 0.001 to 0.01 mass %.

(8) The high-strength steel sheet according to any one of (1) to (4) above may further contain at least one element of Nb: 0.01 to 0.10 mass %, V: 0.01 to 0.10 mass %, Cu: 0.1 to 2 mass %, Ni: 0.05 to 1 mass %, Cr: 0.01 to 1 mass %, Mo: 0.01 to 0.4 mass %, B: 0.0003 to 0.005 mass %, and Zr: 0.001 to 0.01 mass %.

(9) A second aspect of the present invention provides a method of producing molten steel for the high-strength steel sheet according to any one of (1) to (4) above, having a refinement process for producing a steel, the refinement process including: a first process of obtaining a first molten steel including applying processing so as to obtain P of not more than 0.05 mass % and S of not less than 0.0001 mass %, and performing addition or adjustment such that C is not less than 0.03 mass % and not more than 0.25 mass %, Si is not less than 0.1 mass % and not more than 2.0 mass %, Mn is not less than 0.5 mass % and not more than 3.0 mass %, and N is not less than 0.0005 mass % and not more than 0.01 mass %; a second process of obtaining a second molten steel including performing addition to the first molten steel such that Al is more than 0.01 mass % in acid-soluble Al, and T.O is not more than 0.0050 mass %; a third process of obtaining a third molten steel including adding at least one element of Ce, La, Nd, and Pr to the second molten steel so as to satisfy on a basis of mass $0.7<100\times([Ce]+[La]+[Nd]+[Pr])/[\text{acid-soluble Al}]\leq 70$, $0.2\leq([Ce]+[La]+[Nd]+[Pr])/[S]\leq 10$, and $0.001\leq[Ce]+[La]+[Nd]+[Pr]\leq 0.01$, where [Ce] is an amount of Ce contained, [La] is an amount of La contained, [Nd] is an amount of Nd contained, [Pr] is an amount of Pr contained, [acid-soluble Al] is an amount of acid-soluble Al contained, and [S] is an amount of S contained; and a fourth process of obtaining a fourth molten steel including adding Ca to or performing adjustment to the third molten steel such that Ca is not less than 0.0005 mass % and not more than 0.0050 mass %.

(10) In the method of producing molten steel for a high-strength steel sheet according to (9) above, the third process may include, before the at least one element of Ce, La, Nd, and Pr is added to the second molten steel, adding at least one element of Nb and V to the second molten steel such that the second molten steel further contains at least one element of Nb of not less than 0.01 mass % and not more than 0.10 mass % and V of not less than 0.01 mass % and not more than 0.10 mass %.

(11) In the method of producing molten steel for a high-strength steel sheet according to (9) or (10) above, the third process may include, before the at least one element of Ce, La, Nd, and Pr is added to the second molten steel, adding at least one element of Cu, Ni, Cr, Mo, and B to the second molten steel such that the second molten steel further contains at least one element of Cu of not less than 0.1 mass % and not more than 2 mass %, Ni of not less than 0.05 mass % and not more than 1 mass %, Cr of not less than 0.01 mass % and not more than 1 mass %, Mo of not less than 0.01 mass % and not more than 0.4 mass %, and B of not less than 0.0003 mass % and not more than 0.005 mass %.

(12) The method of producing molten steel for a high-strength steel sheet according any one of (9) to (11) above, the third process may include, before the at least one element of Ce, La, Nd, and Pr is added to the second molten steel, adding Zr to the second molten steel such that the second molten steel further contains Zr of not less than 0.001 mass % to 0.01 mass %.

(13) A third aspect of the present invention provides a high-strength steel sheet including: C: 0.03 to 0.25 mass %, Si: 0.03 to 2.0 mass %, Mn: 0.5 to 3.0 mass %, P: not more than 0.05 mass %, T.O: not more than 0.0050 mass %, S: 0.0001 to 0.01 mass %, acid-soluble Ti: 0.008 to 0.20 mass %, N: 0.0005 to 0.01 mass %, acid-soluble Al: more than 0.01 mass %, Ca: 0.0005 to 0.005 mass %, and a total of at least one element of Ce, La, Nd, and Pr: 0.001 to 0.01 mass %, with a balance including iron and inevitable impurities, in which the steel sheet contains a chemical component on a basis of mass that satisfies $0.7<100\times([Ce]+[La]+[Nd]+[Pr])/[\text{acid-soluble Al}]\leq 70$, and $0.2\leq([Ce]+[La]+[Nd]+[Pr])/[S]\leq 10$, where [Ce] is an amount of Ce contained, [La] is an amount of La contained, [Nd] is an amount of Nd contained, [Pr] is an amount of Pr contained, [acid-soluble Al] is an amount of acid-soluble Al contained, and [S] is an amount of S contained. The steel sheet has a compound inclusion including a first inclusion phase containing at least one element of Ce, La, Nd, and Pr, containing Ca, and containing at least one element of O and S, and a second inclusion phase having a component different from that of the first inclusion phase and containing at least one element of Mn, Si, Ti, and Al, the compound inclusion forms a spherical compound inclusion having an equivalent circle diameter in the range of 0.5 μm to 5 μm, a ratio of the number of the spherical compound inclusion relative to number of all inclusions having the equivalent circle diameter in the range of 0.5 μm to 5 μm is 50% or more, and number density of an inclusion with more than 5 μm is less than 10 pieces/$mm^2$.

(14) In the high-strength steel sheet according to (13) above, the spherical inclusion may be an inclusion having an equivalent circle diameter of 1 μm or more, and the ratio of the number of elongated inclusions having a major axis/minor axis of 3 or less relative to number of all inclusions having the equivalent circle diameter of 1 μm or more is 50% or more.

(15) In the high-strength steel sheet according to (13) or (14) above, the spherical inclusion may contain at least one element of Ce, La, Nd, and Pr, a total of which is in the range of 0.5 mass % to 95 mass % in an average composition.

(16) In the high-strength steel sheet according to any one of (13) to (15) above, an average grain diameter of a crystal in a structure of the steel sheet may be 10 μm or less.

(17) The high-strength steel sheet according to any one of (13) to (16) above may further contain at least one element of Nb: 0.005 to 0.10 mass %, and V: 0.01 to 0.10 mass %.

(18) The high-strength steel sheet according to any one of (13) to (17) above may further contain at least one element of: Cu: 0.1 to 2 mass %, Ni: 0.05 to 1 mass %, Cr: 0.01 to 1.0 mass %, Mo: 0.01 to 0.4 mass %, and B: 0.0003 to 0.005 mass %.

(19) The high-strength steel sheet according to any one of (13) to (18) above may further contain Zr: 0.001 to 0.01 mass %.

(20) The high-strength steel sheet according to any one of (13) to (16) above may further contain at least one element of Nb: 0.005 to 0.10 mass %, V: 0.01 to 0.10 mass %, Cu: 0.1 to 2 mass %, Ni: 0.05 to 1 mass %, Cr: 0.01 to 1.0 mass %, Mo: 0.01 to 0.4 mass %, B: 0.0003 to 0.005 mass %, and Zr: 0.001 to 0.01 mass %.

(21) A fourth aspect of the present invention provides a method of producing molten steel for the high-strength steel sheet according to any one of (13) to (16) above, having a refinement process for producing a steel, the refinement process including: a first process of obtaining a first molten steel including: applying processing so as to obtain P of not more than 0.05 mass % and S of not less than 0.0001 mass % and not more than 0.01 mass %, and performing addition or adjustment such that C is not less than 0.03 mass % and not more than 0.25 mass %, Si is not less than 0.03 mass % and not more than 2.0 mass %, Mn is not less than 0.5 mass % and not more than 3.0 mass %, and N is not less than 0.0005 mass % and not more than 0.01 mass %; a second process of obtaining a second molten steel including performing addition to the first molten steel such that Al is more than 0.01 mass % in acid-soluble Al, and T.O is not more than 0.0050 mass %; a third process of obtaining a third molten steel including adding Ti of not less than 0.008 mass % and not more than 0.20 mass % in acid-soluble Ti to the second molten steel; a fourth process of obtaining a fourth molten steel including adding at least one element of Ce, La, Nd, and Pr to the third molten steel so as to satisfy on a basis of mass $0.7<100\times([Ce]+[La]+[Nd]+[Pr])/[\text{acid-soluble Al}]\leq 70$, $0.2\leq([Ce]+[La]+[Nd]+[Pr])/[S]\leq 10$, and $0.001\leq[Ce]+[La]+[Nd]+[Pr]\leq 0.01$, where [Ce] is an amount of Ce contained, [La] is an amount of La contained, [Nd] is an amount of Nd contained, [Pr] is an amount of Pr contained, [acid-soluble Al] is an amount of acid-soluble Al contained, and [S] is an amount of S contained; and a fifth process of obtaining a fifth molten steel including adding Ca to or performing adjustment to the fourth molten steel such that Ca is not less than 0.0005 mass % and not more than 0.0050 mass %.

(22) In the method of producing molten steel for a high-strength steel sheet according to (21) above, the third process may include, before the at least one element of Ce, La, Nd, and Pr is added to the second molten steel, adding at least one element of Nb and V to the second molten steel such that the second molten steel further contains at least one element of Nb of not less than 0.005 mass % and not more than 0.10 mass %, and V of not less than 0.01 and not more than 0.10 mass %.

(23) In the method of producing molten steel for a high-strength steel sheet according to (21) or (22) above, the third process may include, before the at least one element of Ce, La, Nd, and Pr is added to the second molten steel, adding at least one element of Cu, Ni, Cr, Mo, and B to the second molten steel such that the second molten steel further contains at least one element of Cu of not less than 0.1 mass % and not more than 2 mass %, Ni of not less than 0.05 mass % and not more than 1 mass %, Cr of not less than 0.01 mass % and not more than 1 mass %, Mo of not less than 0.01 mass % and not more than 0.4 mass %, and B of not less than 0.0003 mass % and not more than 0.005 mass %.

(24) In the method of producing molten steel for a high-strength steel sheet according to any one of (21) to (23) above, the third process may include, before the at least one element of Ce, La, Nd, and Pr is added to the second molten steel, adding Zr to the second molten steel such that the second molten steel further contains Zr of not less than 0.001 mass % and not more than 0.01 mass %.

Effects of the Invention

According to the high-strength steel sheet exhibiting excellent stretch-flange formability and bending workability of the first aspect of the present invention, it is possible to improve the stretch-flange formability and the bending workability, by stably adjusting components in the molten steel through Al deoxidation, suppressing generation of coarsened alumina inclusions, and precipitating fine inclusions multiple-precipitated in the ingot in the formation of oxide or oxysulfide to disperse the inclusions in the steel sheet as fine spherical inclusions that do not deform during rolling and are less likely to be a starting point of the occurrence of cracking, while making the crystal grain diameter fine in the structure.

According to the method of producing molten steel for the high-strength steel sheet exhibiting excellent stretch-flange formability and bending workability of the second aspect of the present invention, it is possible to obtain the high-strength hot-rolled steel sheet exhibiting excellent stretch-flange formability and bending workability, by stably adjusting components in the molten steel through Al deoxidation, suppressing generation of coarsened alumina inclusions, and precipitating fine compound inclusions formed by oxide or oxysulfide multiple-precipitated in the ingot to disperse the inclusions in the steel sheet as fine spherical inclusions that do not deform during rolling and are less likely to be a starting point of the occurrence of cracking, while making the crystal grain diameter fine in the structure.

According to the high-strength steel sheet exhibiting excellent stretch-flange formability and bending workability of the third aspect of the present invention, it is possible to improve the stretch-flange formability and the bending workability, by stably adjusting components in the molten steel through Al deoxidation, deoxidation with Ce, La, Nd and Pr, and then Ca deoxidation, suppressing generation of coarsened alumina inclusions, and generating compound inclusions formed by different fine inclusion phases in the cast slab to disperse the compound inclusions in the steel sheet as fine spherical inclusions that do not deform during rolling and are less likely to be a starting point of the occurrence of cracking, while making the crystal grain diameter fine in the structure.

According to the method of producing molten steel for the high-strength steel sheet exhibiting excellent stretch-flange formability and bending workability of the fourth aspect of the present invention, it is possible to obtain the high-strength hot-rolled steel sheet exhibiting excellent stretch-flange formability and bending workability, by stably adjusting components in the molten steel through deoxidation with Ce, La, Nd and Pr, and Ca deoxidation thereafter, suppressing generation of coarsened alumina inclusions, and generating compound inclusions formed by different fine inclusion phases in the case slab to disperse the inclusions in the steel sheet as fine spherical inclusions that do not deform during rolling and are less likely to be a starting point of the occurrence of cracking, while making the crystal grain diameter fine in the structure by adding Ti.

EMBODIMENTS OF THE INVENTION

First Embodiment

Figure 1A:
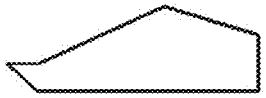
FIG. 1A is a diagram for explaining $Al_2O_3$, which is an elongated inclusion existing in a hot-rolled steel sheet.

The present inventors made a study mainly of a method of improving the stretch-flange formability and the bending workability by precipitating fine MnS inclusions in an ingot (cast slab), and dispersing the inclusions in the steel sheet as fine spherical inclusions that do not deform during rolling and are less likely to be a starting point of the occurrence of cracking, and of finding additive elements that do not deteriorate the fatigue characteristics.

As a result, the present inventors found that the hole-expandability or other properties can be improved in a manner such that: fine and hard Ce oxide, La oxide, Nd oxide, Pr oxide, cerium oxysulfide, lanthanum oxysulfide, neodymium oxysulfide, and/or praseodymium oxide are/is formed through deoxidation with addition of Ce, La, Nd and/or Pr; a compound inclusion containing an inclusion phase including at least one element of Ce, La, Nd, and Pr, Ca, and at least one element of O and S, and an inclusion phase further including at least one element of Mn, Si, and Al, the components of these inclusion phases being different from each other, is further formed through combination with Ca added; and this compound inclusion is formed into a spherical inclusion having an equivalent circle diameter in the range of 0.5 μm to 5 μm. With these formations, precipitated MnS is less likely to deform even during rolling, and hence, the steel sheet has a significantly reduced number of enlarged and coarsened MnS. Further, MnS-based inclusion is less likely to be a starting point of the occurrence of cracking or a pathway of crack propagation even during the repetitive deformation, hole-expanding working or bending working, so that hole-expandability can be improved.

In addition to forming the precipitates into fine oxide and fine MnS-based inclusions, the present inventors also made a study of sequentially applying multiple deoxidation with Si, Al, (Ce, La, Nd, Pr), and Ca to reduce sulfur to the low sulfur concentration so as to reliably fix the residual sulfur to be fine and hard inclusions. As a result, the present inventors found that, for molten steel subjected first to deoxidation with Si, second to deoxidation with Al, and then to deoxidation with addition of at least one element of Ce, La, Nd, and Pr, it is possible to significantly improve the stretch-flange formability and the bending workability, in a manner such that: by obtaining predetermined (Ce+La+Nd+Pr)/acid-soluble Al and (Ce+La+Nd+Pr)/S on the basis of mass and adding Ca at the end, oxygen potential in the molten steel can be reduced; under this reduced oxygen potential, sulfur can be reduced to the extremely low sulfur concentration in a relatively easy manner, and fine MnS-based inclusions can be obtained; and this makes it possible to reliably fix the residual sulfur to be fine and hard inclusions.

Hereinbelow, a high-strength steel sheet exhibiting excellent stretch-flange formability and bending workability will be described in detail as a first embodiment according to the present invention. Below, the unit "mass %" used for compositions will be expressed simply as "%." Note that the high-strength steel sheet in the present invention includes a steel sheet subjected to normal hot rolling and/or cold rolling and used as it is without applying further treatment thereto, and a steel sheet used after application of surface treatment such as plating and coating.

First, experiments concerning the first embodiment according to the present invention will be described.

The present inventors produced a steel ingot by subjecting molten steel containing C: 0.06%, Si: 1.0%, Mn: 1.4%, P: 0.01% or less, S: 0.005%, and N: 0.003% with a balance including Fe to deoxidation using various elements. The obtained steel ingot is hot rolled to form a hot-rolled steel sheet having a thickness of 3 mm. For the obtained hot-rolled steel sheet, a tensile test, a hole-expanding test, and a bending test were performed, and examination was made on number density of inclusions, formation and average composition in the steel sheet.

Figure 1B:
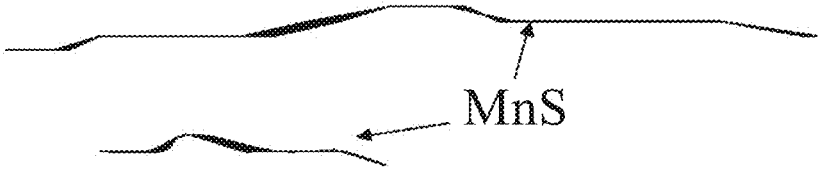
FIG. 1B is a diagram for explaining MnS, which is an elongated inclusion existing in the hot-rolled steel sheet.

First, in the hot-rolled steel sheet produced by adding Si to the molten steel, and then subjecting the molten sheet to Al deoxidation, $Al_2O_3$-based inclusions precipitated in the steel ingot as inclusions had a high melting temperature of 2040° C., and remained in an angulated shape without being elongated during rolling as illustrated in FIG. 1A. Thus, these inclusions serve as a starting point of cracking of the steel sheet during hole-expanding work, causing the deterioration in the bending workability and the stretch-flange formability (hole expandability). The coarsened MnS-based inclusions precipitated in the steel ingot as inclusions had a low melting point of 1610° C., and were easily elongated during rolling as illustrated in FIG. 1B to form elongated MnS-based inclusions. Further, these inclusions serve as a starting point of cracking of the steel sheet during hole-expanding work.

Figure 2A:
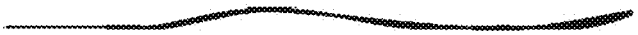
FIG. 2A is a diagram for explaining an elongated $CaOAl_2O_3$-based inclusion existing in the hot-rolled steel sheet.
Figure 2B:
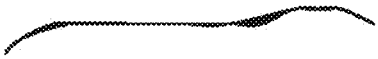
FIG. 2B is a diagram for explaining an elongated CaS-based inclusion existing in the hot-rolled steel sheet.

In the hot-rolled steel sheet produced by adding Ca after the deoxidation with Al, Ca is melted and aggregates with interfacial energy to be a larger size. Then, Ca precipitates as coarsened CaO—$Al_2O_3$-based inclusions or CaS(Fe, Mn, $Al_2O_3$)-based inclusions in the ingot. These inclusions have a melting point of approximately 1390° C. Thus, these inclusions were easily elongated during rolling as illustrated in FIG. 2A and FIG. 2B to form elongated inclusions having a size in the range of approximately 50 μm to 100 μm, causing the deterioration in the bending workability and the stretch-flange formability (hole expandability).

Further, examination was made on the stretch-flange formability and the bending workability of a steel sheet produced by adding Si to a molten steel, subjecting the molten steel to deoxidation with Al, agitating the molten steel for approximately 2 minutes, and adding at least one element of Ce, La, Nd, and Pr for deoxidation. As a result, with the steel sheet subjected to the sequential three-step deoxidation with Si, Al, and at least one element of Ce, La, Nd, and Pr as described above, it is confirmed that the stretch-flange formability and the bending workability can be further improved. This is because MnS is precipitated on the fine and hard Ce oxide, La oxide, Nd oxide, Pr oxide, cerium oxysulfide, lanthanum oxysulfide, neodymium oxysulfide, and/or praseodymium oxysulfide generated through deoxidation with addition of Ce, La, Nd, and/or Pr, and it is possible to suppress deformation of the multiple-precipitated oxide or oxysulfide inclusions during rolling, whereby the number of elongated and coarsened MnS-based inclusions in the steel sheet can be significantly reduced.

It should be noted that the mechanism of making finer the Ce oxide, the La oxide, the Nd oxide, the Pr oxide, the cerium oxysulfide, the lanthanum oxysulfide, the neodymium oxysulfide and the praseodymium oxysulfide is that: Al added later causes reductive decomposition of the $SiO_2$-based inclusions generated first through the Si deoxidation, thereby forming fine $Al_2O_3$-based inclusions; Ce, La, Nd, and/or Pr is subjected to reductive decomposition to form fine Ce oxide, La oxide, Nd oxide, Pr oxide, cerium oxysulfide, lanthanum oxysulfide, neodymium oxysulfide, and/or praseodymium oxysulfide; and since the interfacial energy between the molten steel and the generated Ce oxide, La oxide, Nd oxide, Pr oxide, cerium oxysulfide, lanthanum oxysulfide, neodymium oxysulfide, and praseodymium oxysulfide is low, it is possible to suppress aggregation of the generated oxides and oxysulfides.

The present inventors further produced a steel ingot by then applying Al deoxidation, applying deoxidation while changing compositions of Ce, La, Nd, and Pr, and then adding Ca. Thus, the obtained steel ingot was hot rolled to form a hot-rolled steel sheet having a thickness of 3 mm. For the obtained hot-rolled steel sheet, a hole-expanding test and a bending test were performed, and examination was made on the number density of inclusions, formation and average composition in the steel sheet.

Through experiments described above, it was found that, by setting a ratio (Ce+La+Nd+Pr)/acid-soluble Al in the range of 0.7 to 70 and a ratio of (Ce+La+Nd+Pr)/S in the range of 0.2 to 10 on the basis of mass, the oxygen potential sharply decreases in molten steel obtained through multiple deoxidation of adding Si, applying deoxidation with Al, applying deoxidation with addition of at least one element of Ce, La, Nd, and Pr, and then adding Ca. In other words, with the effect obtained through the multiple deoxidation with Al, Si, (Ce, La, Nd, Pr), and Ca, it is possible to obtain the largest oxygen-potential-reducing effect that conventional deoxidation applications can obtain with various deoxidation elements. With the effect of multiple deoxidation, it is possible to extremely lower the $Al_2O_3$ concentration in the generated oxides, and hence, it is possible to obtain a steel sheet exhibiting excellent stretch-flange formability and bending workability as with steel sheets produced with little deoxidation with Al.

Figure 3A:
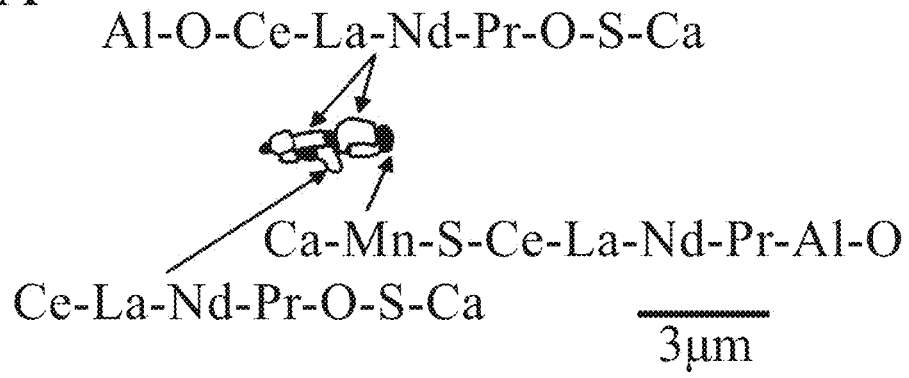
FIG. 3A is a diagram for explaining a compound inclusion relating to a first embodiment of the present invention, and is a diagram illustrating an example of how a first inclusion exists.
Figure 3B:
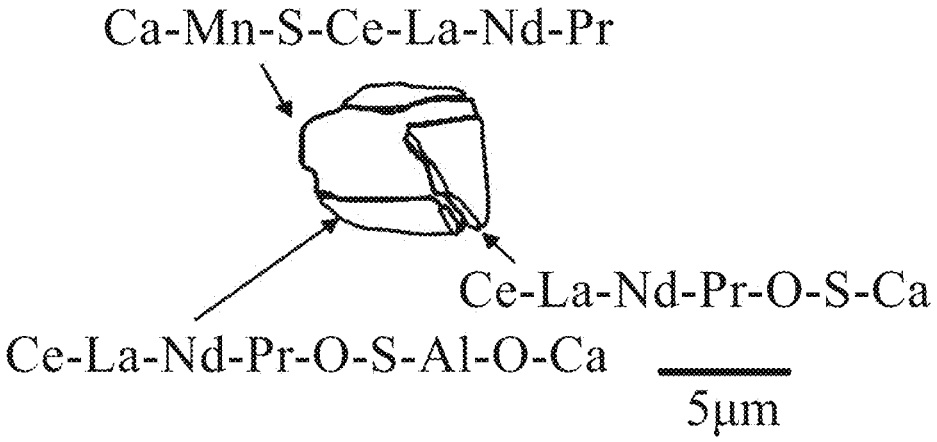
FIG. 3B is a diagram for explaining a compound inclusion relating to the first embodiment of the present invention, and is a diagram illustrating an example of how a second inclusion exists.

The reason for this is considered to be as follows:

By adding Si, $SiO_2$ inclusions are generated, and then, $SiO_2$ inclusions are reduced to be Si by adding Al. Further, while subjecting $SiO_2$ inclusions to reduction, Al removes the dissolved oxygen in the molten steel to form $Al_2O_3$-based inclusions. Part of the $Al_2O_3$-based inclusions rise to the surface and are removed, whereas the rest of the $Al_2O_3$-based inclusions remain in the molten steel. After this, with the added (Ce, La, Nd, Pr), the $Al_2O_3$-based inclusions are subjected to reductive decomposition to form fine and spherical Ce oxide, La oxide, Nd oxide, Pr oxide, and REM oxysulfide such as cerium oxysulfide, lanthanum oxysulfide, neodymium oxysulfide, and praseodymium oxysulfide. Then, Ca is added to precipitate $Al_2O_3$, MnS, CaS, (MnCa)S or other precipitations in the oxides and/or oxysulfides, thereby forming a spherical compound inclusion containing an Al—O—Ce—La—Nd—Pr—O—S—Ca inclusion phase [for example, $Al_2O_3$(Ce, La, Nd, Pr)$_2O_2$SCa], a Ca—Mn—S—Ce—La—Nd—Pr—Al—O inclusion phase [for example, CaMnS(Ce, La, Nd, Pr)$Al_2O_3$], and a Ce—La—Nd—Pr—O—S—Ca inclusion phase [for example, (Ce, La, Nd, Pr)$_2O_2$SCa] as illustrated in FIG. 3A, which are inclusion phases in solid solution and combined with each other to form one inclusion, or a spherical compound inclusion containing a Ca—Mn—S—Ce—La—Nd—Pr inclusion phase [for example, CaMnS(Ce, La, Nd, Pr)], a Ce—La—Nd—Pr—O—S—Ca inclusion phase [for example, (Ce, La, Nd, Pr)$_2O_2$SCa], and a Ce—La—Nd—Pr—O—S—Al—O—Ca inclusion phase [for example, (Ce, La, Nd, Pr)$_2O_2SAl_2O_3$Ca] as illustrated in FIG. 3B, which are combined with each other to form one inclusion. These compound inclusions are formed mainly by oxysulfide of at least one element of Ce, La, Nd, and Pr and have a substantially spherical shape. Thus, it is considered that these compound inclusions are formed such that, during processes in which added metals such as Ce, La, Nd and Pr are melted and react to form oxysulfide, a large number of extremely fine cores are formed, and then, are subjected to phase separation to form the compound inclusions, or a phase having a lower melting point is partially melted and adhere to a phase having a higher melting point.

These fine and spherical compound inclusions have a high melting point of approximately 2000° C., and do not elongate during hot rolling. This makes these compound inclusions remain in the fine and spherical formation in the hot-rolled steel sheet. Thus, by forming the spherical compound inclusion (REM oxysulfide compound inclusion) having the oxide or oxysulfide formation obtained through the multiple precipitations as described above, it is possible to eliminate the cause of deteriorating the bending workability and the stretch-flange formability (hole expandability).

With four steps of multiple deoxidation through the addition of Al, Si, (Ce, La, Nd, Pr), and Ca, it is considered that: although $Al_2O_3$ slightly remains, in most part, there exist fine and hard oxides or oxysulfides having an equivalent circle diameter in the range of 0.5 μm to 5 μm and formed by at least one element of Ce, La, Nd, and Pr; in these oxides or oxysulfides, oxides containing at least one element of Si, Al, and Ca are multiple precipitated; and, a spherical compound inclusion (REM oxysulfide compound inclusion) having the oxide or oxysulfide formation in which at least one of MnS, CaS, and (Mn, Ca)S is multiple precipitated is generated.

It should be noted that the fine spherical composite compound cannot be obtained if Ca is added before the addition of (Ce, La, Nd, Pr).

As described above, the present inventors newly found that, by appropriately performing the deoxidation method using the multiple deoxidation with the addition of Al, Si, (Ce, La, Nd, Pr), and Ca in the order in which they appear, it is possible to precipitate the fine and hard spherical compound inclusions (REM oxysulfide compound inclusion) as described above, and to suppress the deformation of the multiple-precipitated inclusions even during rolling work. This enables the significant reduction in the number of the elongated and coarsened MnS-based inclusions in the steel sheet, whereby it is possible to obtain the effect of improving the bending workability or other properties. Further, with the multiple deoxidation, the oxygen potential in the molten steel can be reduced, whereby it is possible to reduce the unevenness in the components.

On the basis of the findings obtained from experiments, the present inventors examined conditions for chemical components in the steel sheet in the following manner, and designed the components in the steel sheet.

Next, a description will be made of chemical components in the high-strength steel sheet according to this embodiment exhibiting excellent stretch-flange formability and bending workability.

[C: 0.03% to 0.25%]

C is the most fundamental element that controls the hardenability and the strength of the steel, and increases the hardness of and the depth of the quench hardening layer, effectively contributing to improving the fatigue strength. In other words, C is an essential element for securing the strength of the steel sheet, and C of at least 0.03% is necessary to obtain the high-strength steel sheet. However, in the case where the amount of C exceeds 0.25%, the workability and the weldability deteriorate. In order to obtain the required strength while achieving the workability and the weldability, the concentration of C is set to be not more than 0.25% in the high-strength steel sheet according to this embodiment. Thus, the lower limit of C is set to 0.03%, preferably to 0.04%, more preferably to 0.06%. The upper limit of C is set to 0.25%, preferably to 0.20%, more preferably to 0.15%.

[Si: 0.1% to 2.0%]

Si is a primary deoxidation element, which increases the number of nucleation site of austenite during heating in the hardening, suppresses the grain growth in the austenite, and reduces the grain diameter in the quench hardened layer. Si suppresses the generation of carbides to prevent the reduction in the strength of the grain boundaries due to the carbides, and is effective in generating a bainite structure. Thus, Si is an important element to improve the strength without causing the deterioration in the elongation property, and improve the hole-expandability with a low yield strength ratio. In order to reduce the dissolved oxygen concentration in the molten steel, generate the $SiO_2$-based inclusion once, and obtain the minimum value of the final dissolved oxygen through the multiple deoxidation (this $SiO_2$-based inclusion is subjected to reduction with Al added later to form the alumina-based inclusion, and then, reduction with Ce, La, Nd, and/or Pr is applied to subject the alumina-based inclusion to reduction), it is necessary to add Si of 0.1% or more. For this reason, in the high-strength steel sheet according to this embodiment, the lower limit of Si is set to 0.1%. In the case where the concentration of Si is excessively high, toughness and ductility significantly deteriorate, and the decarburization of the surface and the damage of the surface increase, resulting in deteriorated bending workability. Further, in the case where Si is excessively added, Si has an adverse effect on the weldability and the ductility. For these reasons, in the high-strength steel sheet according to this embodiment, the upper limit of Si is set to 2.0%. Accordingly, the lower limit of Si is set to 0.1%, preferably to 0.2%, more preferably to 0.5%. The upper limit of Si is set to 2.0%, preferably to 1.8%, more preferably to 1.3%.

[Mn: 0.5% to 3.0%]

Mn is an element useful for deoxidation in the steel-producing stage, and is an element effective in enhancing the strength of the steel sheet as with C and Si. In order to obtain such an effect, it is necessary to make the steel sheet contain Mn of 0.5% or more. However, in the case where the amount of Mn contained exceeds 3.0%, Mn segregates or the solid solution strengthening increases, reducing the ductility. Further, the weldability and the toughness of the base material also deteriorate. For these reasons, the upper limit of Mn is set to 3.0%. Thus, the lower limit of Mn is set to 0.5%, preferably to 0.9%, more preferably to 1%. The upper limit of Mn is set to 3.0%, preferably to 2.6%, more preferably to 2.3%.

[P: 0.05% or Less]

P is an element inevitably contained in the steel, and is effective in that P functions as a substitutional solid-solution strengthening element having a size smaller than Fe atom. However, in the case where the concentration of P exceeds 0.05%, P segregates in the grain boundaries of austenite, and the strength of the grain boundaries deteriorates, reducing the torsion fatigue strength and possibly causing deterioration in the workability. Thus, the upper limit of P is set to 0.05%, preferably to 0.03%, more preferably to 0.025%. If the solid solution strengthening is not required, P is not necessary to be added, and hence, the lower limit value of P includes 0%.

[T.O: 0.0050% or Less]

T.O forms oxide as an impurity. In the case where the amount of T.O is excessively high, the $Al_2O_3$-based inclusion increases, and the oxygen potential in the steel cannot be made minimized. This leads to the significant deterioration in the toughness and ductility, and an increase in the surface damage, resulting in the deterioration in the bending workability. For these reasons, in the high-strength steel sheet according to this embodiment, the upper limit of T.O is set to 0.0050%, preferably to 0.0045%, more preferably to 0.0040%.

[S: 0.0001% to 0.01%]

S segregates as an impurity, and combines with Mn to form a coarsened and elongated MnS-based inclusion, which deteriorates the stretch-flange formability. Thus, it is desirable to reduce the concentration of S as much as possible. By controlling the formation of the coarsened and elongated MnS-based inclusion in the high-strength steel sheet according to this embodiment, it is possible to obtain the material more than or equivalent to the cost without requiring the desulfurization load in the secondary refinement and without the need of the desulfurization cost, even if the steel sheet contains a relatively high S concentration of approximately 0.01%. Thus, in the high-strength steel sheet according to this embodiment, the concentration of S is set in the range of the extremely low S concentration, which is a concentration obtained on the assumption that desulfurization is performed in the secondary refinement, to the relatively high S concentration, that is, the concentration of S is set in the range of 0.0001% to 0.01%.

Further, in the high-strength steel sheet according to this embodiment, the MnS-based inclusion is precipitated and dissolved in solid solution on the compound inclusion formed by the fine and hard Ce oxide, La oxide, Nd oxide, Pr oxide, cerium oxysulfide, lanthanum oxysulfide, neodymium oxysulfide, praseodymium oxysulfide, Ca oxide and the like, and the formation of the MnS-based inclusion is controlled. This makes the MnS-based inclusion less likely to deform during rolling work, and prevents the elongation of the inclusion. Thus, the upper limit value of the concentration of S is set on the basis of the relationship with the total amount of at least one element of Ce, La, Nd, and Pr as described later. Further, in the case where the concentration of S exceeds 0.01%, the cerium oxysulfide and the lanthanum oxysulfide grow to be over 2 μm in size. These coarsened oxysulfides make the toughness and the ductility significantly deteriorate, leading to the increase in the surface damages and deteriorating the bending workability. For these reasons, in the high-strength steel sheet according to this embodiment, the upper limit of S is set to 0.01%, preferably to 0.008%, more preferably to 0.006%.

In other words, according to the high-strength steel sheet according to this embodiment, the formation of MnS is controlled with the inclusions of the Ce oxide, the La oxide, the cerium oxysulfide, the lanthanum oxysulfide, the neodymium oxysulfide, and the praseodymium oxysulfide, or the Ca oxide or other elements as described above. Thus, even if the concentration of S is relatively high but not more than 0.01%, by adding the corresponding amount of at least one of Ce and La, it is possible to prevent the occurrence of adverse effects on the material. In other words, even if the concentration of S is relatively high, by adjusting the amount of Ce or La added so as to correspond to the amount of S, it is possible to substantially obtain the desulfurization effect, and it is possible to obtain a material equivalent to the ultra-low sulfur steel. This means that, by appropriately adjusting the concentration of S in association with the total amount of Ce, La, Nd and Pr, it is possible to increase the flexibility in the upper limit of the concentration of S. Thus, the high-strength steel sheet according to this embodiment does not require desulfurization of the molten steel in the secondary refinement to obtain the ultra-low sulfur steel, and can omit the desulfurization process. This enables simplification of the producing processes, and reduction in the cost required for the accompanying desulfurization process.

[N: 0.0005% to 0.01%]

N is captured from air during the steel-melting process, and hence, is an element that is inevitably contained in the steel. N forms nitrides with Al or other elements, and promotes reduction in size of grains in the base material structure. However, in the case where the amount of N contained exceeds 0.01%, N generates coarsened precipitates, for example, with Al, deteriorating the stretch-flange formability. For this reason, in the high-strength steel sheet according to this embodiment, the upper limit of the concentration of N is set to 0.01%, preferably to 0.005%, more preferably to 0.004%. On the other hand, the cost required for lowering the N concentration to less than 0.0005% is high, and hence, the lower limit of the N concentration is set to 0.0005% from the viewpoint of industrial feasibility.

[Acid-Soluble Al: Over 0.01%]

In general, an oxide of acid-soluble Al forms a cluster and is likely to coarsen, which leads to the deterioration in the stretch-flange formability and the bending workability. Thus, it is desirable to reduce acid-soluble Al as much as possible. However, according to the high-strength steel sheet according to this embodiment, a range of amount of acid-soluble Al was newly found, which enables obtaining the ultra-low oxygen potential as described above while preventing clustering and coarsening of alumina-based inclusion, by employing Al deoxidation and the deoxidation effect obtained by sequentially applying multiple deoxidation with Si, Ti, and at least one element of Ce, La, Nd, and Pr, and adjusting the (Ce, La, Nd, Pr) concentration so as to correspond to the concentration of acid-soluble Al. In this range, part of the $Al_2O_3$-based inclusions generated through Al deoxidation rise to the surface and are removed, whereas the rest of the $Al_2O_3$-based inclusions remaining in the molten steel are subjected to reductive decomposition with the Ce and La added later, and the clustered alumina-based oxide is decomposed to form the fine inclusions.

With this finding, according to the high-strength steel sheet according to this embodiment, it is possible to eliminate the need for setting the limitation that Al is substantially not added in order to avoid the coarsened cluster of the alumina-based inclusion as in the conventional art. In particular, it is possible to increase the flexibility in the concentration of the acid-soluble Al. By setting the concentration of acid-soluble Al to more than 0.01%, it is possible to employ both Al deoxidation and deoxidation with addition of Ce and La, thereby eliminating the need for adding deoxidation element of Ce and La more than necessary as in the conventional art. This makes it possible to solve the problem of an increase in the oxygen potential in the steel due to deoxidation with Ce and La. Further, it is possible to obtain the effect of reducing the variation in the composition of the component elements. The lower limit of acid-soluble Al is set preferably to 0.013%, more preferably to 0.015%.

The upper limit value of the acid-soluble Al concentration can be set on the basis of $70 \geq 100 \times (Ce+La+Nd+Pr)/\text{acid-soluble Al} > 0.7$, which is expressed on the basis of mass and is a relationship between the acid-soluble Al and the total amount of at least one element of Ce, La, Nd, and Pr as described later. However, the upper limit of the acid-soluble Al concentration may be set to 1% or less from the viewpoint of the cost required for adding the alloy of Al, Ce, La, Nd, and Pr.

In this specification, the term "acid-soluble Al concentration" refers to a measured concentration of Al dissolved in acid, and this measurement employs a characteristic in which dissolved Al is dissolved in acid whereas $Al_2O_3$ is not dissolved in acid. In this specification, the term "acid" refers, for example, to a mixed acid having mass ratio of hydrochloric acid: 1, nitric acid: 1, and water: 2. By using such an acid, it is possible to separate Al soluble in the acid and $Al_2O_3$ non-soluble to the acid, whereby it is possible to measure the acid-soluble Al concentration.

[Ca: 0.0005% to 0.0050%]

In the high-strength steel sheet according to this embodiment, Ca is an important element, which controls the formation of desulfurization such as formation of spherical sulfides, and also has an effect of causing at least one of MnS, CaS, and (Mn, Ca)S to be precipitated and dissolved in solid solution in the oxide or oxysulfide obtained through multiple precipitations to form a compound inclusion, thereby improving the stretch-flange formability and the bending workability of the steel. In order to obtain these effects, it is preferable to set the amount of Ca added to 0.0005% or more. However, even if the amount of Ca contained is excessively high, the effect obtained from the addition of Ca saturates, and Ca impairs cleanliness of the steel, deteriorating the ductility of the steel. For these reasons, the upper limit of the amount of Ca is set to 0.0050%. The lower limit of Ca is set to 0.0005%, preferably to 0.0007%, more preferably to 0.001%, whereas the upper limit of Ca is set to 0.0050%, preferably to 0.0045%, more preferably to 0.0035%.

[Total of at Least One Element of Ce, La, Nd, and Pr: 0.001% to 0.01%]

Ce, La, Nd, and Pr have an effect of: reducing $SiO_2$ generated through Si deoxidation and $Al_2O_3$ generated sequentially through Al deoxidation; separating $Al_2O_3$ clusters, which are likely to coarsen; and forming a hard and fine inclusion having a main phase (target concentration of 50% or more) of Ce oxide (for example, $Ce_2O_3$ and $CeO_2$), cerium oxysulfide (for example, $Ce_2O_2S$), La oxide (for example, $La_2O_3$ and $LaO_2$), lanthanum oxysulfide (for example, $La_2O_2S$), Nd oxide (for example, $Nd_2O_3$), Pr oxide (for example, $Pr_6O_{11}$), Ce oxide-La oxide-Nd oxide-Pr oxide, or cerium oxysulfide-lanthanum oxysulfide, which are likely to be a precipitation site for the MnS-based inclusion and are less likely to deform during rolling. Note that it is preferable to use Ce and La from among Ce, La, Nd and Pr.

The above-described inclusion may partially contain MnO, $SiO_2$, or $Al_2O_3$ depending on deoxidation conditions. However, this inclusion sufficiently functions as the precipitation site for the MnS-based inclusion, and the effect of providing the fine and hard inclusion is not impaired, provided that this inclusion has the main phase formed by the oxides described above.

Through experiments, it is found that, in order to obtain such an inclusion, it is necessary to set the total concentration of at least one element of Ce, La, Nd, and Pr to be not less than 0.001% and not more than 0.01%.

In the case where the total concentration of at least one element of Ce, La, Nd, and Pr is less than 0.001%, $SiO_2$ and $Al_2O_3$ inclusions cannot be deoxidized. On the other hand, in the case where the total amount exceeds 0.01%, at least one of cerium oxysulfide, lanthanum oxysulfide, neodymium oxysulfide, and praseodymium oxysulfide is excessively generated, and the generated oxysulfide forms coarsened inclusions, deteriorating the stretch-flange formability and the bending workability. Note that the preferable lower limit of the total concentration of at least one element of Ce, La, Nd, and Pr is set to 0.0013%, and the more preferable lower limit thereof is set to 0.0015%. The preferable upper limit of the total concentration of at least one element of Ce, La, Nd, and Pr is set to 0.009%, and the more preferable upper limit is set to 0.008%.

As conditions for the existence of inclusions having a formation in which MnS is precipitated in the oxide or oxysulfide formed by at least one element of Ce, La, Nd, and Pr in the high-strength steel sheet according to this embodiment, the present inventors focused on the fact that it is possible to determine the degree of improvement of MnS with the oxide or oxysulfide formed by at least one of Ce, La, Nd, and Pr, by specifying the degree of improvement using the concentration of S. Then, the present inventors reached an idea of specifying and simplifying the degree of improvement using a mass ratio of chemical components (Ce+La+Nd+Pr)/S in the steel sheet. More specifically, in the case where this mass ratio is low, the number of the oxide or oxysulfide formed by at least one element of Ce, La, Nd, and Pr is small, and a large number of MnS is precipitated alone. In the case where this mass ratio is high, the number of the oxide or oxysulfide formed by at least one element of Ce, La, Nd, and Pr is higher as compared with that of MnS, which leads to an increase in the number of inclusions having a formation in which MnS is precipitated in the oxide or oxysulfide formed by at least one element of Ce, La, Nd, and Pr. This means that MnS is improved with the oxide or oxysulfide formed by at least one element of Ce, La, Nd, and Pr. In order to improve the stretch-flange formability and the bending workability as described above, MnS is caused to precipitated in the oxide or oxysulfide formed by at least one element of Ce, La, Nd, and Pr, which leads to prevention of elongated MnS. For these reasons, the above-described mass ratio can be used as a parameter to determine whether or not these effects can be obtained.

In order to determine the chemical component ratio effective in suppressing the elongation of the MnS-based inclusion, the mass ratio of (Ce+La+Nd+Pr)/S in the steel sheet was varied to evaluate the formation of the inclusions, the stretch-flange formability, and the bending workability. As a result, it was found that, by setting the mass ratio of (Ce+La+Nd+Pr)/S to be in the range of 0.2 to 10, both the stretch-flange formability and the bending workability significantly improve.

In the case where the mass ratio of (Ce+La+Nd+Pr)/S is less than 0.2, the ratio of the number of the compound inclusions having the formation in which MnS is precipitated in the oxide or oxysulfide formed by at least one element of Ce, La, Nd, and Pr is undesirably low. This correspondingly leads to the excessive increase in the ratio of number of elongated MnS-based inclusions, which are likely to be the starting point of the occurrence of cracking, deteriorating the stretch-flange formability and the bending workability.

In the case where the mass ratio of (Ce+La+Nd+Pr)/S exceeds 10, the effect of precipitating MnS in the cerium oxysulfide and lanthanum oxysulfide to improve the stretch-flange formability and the bending workability saturates, which is not worth the cost. From these reasons, the mass ratio of (Ce+La+Nd+Pr)/S is set in the range of 0.2 to 10. In the case where the mass ratio of (Ce+La+Nd+Pr)/S is excessively high, for example, is over 70, the at least one of the cerium oxysulfide, the lanthanum oxysulfide, the neodymium oxysulfide, and the praseodymium oxysulfide is excessively generated, and becomes coarsened inclusions, deteriorating the stretch-flange formability and the bending workability. Thus, the upper limit of the mass ratio of (Ce+La+Nd+Pr)/S is set to 10.

Next, selective elements for the high-strength steel sheet according to this embodiment will be described. These elements are selective elements, and hence, may be added or may not be added. Further, it may be possible to add these elements either alone or in combination of two or more types. In other words, the lower limit of these selective elements may be set to 0%.

For Nb and V

Nb and V form carbides, nitrides, or carbonitrides with C and/or N to facilitate the reduction in size of grains in the base material structure, and contribute to improving the toughness.

[Nb: 0.01% to 0.10%]

In order to obtain composite carbides and composite nitrides described above, it is preferable to set the concentration of Nb to 0.01% or more, and it is more preferable to set the concentration of Nb to 0.02% or more. However, in the case where the base material contains the large amount of Nb in excess of the concentration of 0.10%, the effect of providing the fine grain in the base material structure saturates, increasing the producing cost. For these reasons, the upper limit of the concentration of Nb is set to 0.10%, preferably set to 0.09%, more preferably set to 0.08%.

[V: 0.01% to 0.10%]

In order to obtain the above-described composite carbides, composite nitrides and the like, it is preferable to set the concentration of V to 0.01% or more. However, even if the large amount of V is contained in excess of the concentration of 0.10%, the effect obtained from V contained saturates, increasing the producing cost. For this reason, the upper limit of the concentration of V is set to 0.10%.

For Cu, Ni, Cr, Mo, and B

Cu, Ni, Cr, Mo, and B enhance the strength, and improves the hardenability of the steel.

[Cu: 0.1% to 2%]

Cu contributes to improving the precipitation hardening and the fatigue strength of ferrite, and may be added depending on applications to further enhance the strength of the steel sheet. In order to obtain this effect, it is preferable to add Cu of 0.1% or more. However, the excessively large amount of Cu contained deteriorates the balance of strength-ductility. Thus, the upper limit of Cu is set to 2%, preferably to 1.8%, more preferably to 1.5%.

[Ni: 0.05% to 1%]

Ni can be used for solid solution strengthening of ferrite, and may be added depending on applications to further enhance the strength of the steel sheet. In order to obtain this effect, it is preferable to add Ni of 0.05% or more. However, the excessively large amount of Ni contained deteriorates the balance of strength-ductility. Thus, the upper limit of Ni is set to 1%, preferably to 0.09%, more preferably to 0.08%.

[Cr: 0.01% to 1%]

Cr may be added depending on applications to further enhance the strength of the steel sheet. In order to obtain this effect, it is preferable to add Cr of 0.01% or more, and it is more preferable to add Cr of 0.02% or more. However, the excessively large amount of Cr contained deteriorates the balance of strength-ductility. Thus, the upper limit of Cr is set to 1%, preferably to 0.9%, more preferably to 0.8%.

[Mo: 0.01% to 0.4%]

Mo may be added depending on applications to further enhance the strength of the steel sheet. In order to obtain this effect, it is preferable to add Mo of 0.01% or more, and it is more preferable to add Mo of 0.05% or more. However, the excessively large amount of Mo contained deteriorates the balance of strength-ductility. Thus, the upper limit of Mo is set to 0.4%, preferably to 0.3%, more preferably to 0.2%.

[B: 0.0003% to 0.005%]

B may be added depending on applications to further enhance the strength of the grain boundaries to improve the workability. In order to obtain this effect, it is preferable to add B of 0.0003% or more, and it is more preferable to add B of 0.0005% or more. However, in the case where the amount of B contained exceeds 0.005%, the effect obtained from B saturates, and the cleanliness of the steel is impaired, deteriorating the ductility. Thus, the upper limit of B is set to 0.005%.

For Zr

Zr may be added depending on applications to strengthen the grain boundaries and improve the workability with the control of sulfide formation.

[Zr: 0.001% to 0.01%]

In order to obtain the effect of forming spherical sulfides as described above to improve the toughness of the base material, it is preferable to add Zr of 0.001% or more. However, the excessively large amount of Zr contained impairs the cleanliness of the steel, which leads to the deterioration in the ductility. Thus, the upper limit of Zr is set to 0.01%, preferably to 0.009%, more preferably to 0.008%.

Next, a description will be made of conditions for the existence of inclusions in the high-strength steel sheet according to this embodiment. In this specification, the term "steel sheet" means a rolled sheet obtained through hot rolling, or through hot rolling and cold rolling. Further, the conditions for the existence of inclusions in the high-strength steel sheet according to this embodiment are set from various viewpoints.

In order to obtain the steel sheet exhibiting excellent stretch-flange formability and bending workability, it is important to minimize the number of elongated and coarsened MnS-based inclusions in the steel sheet, which are likely to be the starting point of the occurrence of cracking or the pathway of crack propagation.

In this regard, the present inventors found that, as with steel sheets produced with little deoxidation with Al, it is possible to obtain a steel sheet exhibiting excellent stretch-flange formability and bending workability, by adding Si to a steel sheet, subjecting the steel sheet to the deoxidation with Al, then, adding at least one element of Ce, La, Nd, and Pr, further adding Ca for deoxidation in a manner described above, and adjusting the ratio (Ce+La+Nd+Pr)/acid-soluble Al and the ratio of (Ce+La+Nd+Pr)/S on the basis of mass so as to be those described above, to sharply decrease the oxygen potential in the molten steel through the multiple deoxidation, subject $Al_2O_3$ generated through Al deoxidation to reduction, and separate $Al_2O_3$ cluster, which is likely to coarsen.

Further, it was also found that, through deoxidation with addition of Ce, La, Nd, and/or Pr, and addition of Ca thereafter, although a slight amount of $Al_2O_3$ remains, it was possible to in most parts generate fine and hard Ce oxide, La oxide, Nd oxide, Pr oxide, cerium oxysulfide, lanthanum oxysulfide, neodymium oxysulfide, praseodymium oxysulfide, and Ca oxide or Ca oxysulfide, dissolve the generated oxides and oxysulfide in solid solution, obtain MnS precipitated and dissolved in solid solution, and form a compound inclusion containing inclusion phases each having a different component. The obtained compound inclusion is less likely to deform even during rolling work, whereby the number of the elongated and coarsened MnS can be significantly reduced in the steel sheet.

Further, it was found that, by obtaining, on the basis of mass, the ratio of (Ce+La+Nd+Pr)/acid-soluble Al and the ratio of (Ce+La+Nd+Pr)/S as described above, the number density of fine inclusions having an equivalent circle diameter of 2 μm or less significantly increases, and the fine inclusions are dispersed in the steel.

These fine inclusions are less likely to aggregate, and hence, most of them remain in the spherical shape or spindle shape. These inclusions have a major axis/minor axis (hereinafter, also referred to as "elongated ratio") of 3 or less, preferably 2 or less. In the present invention, these inclusions are referred to as a spherical inclusion.

In terms of experiment, the inclusions can be identified easily through observation using a scanning electron microscope (SEM), and focus was placed on the number density of inclusions having an equivalent circle diameter of 5 μm or less. Note that, although the lower limit value for the equivalent circle diameter is not particularly set, it is preferable to set a target of the observation at the inclusions having approximately 0.5 μm or more, the size of which can be counted and expressed in number. In this specification, the term "equivalent circle diameter" refers to a value obtained through (major axis×minor axis)0.5 on the basis of the major axis and the minor axis of the inclusion with cross-section observation.

It is considered that the fine inclusions having a size of 5 μm or less are dispersed because of the synergistic effect of: the reduced oxygen potential in the molten steel due to Al deoxidation; the oxide or oxysulfide formed by at least one element of Ce, La, Nd, and Pr in which oxide containing at least one element of Si, Al, and Ca is precipitated and dissolved in solid solution; and the fine compound inclusions formed by oxide and/or oxysulfide having at least one of MnS, CaS, and (Mn, Ca)S precipitated and dissolved in solid solution therein.

The generated compound inclusions are formed by inclusion phases that have different components and include an inclusion phase containing at least one element of Ce, La, Nd, and Pr, further containing Ca, and containing at least one element of O and S (hereinafter, also referred to as a first group of [Ce, La, Nd, Pr]—Ca—[O, S]) and an inclusion phase further containing at least one element of Mn, Si, and Al (hereinafter, also referred to as a second group [Ce, La, Nd, Pr]—Ca—[O, S]—[Mn, Si, Al]). It is considered that these compound inclusions form a large number of spherical compound inclusions having an equivalent circle diameter in the range of 0.5 μm to 5 μm, and these spherical compound inclusions are less likely to be a starting point of the occurrence of cracking or pathway of crack propagation, and contribute to relaxation of stress concentration because of its fine structure, which leads to improvement in the stretch-flange formability and the bending workability.

The present inventors checked whether the elongated and coarsened MnS-based inclusions, which are likely to be the starting point of the occurrence of cracking or pathway of crack propagation, are reduced in the steel sheet.

The present inventors experimentally knew that, in the case where the equivalent circle diameter is less than 1 μm, the elongated MnS does not have any adverse effect in terms of the starting point of the occurrence of cracking, and does not deteriorate the stretch-flange formability or bending workability. Further, the inclusions having an equivalent circle diameter of 1 μm or more can be easily observed with the scanning electron microscope (SEM) or other devices. For these reasons, by targeting the observation at the inclusions having the equivalent circle diameter of 1 μm or more in the steel sheet, their formations and compositions were examined to evaluate the distribution state of the elongated MnS.

It should be noted that, although the upper limit of the equivalent circle diameter of MnS is not particularly set, MnS having a size of approximately 1 mm may be observed in practical.

The ratio of the number of the elongated inclusions was measured through composition analysis on plural pieces (for example, 50 pieces) of inclusions having the equivalent circle diameter of 1 μm or more and randomly selected using a SEM, and through measurement of the major axis and the minor axis of the inclusions using a SEM image. In this specification, the elongated inclusion represents an inclusion having a major axis/minor axis (elongated ratio) of over 3. Further, the ratio of the number of the elongated inclusions can be obtained by dividing the number of the detected elongated inclusions by the total number of inclusions analyzed (50 in the case of the above-described example).

The reason that the elongated ratio is set to 3 or less is because the inclusions having the elongated ratio of over 3 in the comparative steel sheet without having the Ce, La, Nd or Pr added therein were formed mostly by inclusions having, as a core, the oxide or oxysulfide made of Ce, La, Nd, and Pr through addition of MnS, Ce, La, Nd, or Pr and having MnS precipitated around the core, the CaO—$Al_2O_3$-based inclusion having a low melting point, and the coarsened and elongated CaS. Note that, although the upper limit of the elongated ratio of MnS is not particularly set, MnS having the elongated ratio of approximately 50 may be observed in practice.

As a result, it was found that the stretch-flange formability and the bending workability were improved in the steel sheet having the controlled formation in which the ratio of the number of the elongated inclusions having an elongated ratio of 3 or less is controlled to be 50% or more. More specifically, in the case where the ratio of the number of the elongated inclusions having the elongated ratio of 3 or less is 50% or more, there are excessive increases in the ratio of number of MnS, which is likely to be the starting point of the occurrence of cracking, the ratio of the number of the inclusions having a core made of oxide or oxysulfide of Ce and La through addition of Ce and La and having MnS precipitated around the core, the ratio of the number of the CaO—$Al_2O_3$-based inclusion having the low melting point, and the ratio of the number of the coarsened and elongated CaS, which leads to the deterioration in the stretch-flange formability and the bending workability. For these reasons, in the high-strength steel sheet according to this embodiment, the ratio of the number of the elongated inclusions having the elongated ratio of 3 or less is set to 50% or more.

The stretch-flange formability and the bending workability become more favorable with decrease in the number of the elongated MnS-based inclusions. Thus, the lower limit value of the ratio of the number of the elongated inclusions having the elongated ratio of over 3 includes 0%. In this specification, the state in which an inclusion has an equivalent circle diameter of 1 μm or more and the lower limit value of the ratio of number of an elongated inclusion having the elongated ratio of over 3 is 0% means that there exists an inclusion having the equivalent circle diameter of 1 μm or more but there exists no inclusion having the elongated ratio of over 3, or the inclusion is an elongated inclusion having the elongated ratio of over 3 but the equivalent circle diameters of all the inclusions are less than 1 μm.

Further, it was confirmed that the maximum equivalent circle diameter of the elongated inclusion is smaller as compared with the average grain diameter of crystals in the structure. This also contributes to a significant improvement in the stretch-flange formability and the bending workability.

In the case where a steel sheet has the controlled formation in which the mass ratio of (Ce+La+Nd+Pr)/S is in the range of 0.2 to 10, and the ratio of the number of the elongated inclusions having the elongated ratio of 3 or less is 50% or more, the steel sheet correspondingly has a compound inclusion formed by inclusion phases having different components and including an inclusion phase (first group of [Ce, La, Nd, Pr]—Ca—[O, S]) containing at least one element of Ce, La, Nd, and Pr, further containing Ca, and further containing at least one of O and S, and an inclusion phase (second group of [Ce, La, Nd, Pr]—Ca—[O, S]—[Mn, Si, Al]) further containing at least one element of Mn, Si, and Al, and in many cases, this compound inclusion forms a large number of spherical compound inclusions having an equivalent circle diameter in the range of 0.5 μm to 5 μm.

Further, the spherical compound inclusion having the equivalent circle diameter in the range of 0.5 μm to 5 μm is a hard inclusion having the high melting point, and is less likely to deform during rolling. Thus, this spherical compound inclusion remains in the non-elongated shape in the steel sheet, in other words, is a spherical or spindle-shaped (also referred to as spherical) inclusion.

In this specification, although not particularly defined, a spherical inclusion determined to be not elongated represents an inclusion having the elongated ratio of 3 or less, preferably of 2 or less in the steel sheet. This is because the inclusion in the ingot stage before rolling was formed by the compound inclusion having a different component and including an inclusion phase of the first group of [Ce, La, Nd, Pr]—Ca—[O, S], and an inclusion phase of the second group of [Ce, La, Nd, Pr]—Ca—[O, S]—[Mn, Si, Al], was formed by a spherical compound inclusion having an equivalent circle diameter in the range of 0.5 μm to 5 μm, and had the elongated ratio of 3 or less. Further, if the spherical inclusion determined to be not elongated has a completely spherical shape, the elongated ratio is 1, and hence, the lower limit of the elongated ratio is 1.

The ratio of number of this inclusion was investigated in a similar manner to that made on the ratio of the number of the elongated inclusions. As a result, it was found that the stretch-flange formability and the bending workability improve, according to the steel sheet having a compound inclusion formed by inclusion phases having a different component and including an inclusion phase of the first group ([Ce, La, Nd, Pr]—Ca—[O, S]) containing at least one element of Ce, La, Nd, and Pr, further containing Ca, and further containing at least one element of O and S, and an inclusion phase of the second group ([Ce, La, Nd, Pr]—Ca—[O, S]—[Mn, Si, Al]) further containing at least one element of Mn, Si, and Al, in which the steel sheet has a formation controlled such that this compound inclusion forms a spherical compound inclusion having an equivalent circle diameter in the range of 0.5 μm to 5 μm, and the ratio of the number of the spherical compound inclusion relative to the total number of inclusions having an equivalent circle diameter in the range of 0.5 μm to 5 μm is 30% or more.

In the case where this ratio of number is less than 30%, it is not favorable because the ratio of the number of the elongated inclusions of MnS correspondingly excessively increases, deteriorating the stretch-flange formability and the bending workability.

For these reasons, the ratio of the number of the spherical compound inclusions having the equivalent circle diameter in the range of 0.5 μm to 5 μm is set to 30% or more. In this specification, the ratio of number is measured from the SEM image on the basis of the major axis and the minor axis of 50 pieces of the elongated inclusions randomly selected using the SEM. Then, the number of the elongated inclusions having the major axis/minor axis (elongated ratio) of 3 or less is divided by the number of all the inclusions investigated (50 pieces), thereby obtaining the ratio of the number of the elongated inclusions.

With the increase in the number of spherical compound inclusions having the equivalent circle diameter in the range of 0.5 μm to 5 μm, the stretch-flange formability and the bending workability can be more preferably obtained. Thus, the upper limit of the ratio of number includes 100%.

It should be noted that the spherical compound inclusions having the equivalent circle diameter in the range of 0.5 μm to 5 μm are less likely to deform even during rolling. Thus, the equivalent circle diameter is not particularly set, and it may be possible to set the equivalent circle diameter to 1 μm or more. However, if the inclusions have the excessively large diameter, the inclusions possibly serve as the starting point of the occurrence of cracking. Thus, the upper limit of the equivalent circle diameter is set preferably to above 5 μm.

On the other hand, these compound inclusions are less likely to deform even during rolling, and do not serve as the starting point of the occurrence of cracking in the case where the equivalent circle diameter is less than 0.5 μm. Thus, the lower limit of the equivalent circle diameter is not particularly set.

Next, the condition for the existence of the compound inclusions in the high-strength steel sheet according to this embodiment described above is set using number density of the inclusion per unit volume.

The distribution of grain diameter of inclusions was obtained through a SEM evaluation on an electrolyzed surface using a speed method. The SEM evaluation on the electrolyzed surface using the speed method was performed such that: a surface of a test piece was polished, and was subjected to electrolyzation using the speed method; and the surface of the test piece was directly observed with the SEM observation, thereby evaluating the size or number density of the inclusion. Note that the speed method represents a method of electrolyzing the surface of the test piece using 10% acetyl acetone-1% tetramethyl ammonium chloride-methanol, and extracting the inclusion. As for the amount of electrolysis, electrolyzation was performed until the amount of electrolysis of the surface of the test piece per 1 $cm^2$ area reached 1 C. The SEM image of the surface electrolyzed as described above was subjected to image processing, thereby obtaining a frequency (number of pieces) distribution in terms of equivalent circle diameter. On the basis of the frequency distribution of the grain diameter, the average equivalent circle diameter was obtained. Further, the number density of inclusions per unit volume was calculated by dividing the frequency by the area of the observed view and the depth obtained from the amount of electrolysis.

On the other hand, for the high-strength steel sheet according to this embodiment described above, the condition for the existence of the spherical compound inclusions having the equivalent circle diameter in the range of 0.5 μm to 5 μm and formed by inclusion phases having a different component and including an inclusion phase of the first group of [Ce, La, Nd, Pr]—Ca—[O, S] and an inclusion phase of the second group of [Ce, La, Nd, Pr]—Ca—[O, S]—[Mn, Si, Al] is set using the amount of average composition of Ce, La, Nd or Pr contained in the inclusions.

More specifically, as described above, in order to improve the stretch-flange formability and the bending workability, it is important for the compound inclusions to exist as the spherical compound inclusions having the equivalent circle diameter in the range of 0.5 μm to 5 μm and prevent coarsening of the MnS-based inclusions.

These compound inclusions are spherical compound inclusions or spindle-shaped inclusions having the equivalent circle diameter in the range of 0.5 μm to 5 μm.

Although not particularly set, the spindle-shaped inclusions are inclusions having an elongated ratio of 3 or less, preferably of 2 or less in the steel sheet. If the inclusions have a completely spherical shape, the elongated ratio is 1, and hence, the lower limit of the elongated ratio is 1.

In order to determine a composition effective in suppressing the elongation and improving the stretch-flange formability and the bending workability, composition analysis of the compound inclusions was performed.

Since the observation becomes easy if the equivalent circle diameter of the inclusions is 1 μm or more, the target of the observation was set at the inclusion having the equivalent circle diameter of 1 μm or more for the convenience purpose. However, if the observation is possible, it may be possible to include the inclusions having the equivalent circle diameter of less than 1 μm.

Further, since the compound inclusions described above were not elongated, it was confirmed that all the compound inclusions had the elongated ratio of 3 or less. Thus, composite analysis was performed for the inclusions having the equivalent circle diameter of 1 μm or more and the elongated ratio of 3 or less.

As a result, it was found that the inclusions having the equivalent circle diameter of 1 μm or more and the elongated ratio of 3 or less are formed by compound inclusions having a formation of components in which there are provided two or more inclusion phases each having different components and including an inclusion phase of a first group having a component in which at least one element of Ce, La, Nd, and Pr is contained, Ca is contained, and at least one element of O and S is contained, and an inclusion phase of a second group having a component in which at least one element of Mn, Si, and Al is further contained, as illustrated in FIG. 3A and FIG. 3B. Further, it was found that the stretch-flange formability and the bending workability can be improved, by forming the compound inclusions so as to contain the total amount of at least one element of Ce, La, Nd, and Pr in the range of 0.5% to 95% in average composition.

In the case where the average amount of the total of the at least one element of Ce, La, Nd, and Pr contained is less than 0.5 mass % in the inclusion having the equivalent circle diameter of 1 μm or more and the elongated ratio of 3 or less, the ratio of the number of the inclusions having the formation described above largely decreases, while the ratio of the number of the MnS-based elongated inclusions, which are likely to be the starting point of the occurrence of cracking, excessively increases correspondingly. Thus, the stretch-flange formability and the bending workability deteriorate.

On the other hand, in the case where the average amount of the total of the at least one element of Ce, La, Nd, and Pr contained exceeds 95% in the inclusions having the equivalent circle diameter of 1 μm or more and the elongated ratio of 3 or less, the cerium oxysulfide and the lanthanum oxysulfide are largely generated, which leads to coarsened inclusions having the equivalent circle diameter of approximately 50 μm or more. Thus, the stretch-flange formability and the bending workability deteriorate.

Next, the structure of the steel sheet will be described.

According to the high-strength steel sheet according to this embodiment, the fine MnS-based inclusions are precipitated in the ingot, and are dispersed in the steel sheet as the fine spherical inclusions, which do not deform during rolling and are less likely to be the starting point of the occurrence of cracking, thereby improving the stretch-flange formability and the bending workability. Thus, the micro-structure of the steel sheet is not particularly limited.

Although the micro-structure of the steel sheet is not particularly limited, it may be possible to employ any structure from among a steel sheet having a structure of a phase formed mainly by bainitic ferrite, a composite-structure steel sheet having a main phase of a ferrite phase and a second phase of a martensite phase and a bainite phase, and a composite-structure steel sheet formed by ferrite, retained austenite and a low-temperature transformation phase (formed by martensite or bainite).

Thus, any of the structures described above are favorable because it is possible to reduce the crystal grain diameter to 10 μm or less, and the hole-expandability and the bending workability can be improved. In the case where the average grain diameter exceeds 10 μm, the degree of improvement in the ductility and the bending workability reduces. In order to improve the hole-expandability and the bending workability, it is more preferable to set the crystal grain diameter to 8 μm or less. However, in general, in the case where excellent stretch-flange formability is required, for example, in the case of application for underbody components, it is desirable and preferable that the ferrite or bainite phase be the maximum area-ratio phase, although the ductility is slightly lower.

Next, producing conditions will be described.

According to a method of producing molten steel for the high-strength steel sheet according to this embodiment, alloys such as C, Si, and Mn are further added to the molten steel decarbonized by blowing in a converter or by further using a vacuum degassing device, and the molten steel is agitated, thereby performing deoxidation and component adjustment.

As for S, desulfurization may not be performed in the refinement process as described above, and thus, the desulfurization process can be omitted. However, in the case where desulfurization of the molten steel is necessary in the secondary refinement to produce the ultra-low sulfur steel with approximately S≤20 ppm, it may be possible to perform the component adjustment through desulfurization.

It is preferable that, after the elapse of approximately 3 minutes from the addition of Si described above, Al be added to perform Al deoxidation, and then, the rising time of approximately 3 minutes be set so as to allow $Al_2O_3$ to rise to the surface and be separated.

Thereafter, at least one element of Ce, La, Nd, and Pr is added, and components are adjusted so as to satisfy 70≥100×(Ce+La+Nd+Pr)/acid-soluble Al≥2, and (Ce+La+Nd+Pr)/S being in the range of 0.2 to 10 on the basis of mass.

In the case where a selective element is added, the selective element is added before the addition of the at least one element of Ce, La, Nd, and Pr, agitation is sufficiently performed, and the at least one element of Ce, La, Nd, and Pr is added. Depending on applications, the at least one element of Ce, La, Nd, and Pr may be added after the component adjustment of the selective element. Then, agitation is sufficiently performed, and Ca is added. The thus obtained molten steel is subjected to continuous casting to produce an ingot.

The continuous casting not only includes an ordinal slab continuous casting having a thickness of approximately 250 mm, but also includes a bloom, a billet, and thin slab continuous casting having a thinner die-thickness than that of ordinal slab continuous-casting devices, for example, a thickness of 150 mm or less.

Hot rolling conditions for producing the high-strength hot-rolled steel sheet will be described.

Since carbonitrides or other inclusions in the steel need to be once dissolved in solid solution, it is important to set a heating temperature for a slab before hot rolling to over 1200° C.

By making the carbonitrides dissolved in solid solution, it is possible to obtain a ferrite phase, which is favorable to improve the ductility in the cooling process after the rolling. On the other hand, in the case where the heating temperature for the slab before the hot rolling exceeds 1250° C., the surface of the slab is significantly oxidized. In particular, wedge-shaped surface defects appear after descaling due to selective oxidation of the grain boundaries, deteriorating quality of the surface after the rolling. Thus, it is preferable to set the upper limit of the heating temperature to 1250° C.

After being heated to temperatures in the range described above, the slab is subjected to the normal hot rolling. In this hot rolling process, the temperature at the time of completion of the finishing rolling is important to control the structure of the steel sheet. In the case where the temperature at the time of completion of the finishing rolling is less than Ar3 point+30° C., the diameter of the crystal grain in the surface layer portion is likely to coarsen, which is not favorable in terms of bending workability. On the other hand, in the case where this temperature exceeds the Ar3 point+200° C., the diameter of the austenite grain after the completion of the rolling coarsens, which makes it difficult to control the structure and the ratio of the phase generated during cooling. Thus, the upper limit of the temperature is set preferably to the Ar3 point+200° C.

Further, depending on the targeted structure configuration, the condition for the hot rolling is selected from among a condition in which an average cooling rate for the steel sheet after the finishing rolling is set in the range of 10° C./sec to 100° C./sec, and the coiling temperature is set in the range of 450° C. to 650° C., and a condition in which the steel sheet is air cooled at approximately 5° C./sec until the temperature reaches 680° C. after the finishing rolling, and is cooled thereafter at the cooling rate of 30° C./sec or more, and the coiling temperature is set to 400° C. or less. By controlling the cooling rate and the coiling temperature after the rolling, it is possible to obtain a steel sheet having one or more structures of polygonal ferrite, bainitic ferrite, and a bainite phase, and the corresponding ratio under the former rolling condition, and a DP steel sheet having a compound structure including the large amount of polygonal ferrite phase, which are excellent in ductility, and the martensite phase under the latter rolling condition.

In the case where the average cooling rate described above is less than 10° C./sec, pearlite, which is not favorable in terms of the stretch-flange formability, is likely to be generated, which is not preferable. Although setting of the upper limit of the cooling rate is not necessary from viewpoint of controlling of the structure, the excessively high cooling rate possibly causes the cooling state of the steel sheet to be nonuniform. Further, a large amount of cost is required to manufacture equipment that can provide such a high cooling rate, which leads to increase in prices of the steel sheet. In view of the facts described above, it is preferable to set the upper limit of the cooling rate to 100° C./sec.

The high-strength cold-rolled steel sheet according to the present invention is produced by subjecting a steel sheet to hot rolling, coiling, pickling, and skin pass, then cold rolling the steel sheet, and applying annealing to the steel sheet. In the annealing processes, batch annealing, continuous annealing or other processes are applied, thereby obtaining the final cold-rolled steel sheet.

It is needless to say that the high-strength steel sheet according to the present invention may be used as a steel sheet for electroplating. Application of electroplating does not change the mechanical properties of the high-strength steel sheet according to the present invention.

Second Embodiment

The present inventors made a study of a method of precipitating fine MnS inclusion in the cast slab, and dispersing the fine MnS inclusion in the steel sheet as a fine spherical inclusion that does not deform during rolling and is less likely to be the starting point of the occurrence of cracking, thereby improving the stretch-flange formability and the bending workability, and of additional elements that do not deteriorate the fatigue characteristics.

Figure 8A:
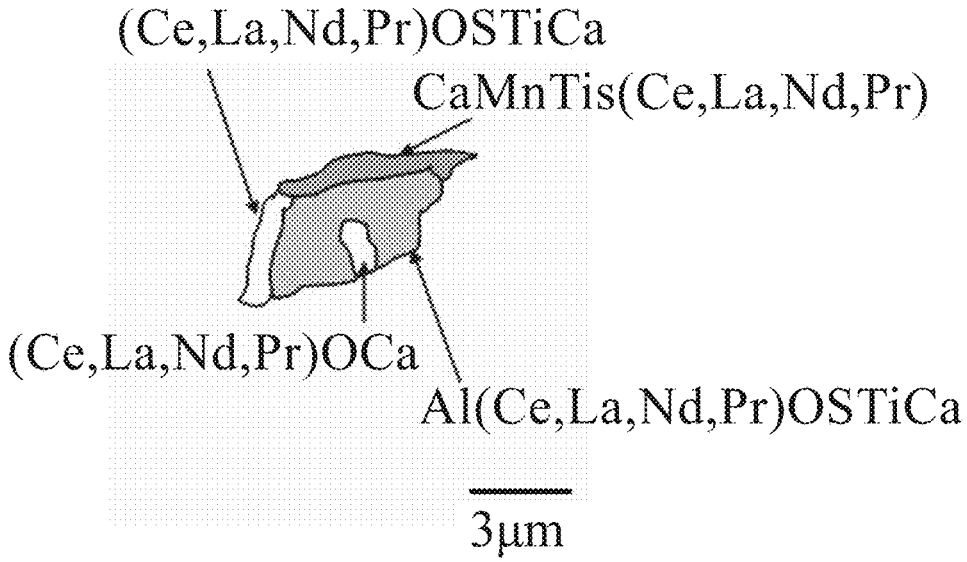
FIG. 8A is a diagram illustrating an example of a compound inclusion formed into a spherical inclusion.
Figure 8B:
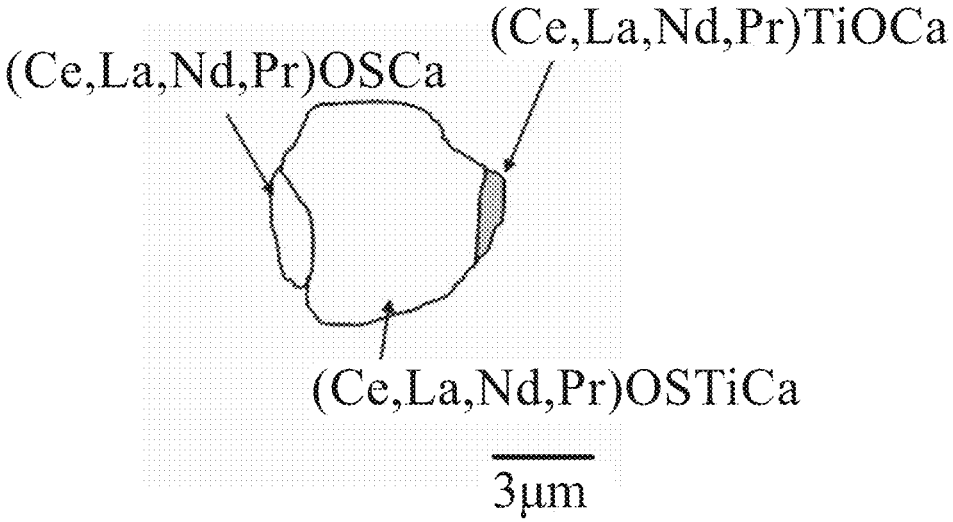
FIG. 8B is a diagram illustrating another example of a compound inclusion formed into a spherical inclusion.

As a result, it was found that an elongated MnS and coarsened inclusions, which have an adverse effect on the hole expandability, was significantly reduced in the steel sheet, and the coarsened inclusions and the MnS-based inclusions are less likely to be the starting point of the occurrence of cracking or pathway of crack propagation during repetitive deformation, hole expanding work, and bending work, which leads to an improvement in the hole-expandability or other properties, by forming a spherical compound inclusion having an equivalent circle diameter in the range of 0.5 μm to 5 μm and containing different inclusion phases including a first inclusion phase containing at least one element of Ce, La, Nd, and Pr, further containing Ca, and further containing at least one element of O and S, and a second inclusion phase further containing at least one element of Mn, Si, Ti, and Al, as illustrated in FIG. 8A and FIG. 8B, and controlling the inclusions such that the ratio of the number of the spherical inclusions is 50% or more, and number density of inclusions having a size of over 5 μm is less than 10 pieces/$mm^2$.

Further, the present inventors also made a study of sequentially performing multiple deoxidation with Si, Mn, Al, (Ce, La, Nd, Pr), and Ca to make precipitates fine oxide or MnS-based inclusions, and remove sulfur to the low sulfur level so as to reliably fix the residual sulfur to be a fine and hard inclusion. As a result, it was found that, for molten steel obtained through deoxidation with Si, deoxidation with Ti and Al, deoxidation with addition of at least one element of Ce, La, Nd, and Pr, and then addition of Ca, by obtaining predetermined (Ce+La+Nd+Pr)/acid-soluble Al, and (Ce+La+Nd+Pr)/S on the basis of mass and adding Ca at the end, the oxygen potential in the molten steel can be reduced, under this reduced oxygen potential, much finer TiS-based inclusion can be obtained, whereby the residual sulfur can be reliably fixed to be the fine and hard inclusions. Further it is also found that, with this setting, the stretch-flange formability and the bending workability significantly improve.

It should be noted that, in some observations, TiN is precipitated alone or multiply precipitated on a compound inclusion containing different inclusion phases including a first inclusion phase containing at least one element of Ce, La, Nd, and Pr, further containing Ca, and further containing at least one element of O and S, and a second inclusion phase further containing at least one element of Mn, Si, Ti, and Al. However, it was confirmed that, since the precipitates were fine precipitates, these precipitates little affect the stretch-flange formability, the bending workability, and the fatigue characteristics. Thus, TiN is not considered to be the MnS-based inclusion to which the high-strength steel sheet according to this embodiment is directed. Further, it was found that, by adding Ti to increase acid-soluble Ti in the steel, a pinning effect resulting from solute Ti or carbonitride Ti can be obtained, whereby it is possible to reduce the size of the crystal grain to the fine crystal grain. Since TiN has little effect on the stretch-flange formability and the bending workability, TiN is not the target of the MnS-based inclusion.

Next, a detailed description will be made of the high-strength steel sheet exhibiting excellent stretch-flange formability and bending workability as a second embodiment of the present invention. Below, the unit "mass %" used for the composition is expressed simply as "%." Note that the high-strength steel sheet of the present invention includes a steel sheet subjected to normal hot rolled or cold rolled and used as it is without applying further treatment thereto, and a steel sheet used after application of surface treatment such as plating and coating.

Next, experiments concerning the second embodiment according to the present invention will be described.

The present inventors produced a steel ingot by subjecting molten steel containing C: 0.06%, Si: 1.0%, Mn: 1.4%, P: 0.01% or less, S: 0.005%, and N: 0.003% with a balance including Fe to deoxidation using various elements. The obtained steel ingot is hot rolled to form a hot-rolled steel sheet with 3 mm. For the obtained hot-rolled steel sheet, a tensile test, a hole-expanding test, and a bending test were performed, and examination was made on number density of inclusions, formation and average composition in the steel sheet.

Further, examination was made on the stretch-flange formability and the bending workability of a steel sheet produced, by first adding Si to molten steel, subjecting the molten steel to deoxidation with Al, agitating the molten steel for approximately 2 minutes, adding Ti, agitating the molten steel for approximately 2 minutes, and adding at least one element of Ce, La, Nd, and Pr, and deoxidizing with Ca. As a result, with the steel sheet subjected to the sequential five-step deoxidation with Si, Al, Ti, at least one element of Ce, La, Nd, and Pr, and Ca as described above, it is confirmed that the stretch-flange formability and the bending workability can be further improved.

It is considered that this is because Al oxide, Ti oxide or Al—Ti compound oxide generated through deoxidation with Al and Ti and partially containing Mn or Si is changed through deoxidation with addition of at least one element of Ce, La, Nd, and Pr to form a (Ce, La, Nd, Pr)—(O) inclusion and a (Mn, Si, Ti, Al)—(Ce, La, Nd, Pr)—(O) inclusion. The formed inclusions absorb S to form a (Ce, La, Nd, Pr)—(O, S) inclusion and a (Mn, Si, Ti, Al)—(Ce, La, Nd, Pr)—(O, S). These inclusions are subjected to reduction through deoxidation with Ca, which causes all the inclusion phases to contain Ca to form a (Ce, La, Nd, Pr)—(O, S)—(Ca) inclusion phase (hereinafter, also referred to as a first inclusion phase of [REM]-[Ca]—[O,S] or simply as a first inclusion phase) and a (Mn, Si, Ti, Al)—(Ce, La, Nd, Pr)—(O, S)—(Ca) inclusion phase (hereinafter, also referred to as a second inclusion phase of [Mn, Si, Ti, Al]-[REM]-[Ca]—[O,S] or simply as a second inclusion phase), so that these inclusions are combined, or precipitated as an inclusion phase to form the compound inclusion having different inclusion phases.

FIG. 8A and FIG. 8B illustrate examples of the generated compound inclusion.

It should be noted that, in the expression of the (Mn, Si, Ti, Al)—(Ce, La, Nd, Pr)—(O, S)—(Ca) inclusion phase, the expression (Mn, Si, Ti, Al) represents containing at least one element of Mn, Si, Ti, and Al, the expression (Ce, La, Nd, Pr) represents containing at least one element of Ce, La, Nd, and Pr, the expression (O, S) represents containing at least one element of O and S, and the expression (Ca) represents containing a Ca element.

These compound inclusions are subjected to deoxidation with Ca at the last stage, which has the most strongest deoxidation effect of all the elements in this embodiment, and contain inclusions having the higher melting point. Thus, these inclusions deform during rolling with a ratio of the major axis to the minor axis of 3 or less, and are less likely to deform.

Further, although having a strong deoxidation effect, Ce, La, Nd, Pr and Ca have favorable wettability with the molten steel, and hence, the generated compound inclusions are finely dispersed.

In other words, there are formed spherical compound inclusions having an equivalent circle diameter in the range of 0.5 μm to 5 μm and containing different inclusion phases including the first inclusion phase of [REM]-[Ca]—[O,S] and the second inclusion phase of [Mn,Si,Ti,Al]-[REM]-[Ca]—[O,S].

The reason that the above-described inclusion phases are expressed as being "different inclusion phases" is because they can be separately recognized as inclusion phases in the compound inclusion through an optical image or electronic image, and are different in concentration through examination on components of the inclusion phases, and hence, the present inventors considered them as being different inclusion phases. In other words, in the case where one inclusion phase contains extremely small amount of an element while the other inclusion phase contains the large amount of the same element, the one inclusion phase and the other inclusion phase are determined to be different.

The present inventors found that the hole-expandability can be improved if the compound inclusions are spherical inclusions having an equivalent circle diameter in the range of 0.5 μm to 5 μm, and the ratio of the number of the spherical inclusions is 50% or more. Note that, although the more favorable effect can be obtained with the increase in the ratio of the number of the spherical inclusions, the upper limit is considered to be approximately 98%.

The high-strength steel sheet according to this embodiment has a ratio of the major axis to the minor axis of 3 or less. Further, in the high-strength steel sheet according to this embodiment, the above-described inclusions are referred to as spherical inclusions. From the examination made by the present inventors, it was found that approximately 80% or more of the inclusions having the size in the range of 0.5 μm to 5 μm is formed by the spherical inclusion having the ratio of the major axis to the minor axis of 3 or less. Note that, in the present case, the number density of the inclusions having the size in the range of 0.5 μm to 5 μm is approximately several ten pieces per $mm^2$, in other words, falls within the range of 10 pieces/$mm^2$ to 100 pieces/$mm^2$.

Further, the present inventors examined the behavior of TiS generated through addition of Ti. As a result, the present inventors found that, under the high temperature, Ti and S are captured on the above-described compound inclusions, and are not precipitated as the coarsened inclusions of TiS. Further, the present inventors found that, since TiS precipitated as a fine precipitate in a solid matter slowly disperses, TiS remains in the solid matter as the fine precipitate.

Through observation, the present inventors found that, according to the steel of the present embodiment having the compound inclusion containing different inclusion phases including the first inclusion phase and the second inclusion phase, the size of TiS is 3 μm at the maximum, and inclusions having a size of 3 μm or less do not have any adverse effect on the hole-expandability in the case where the ratio of the number of the inclusions is 30% or less.

Further, TiN particles are generated with addition of Ti. These particles contribute to achieving a so-called pinning effect of suppressing growth of crystal grains in the structure of the steel sheet during heating applied before rolling, thereby reducing the crystal grain diameter of the structure of the steel sheet. This makes the multiple-precipitated inclusions made of oxide or oxysulfide less likely to be the starting point of the occurrence of cracking or pathway of crack propagation during repetitive deformation or hole expanding work. Further, the crystal gain diameter of the structure of the steel sheet is a fine size, which leads to improvement in the fatigue characteristics as described above.

Further, inclusions having a spherical shape, clustering state, or shapes broken during rolling are partially found as an inclusion having the size of over 5 μm. Although (Ce, La, Nd, Pr) is partially found from among these inclusions, the concentrations are low. Thus, most of these inclusions are considered to be so-called extrinsic inclusions resulting from oxide entering the molten steel from slag inclusion or refractory.

The present inventors made a study of how these inclusions having the size of over 5 μm have an effect on the hole expandability. As a result, it is found that, in the case where the number density is 10 pieces/$mm^2$ or less, these inclusions do not have any adverse effect on the hole expandability.

According to the present invention, Ca is added to the molten steel through blowing after addition of (Ce, La, Nd, Pr). At this time, metal Ca or an alloy containing metal Ca is used as powder for delivering a so-called flux such as CaO. Thus, it is considered that the extrinsic inclusions rise to the surface, and this leads to cleanliness of the molten steel.

The present inventors produced a steel ingot by then performing Al and Ti deoxidation, performing deoxidation while changing the composition of (Ce, La, Nd, Pr), and adding Ca. The obtained steel ingot is hot rolled to form a hot-rolled steel sheet having a thickness of 3 mm. For the obtained hot-rolled steel sheet, a hole-expanding test, and a bending test were performed, and examination was made on the number density of inclusions, formation and average composition in the steel sheet.

As a result of the experiments described above, it was found that the oxygen potential in the molten steel sharply decreases, by obtaining predetermined ratio of (Ce+La+Nd+Pr)/acid-soluble Al and ratio of (Ce+La+Nd+Pr)/S on the basis of mass in the steel sheet obtained by adding Si, performing deoxidation with Ti and Al, adding at least one element of Ce, La, Nd, and Pr, and adding Ca at the end to deoxidize.

In other words, with the effect obtained through multiple deoxidation applied in the order of Al, Ti, (Ce, La, Nd, Pr), and Ca, it is possible to obtain the largest oxygen-potential-reducing effect that the former deoxidation applications can obtain with various deoxidation elements. With the effect of multiple deoxidation, it is possible to extremely lower the $Al_2O_3$ concentration in the generated oxides, and hence, it is possible to obtain a steel sheet exhibiting excellent stretch-flange formability and bending workability as with the steel sheet produced with little deoxidation with Al.

The present inventors found that the predetermined ratio of (Ce+La+Nd+Pr)/acid-soluble Al is 70≥100×(Ce+La+Nd+Pr)/acid-soluble Al>0.2 on the basis of mass.

Further, the present inventors reached an idea of specification and simplification using a mass ratio of chemical components (Ce+La+Nd+Pr)/S in the steel sheet.

More specifically, the (Ce+La+Nd+Pr)/S is set so as to be in the range of 0.2 to 10. In the case where 70≥100×(Ce+La+Nd+Pr)/acid-soluble Al>0.2 is satisfied and (Ce+La+Nd+Pr)/S is in the range of 0.2 to 10, fine inclusions having an equivalent circle diameter of 2 μm or less are dispersed as described later.

On the other hand, in the case where the value of 100×(Ce+La+Nd+Pr)/acid-soluble Al exceeds 70, the diameter of the inclusions increases. In the case where the value of 100×(Ce+La+Nd+Pr)/acid-soluble Al is less than 0.2, $Al_2O_3$ increases.

Further, in the case where (Ce+La+Nd+Pr)/S is less than 0.2, large MnS is precipitated. On the other hand, in the case where (Ce+La+Nd+Pr)/S exceeds 10 and further increases, the effect saturates and the cost for Ce, La, Nd, and Pr increases.

According to the high-strength steel sheet according to this embodiment, the steel sheet exhibiting excellent stretch-flange formability and bending workability can be obtained because of the following reasons.

The present inventors found that the stretch-flange formability (hole expandability) can be further improved in the case where, in the high-strength steel sheet according to this embodiment, the ratio of the number of the spherical compound inclusions having the size of 5 μm or less and the ratio of the major axis to the minor axis of 3 or less is 50% or more when observation is made of inclusions having the equivalent circle diameter of 0.5 μm or more. This is because, according to the high-strength steel sheet according to this embodiment, the compound inclusions having a size of 5 μm or less are finely dispersed, and are also hard, and hence, deformation of these compound inclusions can be suppressed during rolling. Further, it is possible to obtain the effect of improving the bending workability or other properties, by significantly reducing the number of elongated and coarsened MnS-based inclusions in the steel sheet. Yet further, with the multiple deoxidation, the oxygen potential in the molten steel can be reduced, whereby nonuniformity of the components can be reduced.

It should be noted that the fine spherical chemical compound cannot be obtained by adding Ca before the addition of (Ce, La, Nd, Pr). It is considered that this is because, in the case where CaS having toughness and ductility is first generated, reduction of CaS cannot be performed with (Ce, La, Nd, Pr), and CaS remains in the steel.

On the basis of the findings obtained through the experiments and examination described above, the present inventors examined conditions of chemical components in the steel sheet in a manner as described below, and attained the high-strength steel sheet exhibiting excellent stretch-flange formability and bending workability according to this embodiment.

Next, chemical components of the high-strength steel sheet according to this embodiment will be described.

[C: 0.03% to 0.25%]

C is the most fundamental element that controls the hardenability and the strength of the steel, and increases the hardness of and the depth of the quench hardened layer, effectively contributing to improving the fatigue strength. In other words, C is an essential element for securing the strength of the steel sheet, and C of at least 0.03% is necessary to obtain the high-strength steel sheet. However, in the case where the amount of C exceeds 0.25%, the workability and the weldability deteriorate. In order to obtain the required strength while achieving the workability and the weldability, the concentration of C is set to be not more than 0.25% in the high-strength steel sheet according to this embodiment. Thus, the lower limit of C is set to 0.03%, preferably to 0.04%, more preferably to 0.05%. The upper limit of C is set to 0.25%, preferably to 0.20%, more preferably to 0.15%.

[Si: 0.03% to 2.0%]

Si is a primary deoxidation element, which increases the number of nucleation site of austenite during heating in the hardening, suppresses the grain growth in the austenite, and reduces the grain diameter in the quench hardened layer. Si suppresses the generation of carbides to prevent the reduction in the strength of the grain boundaries due to the carbides, and is effective in generating a bainite structure. Thus, Si is an important element to improve the strength without causing the deterioration in the elongation property, and improve the hole-expandability with a low yield strength ratio. In order to reduce the dissolved oxygen concentration in the molten steel, generate the $SiO_2$-based inclusion once, and obtain the minimum value of the final dissolved oxygen through the multiple deoxidation (this $SiO_2$-based inclusion is subjected to reduction with Al added later to form the alumina-based inclusion, and then, reduction with Ce, La, Nd, and/or Pr is applied to subject the alumina-based inclusion to reduction), it is necessary to add Si of 0.03% or more. For this reason, in the high-strength steel sheet according to this embodiment, the lower limit of Si is set to 0.03%. In the case where the concentration of Si is excessively high, toughness and ductility significantly deteriorate, and the decarburization of the surface and the damage of the surface increase, resulting in deteriorated bending workability. Further, in the case where Si is excessively added, Si has an adverse effect on the weldability and the ductility. For these reasons, in the high-strength steel sheet according to this embodiment, the upper limit of Si is set to 2.0%. Accordingly, the lower limit of Si is set to 0.03%, preferably to 0.05%, more preferably to 0.1%. The upper limit of Si is set to 2.0%, preferably to 1.5%, more preferably to 1.0%.

[Mn: 0.5% to 3.0%]

Mn is an element useful for deoxidation in the steel-producing stage, and is an element effective in enhancing the strength of the steel sheet as with C and Si. In order to obtain such an effect, it is necessary to make the steel sheet contain Mn of 0.5% or more. However, in the case where the amount of Mn contained exceeds 3.0%, Mn segregates or the solid solution strengthening increases, reducing the ductility. Further, the weldability and the toughness of the base material also deteriorate. For these reasons, the upper limit of Mn is set to 3.0%. Thus, the lower limit of Mn is set to 0.5%, preferably to 0.7%, more preferably to 1%. The upper limit of Mn is set to 3.0%, preferably to 2.6%, more preferably to 2.3%.

[P: 0.05% or Less]

P is effective in that P functions as a substitutional solid-solution strengthening element having a size smaller than Fe atom. However, in the case where the concentration of P exceeds 0.05%, P segregates in the grain boundaries of austenite, and the strength of the grain boundary deteriorates, reducing the torsion fatigue strength and possibly causing deterioration in the workability. Thus, the upper limit of P is set to 0.05%, preferably to 0.03%, more preferably to 0.025%. If the solid solution strengthening is not required, P is not necessary to be added, and hence, the lower limit value of P includes 0%.

[T.O: 0.0050% or Less]

Total oxygen amount (T.O) forms oxide as an impurity. In the case where the T.O is excessively high, the $Al_2O_3$-based inclusions increase, and the oxygen potential in the steel cannot be made minimized. This leads to the significant deterioration in the toughness and the ductility and the increase in the surface damage, resulting in the deterioration in the bending workability. For these reasons, in the high-strength steel sheet according to this embodiment, the upper limit of T.O is set to 0.0050%, preferably to 0.0045%, more preferably to 0.0040%.

[S: 0.0001% to 0.01%]

S segregates as an impurity, and forms a coarsened and elongated MnS-based inclusion, which deteriorates the stretch-flange formability. Thus, it is desirable to reduce the concentration of S as much as possible. By controlling the formation of the coarsened and elongated MnS-based inclusion in the high-strength steel sheet according to this embodiment, it is possible to obtain the material more than or equivalent to the cost without causing the desulfurization load in the secondary refinement and without the need for the desulfurization cost, even if the steel sheet contains a relatively high S concentration of approximately 0.01%. Thus, in the high-strength steel sheet according to this embodiment, the concentration of S is set in the range of the extremely low S concentration, which is a concentration set on the assumption that desulfurization is performed in the secondary refinement, to the relatively high S concentration, that is, the concentration of S is set in the range of 0.0001% to 0.01%.

Further, according to the high-strength steel sheet according to this embodiment, there is formed the spherical compound inclusion having an equivalent circle diameter in the range of 0.5 μm to 5 μm and containing different inclusion phases including the first inclusion phase of [REM]-[Ca]—[O,S] and the second inclusion phase of [Mn,Si,Ti,Al]-[REM]-[Ca]—[O,S].

The upper limit value of the concentration of S is set in association with the total amount of at least one element of Ce, La, Nd, and Pr as described later.

Further, in the case where the concentration of S exceeds 0.01%, at least one of the cerium oxysulfide, the lanthanum oxysulfide, the neodymium oxysulfide, and the praseodymium oxysulfide grows to be over 5 μm in size. These coarsened oxysulfides make the toughness and the ductility significantly deteriorate, leading to the increase in the surface damages and deteriorating the bending workability. For these reasons, in the high-strength steel sheet according to this embodiment, the upper limit of S is set to 0.01%, preferably to 0.008%, more preferably to 0.006%.

In other words, according to the high-strength steel sheet according to this embodiment, the generation of MnS is suppressed by forming the compound inclusion containing different inclusion phases including the first inclusion phase of [REM]-[Ca]—[O,S] and the second inclusion phase of [Mn,Si,Ti,Al]-[REM]-[Ca]—[O,S] as described above. Thus, even if the concentration of S is relatively high but not more than 0.01%, by adding the corresponding amount of at least one element of Ce, La, Nd, and Pr, it is possible to prevent the occurrence of adverse effect on the material. In other words, even if the concentration of S is relatively high, by adjusting the amount of at least one element of Ce, La, Nd, and Pr so as to correspond to the amount of S, it is possible to substantially obtain the desulfurization effect, and it is possible to obtain a material equivalent to the ultra-low sulfur steel. This means that, by appropriately adjusting the concentration of S so as to associated with the total amount of Ce, La, Nd and Pr, it is possible to increase the flexibility in the upper limit of the concentration of S. Thus, the high-strength steel sheet according to this embodiment does not require desulfurization of the molten steel in the secondary refinement to obtain the ultra-low sulfur steel, and can omit the desulfurization process. This enables simplification of the producing processes, and reduction in the cost required for the desulfurization process.

[Acid-Soluble Ti: 0.008% to 0.20%]

Ti is a primary deoxidation element, which forms carbides, nitrides, and carbonitrides, increases the number of nucleation site of austenite by sufficiently heating the steel before the hot rolling, and suppresses the grain growth of the austenite. With these functions, Ti contributes to forming fine grains and enhancing the strength of the grains, and is effective in dynamic recrystallization during the hot rolling, thereby significantly improving the stretch-flange formability. To obtain these effects, it is found through experiments that it is necessary to add the acid-soluble Ti of 0.008% or more. Thus, in the high-strength steel sheet according to this embodiment, the lower limit of the acid-soluble Ti is set to 0.008%, preferably to 0.01%, more preferably to 0.015%. Note that the temperature for the sufficient heating before the hot rolling is required to be set to a temperature sufficient for dissolving the carbides, nitrides, and carbonitrides generated during casting in solid solution once, and over 1200° C. is necessary. Setting the temperature to over 1250° C. is not preferable from the viewpoint of cost and generation of scale. Thus, it is preferable to set the temperature to approximately 1250° C. In the case where the content exceeds 0.2%, the effect of deoxidation saturates, and coarsened carbides, nitrides, and carbonitrides are formed even if heating is sufficiently applied before the hot rolling, deteriorating the material. Further, the effect corresponding to the amount of the element contained cannot be obtained. Thus, in the high-strength steel sheet according to this embodiment, the upper limit of the concentration of acid-soluble Ti is set to 0.2%, preferably to 0.18%, more preferably to 0.15%. Note that the term "acid-soluble Ti concentration" refers to a measured concentration of Ti dissolved in acid, and this measurement employs a characteristic in which the dissolved Ti is dissolved in acid whereas Ti oxide is not dissolved in acid. In this specification, the term "acid" refers, for example, to a mixed acid having mass ratio of hydrochloric acid: 1, nitric acid: 1, and water: 2. By using such an acid, it is possible to separate Ti soluble in the acid and Ti oxide non-soluble to the acid, whereby it is possible to measure the acid-soluble Ti concentration.

The present inventors found that it is possible to obtain TiS having a size of 3 μm or less, by adjusting Ti in the range described above, adjusting (Ce+La+Nd+Pr)/S so as to be in the range of 0.2 to 10, and adding Ca after the addition of at least one element of Ce, La, Nd, and Pr.

This is because Ca is contained in all the inclusion phases in the compound inclusion containing inclusion phases having different components and including the first inclusion phase of [REM]-[Ca]—[O,S] and the second inclusion phase of [Mn, Si, Ti, Al]-[REM]-[Ca]—[O,S], and hence, Ti and S are more likely to be absorbed by the compound inclusion. Thus, the TiS inclusion, which is precipitated at a high temperature, is more likely to be captured by the compound inclusion, and is not precipitated alone. Further, the TiS inclusion is not competitively precipitated on the compound inclusion. Thus, only the TiS inclusion is precipitated alone when a temperature is a lower temperature and a solubility product of Ti and S reaches a precipitation region, and if precipitated, the TiS inclusion precipitated alone has a size of 3 μm or less.

Further, it is considered that, as is the case with the suppression of MnS, adjustment of (Ce+La+Nd+Pr)/S to be in the range of 0.2 to 10 delays the precipitation of TiS, and has an effect of reducing the size of precipitated TiS and lowering the ratio of number of TiS.

It should be noted that, by adding Ca before addition of at least one element of Ce, La, Nd, and Pr, it is possible to multiply precipitate MnS, TiS, and (Mn, Ti)S in the inclusion containing at least one element of Ce, La, Nd, and Pr. However, in this case, CaS is generated alone. In other words, Ca does not exist in the inclusion containing at least one element of Ce, La, Nd, and Pr, and hence, unlike the high-strength steel sheet according to this embodiment, Ti and S are not likely to be absorbed in the compound inclusion. For these reasons, in the case where Ca is added before the addition of at least one element of Ce, La, Nd, and Pr, the size of the TiS inclusion may be 3 μm or more, and the stretch-flange formability becomes worse as compared with that of the high-strength steel sheet according to this embodiment.

[N: 0.0005% to 0.01%]

N is captured from air during the steel-melting process, and hence, is an element that is inevitably contained in the steel. N forms nitrides with Al, Ti or other elements, and promotes reduction in size of grains in the base material structure. However, in the case where the amount of N contained exceeds 0.01%, N generates coarsened precipitates, for example, with Al or Ti, deteriorating the stretch-flange formability. For this reason, in the high-strength steel sheet according to this embodiment, the upper limit of the concentration of N is set to 0.01%, preferably to 0.005%, more preferably to 0.004%. On the other hand, the cost required for lowering the N concentration to less than 0.0005% is high, and hence, the lower limit of the N concentration is set to 0.0005% from the viewpoint of industrial feasibility.

[Acid-Soluble Al: Over 0.01%]

In general, an oxide of acid-soluble Al forms a cluster and is likely to coarsen, which leads to a deterioration in the stretch-flange formability and the bending workability. Thus, it is desirable to reduce acid-soluble Al as much as possible. However, according to the high-strength steel sheet according to this embodiment, a range of amount of acid-soluble Al was newly found, which enables obtaining the ultra-low oxygen potential as described above while preventing clustering and coarsening of alumina-based inclusions, by employing Al deoxidation and the deoxidation effect obtained by sequentially applying multiple deoxidation with Si, Ti, (Ce, La, Nd, and Pr), and Ca, and adjusting the concentration of at least one element of Ce, La, Nd, and Pr so as to correspond to the concentration of acid-soluble Al. In this range, part of the $Al_2O_3$-based inclusions generated through Al deoxidation rise to the surface and are removed whereas the rest of the $Al_2O_3$-based inclusions remaining in the molten steel are subjected to reductive decomposition with at least one element of Ce, La, Nd, and Pr added later, and the clustered alumina-based oxide is decomposed to form the fine inclusions.

With this finding, according to the high-strength steel sheet according to this embodiment, it is possible to eliminate the need for setting the limitation that Al is substantially not added in order to avoid the coarsened cluster of the alumina-based inclusions as in the conventional art. In particular, it is possible to increase the flexibility in the concentration of the acid-soluble Al. By setting the concentration of acid-soluble Al to over 0.01%, preferably to 0.013% or more, more preferably to 0.015% or more, it is possible to employ the Al deoxidation, deoxidation with addition of at least one element of Ce, La, Nd, and Pr, and Ca deoxidation, thereby eliminating the need for adding the at least one deoxidation element of Ce, La, Nd, and Pr more than necessary as in the conventional art. Thus, it is possible to solve the problem of an increase in the oxygen potential in the steel due to deoxidation with at least one element of Ce, La, Nd, and Pr. Further, it is possible to obtain the effect of reducing the variation in the composition of the component elements.

The upper limit value of the concentration of acid-soluble Al is set in association with the total amount of at least one element of Ce, La, Nd, and Pr as described later.

In this specification, the term "acid-soluble Al concentration" refers to a measured concentration of Al dissolved in acid, and this measurement employs a characteristic in which dissolved Al is dissolved in acid whereas $Al_2O_3$ is not dissolved in acid. In this specification, the term "acid" refers, for example, to a mixed acid having mass ratio of hydrochloric acid: 1, nitric acid: 1, and water: 2. By using such an acid, it is possible to separate Al soluble in the acid and $Al_2O_3$ non-soluble to the acid, whereby it is possible to measure the acid-soluble Al concentration.

[Ca: 0.0005% to 0.005%]

In the high-strength steel sheet according to this embodiment, Ca is an important element, which forms the compound inclusion containing different inclusion phases including the first inclusion phase of [REM]-[Ca]—[O,S] and the second inclusion phase of [Mn,Si,Ti,Al]-[REM]-[Ca]—[O,S].

In other words, Ca is added to reduce the inclusions generated through deoxidation with (Ce, La, Nd, Pr) to make all the inclusion phases contain Ca, thereby forming the compound inclusion describe above. If Ca is not added, the above-described compound inclusion is not formed.

By forming this compound inclusion, it is possible to improve the stretch-flange formability and the bending workability of the steel. In order to obtain this effect, it is preferable to set the amount of Ca added to 0.0005% or more.

However, the excessively large amount of Ca added saturates this effect, impairing the cleanliness of the steel and deteriorating the ductility. Thus, the upper limit of Ca is set to 0.005%. The lower limit of Ca is set to 0.0005%, preferably to 0.0007%, more preferably to 0.001%. The upper limit of Ca is set to 0.005%, preferably to 0.0045%, more preferably to 0.0035%.

[Total of at Least One Element of Ce, La, Nd, and Pr: 0.001% to 0.01%]

Ce, La, Nd, and Pr have an effect of reducing $SiO_2$ generated through Si deoxidation and $Al_2O_3$ sequentially generated through Al deoxidation, and separating $Al_2O_3$ clusters, which are likely to coarsen. Further, by adding Ca after addition of at least one element of Ce, La, Nd, and Pr, there is formed the compound inclusion containing different inclusion phases including the first inclusion phase of [REM]-[Ca]—[O,S] and the second inclusion phase of [Mn, Si,Ti,Al]-[REM]-[Ca]—[O,S].

The present inventors found experimentally that, in order to obtain such an inclusion, it is necessary to set the total concentration of at least one element of Ce, La, Nd, and Pr to be not less than 0.0005% and not more than 0.01%.

In the case where the total concentration of at least one element of Ce, La, Nd, and Pr is less than 0.0005%, the $SiO_2$ and $Al_2O_3$ inclusions cannot be reduced. In the case where the total concentration exceeds 0.01%, the large amount of cerium oxysulfide and lanthanum oxysulfide is generated, and forms coarsened inclusions, deteriorating the stretch-flange formability and the bending workability. Note that the lower limit of the total concentration of at least one element of Ce, La, Nd, and Pr is set preferably to 0.0013%, and more preferably to 0.0015%. The upper limit of the total concentration of at least one element of Ce, La, Nd, and Pr is set preferably to 0.009%, more preferably to 0.008%.

As conditions for the existence of inclusions having a formation in which MnS is precipitated in the oxide or oxysulfide formed by at least one element of Ce, La, Nd, and Pr in the high-strength steel sheet according to this embodiment, the present inventors focused on the fact that it is possible to determine the degree of improvement of MnS with the oxide or oxysulfide formed by at least one of Ce, La, Nd, and Pr, by specifying the degree of improvement using the concentration of S. Then, the present inventors reached an idea of specifying and simplifying the degree of improvement using a mass ratio of chemical components (Ce+La+Nd+Pr)/S in the steel sheet.

More specifically, in the case where this mass ratio is low, the number of the oxide or oxysulfide formed by at least one element of Ce, La, Nd, and Pr is small, and a large number of MnS is precipitated alone. As this mass ratio increases, the number of the inclusions having a formation of the compound inclusion containing different inclusion phases including the first inclusion phase and the second inclusion phase also increases as compared with MnS. This means that MnS is improved with the oxide or oxysulfide formed by at least one element of Ce, La, Nd, and Pr. As described above, MnS is precipitated in the oxide or oxysulfide formed by at least one element of Ce, La, Nd, and Pr in order to improve the stretch-flange formability and the bending workability, which leads to prevention of elongated MnS. For these reasons, the above-described mass ratio can be used as a parameter to determine whether or not these effects can be obtained.

In order to determine the chemical component ratio effective in suppressing the elongation of the MnS-based inclusions, the mass ratio of (Ce+La+Nd+Pr)/S in the steel sheet was varied to adjust the components in the steel sheet, Ca is then added, and evaluation was made of the formation of the inclusions, the stretch-flange formability, and the bending workability. As a result, it was found that, by setting the mass ratio of (Ce+La+Nd+Pr)/S in the range of 0.2 to 10, both the stretch-flange formability and the bending workability significantly improve.

In the case where the mass ratio of (Ce+La+Nd+Pr)/S is less than 0.2, the ratio of the number of the inclusions having the formation of the compound inclusion containing different inclusion phases including the first inclusion phase of [REM]-[Ca]—[O,S] and the second inclusion phase of [Mn, Si,Ti,Al]-[REM]-[Ca]—[O,S] is undesirably low. This correspondingly leads to the excessive increase in the ratio of number of elongated MnS-based inclusions, which are likely to be the starting point of the occurrence of cracking, deteriorating the stretch-flange formability and the bending workability.

In the case where the mass ratio of (Ce+La+Nd+Pr)/S exceeds 10, the effect of generating the compound inclusion containing different inclusion phases including the first inclusion phase and the second inclusion phase to improve the stretch-flange formability and the bending workability saturates, which is not worth the cost. From these reasons, the mass ratio of (Ce+La+Nd+Pr)/S is set in the range of 0.2 to 10. In the case where the mass ratio of (Ce+La+Nd+Pr)/S is excessively high, for example, is over 70, the large amount of the cerium oxysulfide and the lanthanum oxysulfide is generated, and becomes coarsened inclusions, deteriorating the stretch-flange formability and the bending workability. Thus, the upper limit of the mass ratio of (Ce+La+Nd+Pr)/S is set to 10.

It should be noted that, in the high-strength steel sheet according to this embodiment, the total concentration of the at least one element Ce, La, Nd, and Pr contained in the compound inclusion containing different inclusion phases including the first inclusion phase of [REM]-[Ca]—[O,S] and the second inclusion phase of [Mn,Si,Ti,Al]-[REM]-[Ca]—[O,S] is in the range of 0.5% to 95%. In the case where the total concentration is less than 0.5%, the hard compound inclusion cannot be obtained, and the ratio of major axis/minor axis is 3 or more when subjected to rolling, which adversely affects the hole-expandability of the steel sheet. On the other hand, in the case where the total concentration exceeds 95%, the inclusions are more likely to be brittle. Thus, the inclusions are pulverized and remain in a stranded formation as with the elongated inclusions, and adversely affect the hole-expandability of the steel sheet.

Next, selective elements for the high-strength steel sheet according to this embodiment will be described. These elements are selective elements, and hence, may be added or may not be added. Further, it may be possible to add these elements either alone or in combination of two or more types. In other words, the lower limit of these selective elements may be set to 0%.

For Nb and V

Nb and V form carbides, nitrides, or carbonitrides with C or N to facilitate the reduction in size of grains in the base material structure, and contribute to improving the toughness.

[Nb: 0.005% to 0.10%]

In order to obtain composite carbides, composite nitrides or other compound described above, it is preferable to set the concentration of Nb to 0.005% or more, and it is more preferable to set the concentration of Nb to 0.008% or more. However, in the case where the base material contains the large amount of Nb in excess of the concentration of 0.10%, the effect of providing the fine grain in the base material structure saturates, increasing the producing cost. For these reasons, the upper limit of the concentration of Nb is set to 0.10%, preferably set to 0.09%, more preferably set to 0.08%.

[V: 0.01% to 0.10%]

In order to obtain the above-described composite carbides, composite nitrides and the like, it is preferable to set the concentration of V to 0.01% or more. However, even if the large amount of V is contained in excess of the concentration of 0.10%, the effect obtained from V contained saturates, increasing the producing cost. For this reason, the upper limit of the concentration of V is set to 0.10%.

For Cu, Ni, Cr, Mo, and B

Cu, Ni, Cr, Mo, and B enhance the strength, and improve the hardenability of the steel.

[Cu: 0.1% to 2%]

Cu contributes to improving the precipitation hardening and the fatigue strength of ferrite, and may be added depending on applications to further enhance the strength of the steel sheet. In order to obtain this effect, it is preferable to add Cu of 0.1% or more. However, the excessively large amount of Cu contained deteriorates the balance of strength-ductility. Thus, the upper limit of Cu is set to 2%, preferably to 1.8%, more preferably to 1.5%.

[Ni: 0.05% to 1%]

Ni can be used for solid solution strengthening of ferrite, and may be added depending on applications to further enhance the strength of the steel sheet. In order to obtain this effect, it is preferable to add Ni of 0.05% or more. However, the excessively large amount of Ni contained deteriorates the balance of strength-ductility. Thus, the upper limit of Ni is set to 1%.

[Cr: 0.01% to 1.0%]

Cr may be added depending on applications to further enhance the strength of the steel sheet. In order to obtain this effect, it is preferable to add Cr of 0.01% or more. However, the excessively large amount of Cr contained deteriorates the balance of strength-ductility. Thus, the upper limit of Cr is set to 1.0%.

[Mo: 0.01% to 0.4%]

Mo may be added depending on applications to further enhance the strength of the steel sheet. In order to obtain this effect, it is preferable to add Mo of 0.01% or more, and it is more preferable to add Mo of 0.05% or more. However, the excessively large amount of Mo contained deteriorates the balance of strength-ductility. Thus, the upper limit of Mo is set to 0.4%, preferably to 0.3%, more preferably to 0.2%.

[B: 0.0003% to 0.005%]

B may be added depending on applications to further enhance the strength of the grain boundaries, and improve the workability. In order to obtain this effect, it is preferable to add B of 0.0003% or more, and it is more preferable to add B of 0.0005% or more. However, in the case where the amount of B contained exceeds 0.005%, the effect obtained from B saturates, and the cleanliness of the steel is impaired, deteriorating the ductility. Thus, the upper limit of B is set to 0.005%.

For Zr

Zr may be added depending on applications to strengthen the grain boundaries and improve the workability with the control of sulfide formation.

[Zr: 0.001% to 0.01%]

In order to obtain the effect of forming spherical sulfides to improve the toughness of the base material, it is preferable to add Zr of 0.001% or more. However, the excessively large amount of Zr contained impairs the cleanliness of the steel, which leads to a deterioration in the ductility. Thus, the upper limit of Zr is set to 0.01%, preferably to 0.009%, more preferably to 0.008%.

Next, a description will be made of conditions for the existence of inclusions in the high-strength steel sheet according to this embodiment. In this specification, the term "steel sheet" means a rolled sheet obtained through hot rolling, or through hot rolling and cold rolling. Further, the conditions for the existence of inclusions in the high-strength steel sheet according to this embodiment are set from various viewpoints.

In order to obtain the steel sheet exhibiting excellent stretch-flange formability and bending workability, it is important to minimize the elongated and coarsened MnS-based inclusions in the steel sheet, which are likely to be the starting point of the occurrence of cracking or the pathway of crack propagation.

In this regard, the present inventors found that, as with steel sheets produced with little deoxidation with Al, it is possible to obtain a steel sheet exhibiting excellent stretch-flange formability and bending workability because the oxygen potential in the molten steel sharply decreases through the multiple deoxidation, $Al_2O_3$ generated through Al deoxidation is subjected to reduction, and $Al_2O_3$ cluster, which is likely to coarsen, is separated, by adding Si to a steel, subjecting the steel to the deoxidation with Al, then, adding at least one element of Ce, La, Nd, and Pr, further adding Ca for deoxidation in a manner described above, and obtaining the predetermined ratio (Ce+La+Nd+Pr)/acid-soluble Al and ratio of (Ce+La+Nd+Pr)/S on the basis of mass as described above.

Further, it was also found that, with deoxidation through addition of Ce, La, Nd, and/or Pr, and addition of Ca thereafter, the fine and hard compound inclusion containing different inclusion phases including the first inclusion phase of [REM]-[Ca]—[O,S] and the second inclusion phase of [Mn,Si,Ti,Al]-[REM]-[Ca]—[O,S] is generated in most parts although a slight amount of $Al_2O_3$ exists, and the precipitated MnS and other inclusions are less likely to deform even during rolling, whereby the number of the elongated and coarsened MnS can be significantly reduced in the steel sheet.

Further, it was found that, by obtaining the ratio of (Ce+La+Nd+Pr)/acid-soluble Al and the ratio of (Ce+La+Nd+Pr)/S on the basis of mass as described above, the number density of fine inclusions having an equivalent circle diameter of 2 μm or less significantly increases, and the fine inclusions are dispersed in the steel.

These fine inclusions are less likely to aggregate, and hence, most of them remain in the spherical shape or spindle shape. These inclusions have a major axis/minor axis (hereinafter, also referred to as "elongated ratio") of 3 or less, preferably 2 or less. In the present invention, these inclusions are referred to as spherical inclusions.

In terms of experiment, the inclusions can be identified easily through observation using a scanning electron microscope (SEM), and focus was placed on the number density of inclusions having an equivalent circle diameter of 5 μm or less. Note that, although the lower limit value for the equivalent circle diameter is not particularly set, it is preferable to set a target of the observation at the inclusions having approximately 0.5 μm or more, the size of which can be counted and expressed in number. In this specification, the term "equivalent circle diameter" refers to a value obtained through (major axis×minor axis)0.5 on the basis of the major axis and the minor axis of the inclusion with cross-section observation.

It is considered that the fine inclusions having a size of 5 μm or less are dispersed because the oxygen potential in the molten steel is reduced through Al deoxidation and adjustment of components of at least one element of Ce, La, Nd, and Pr; the compound inclusions are less likely to aggregate due to the formation of inclusion phases containing at least one element of Ti, Si, Al, and Ca in the oxide and/or oxysulfide formed by at least one element of Ce, La, Nd, and Pr and further existence of Ca in each inclusion phase; and the hardness of the compound inclusions is increased to make the inclusions fine. It is assumed that, with this formation, the stress concentration occurring during stretch-flange forming is relaxed, and the hole-expandability sharply improves. Thus, the compound inclusions are less likely to be the starting point of the occurrence of cracking or pathway of crack propagation during repetitive deformation and hole-expanding work, and contributes to relaxing the stress concentration due to the fine size, which leads to improvement in the stretch-flange formability and the bending workability.

The present inventors checked whether the number of the elongated and coarsened MnS-based inclusions, which are likely to be the starting point of the occurrence of cracking or pathway of crack propagation, was reduced in the steel sheet.

Through experiments, the present inventors knew that, in the case where the equivalent circle diameter is less than 1 μm, the elongated MnS does not have any adverse effect in terms of the starting point of the occurrence of cracking, and does not deteriorate the stretch-flange formability or bending workability. Further, the inclusions having an equivalent circle diameter of 1 μm or more can be easily observed with the scanning electron microscope (SEM) or other devices. For these reasons, by targeting the observation at the inclusions having the equivalent circle diameter of 0.5 μm or more in the steel sheet, their formations and compositions were examined to evaluate the distribution state of the elongated MnS.

It should be noted that, although the upper limit of the equivalent circle diameter of MnS is not particularly set, MnS having a size of approximately 1 mm may be observed in practical.

The ratio of the number of the elongated inclusions was measured through composition analysis on plural pieces (for example, about 50 pieces) of inclusions having the equivalent circle diameter of 1 μm or more and randomly selected using a SEM, and through measurement of the major axis and the minor axis of the inclusions using a SEM image. In this specification, the elongated inclusion represents an inclusion having a major axis/minor axis (elongated ratio) of over 3. Further, the ratio of the number of the elongated inclusions can be obtained by dividing the number of the detected elongated inclusions by the total number of inclusions analyzed (about 50 in the case of the above-described example). On the other hand, the spherical inclusion represents an inclusion having the major axis/minor axis (elongated ratio) of 3 or less.

Figure 4:
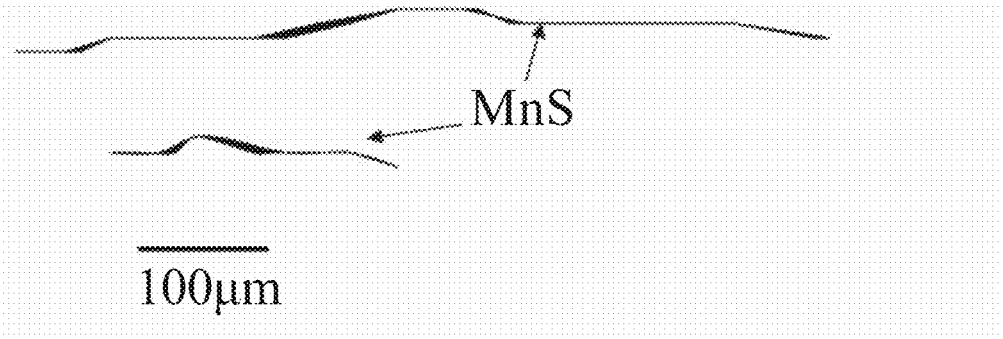
FIG. 4 is a diagram illustrating an elongated sulfide-based inclusion formed mainly by MnS.
Figure 5:
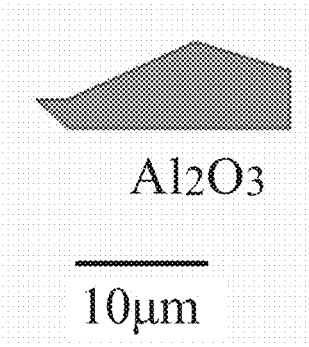
FIG. 5 is a diagram illustrating an alumina-based inclusion that has an effect on stretch-flange formability.
Figure 6:
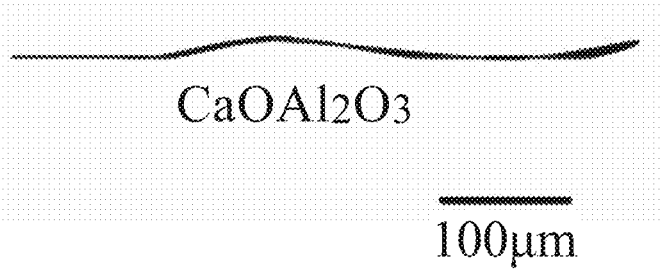
FIG. 6 is a diagram illustrating an elongated CaO—$Al_2O_3$-based oxide having a lower melting point and having an effect on stretch-flange formability.
Figure 7:
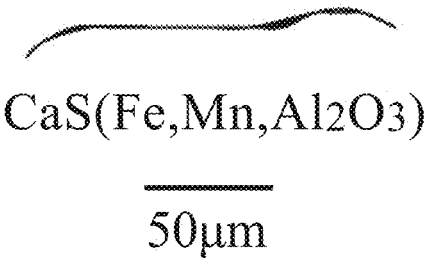
FIG. 7 is a diagram illustrating an elongated CaS-based inclusion containing coarsened Fe, Mn or O dissolved in solid solution or combined with CaO—$Al_2O_3$, and having an effect on the stretch-flange formability.

The reason that the elongated ratio is set to over 3 is because the inclusions having the elongated ratio of over 3 in the comparative steel sheet without having the Ce, La, Nd or Pr added therein were formed mostly by MnS. Note that, although the upper limit of the elongated ratio of MnS is not particularly set, MnS having the elongated ratio of approximately 50 may be observed in practice as illustrated in FIG. 4.

As a result, it was found that, with the steel sheet having the controlled formation in which the ratio of the number of the elongated inclusions having an elongated ratio of 3 or less is controlled to be 50% or more, the stretch-flange formability and the bending workability improve. More specifically, in the case where the ratio of the number of the elongated inclusions having the elongated ratio of 3 or less is less than 50%, the ratio of number of elongated MnS-based inclusions, which are likely to be the starting point of the occurrence of cracking, excessively increases, and the stretch-flange formability and the bending workability deteriorate. For these reasons, according to present invention, the ratio of the number of the elongated inclusions having the elongated ratio of 3 or less is set to 50% or more.

The stretch-flange formability and the bending workability become more favorable with decrease in the number of the elongated MnS-based inclusions. Thus, the lower limit value of the ratio of the number of the elongated inclusions having the elongated ratio of over 3 includes 0%. In this specification, the state in which an inclusion has an equivalent circle diameter of 1 μm or more and the lower limit value of the ratio of number of an elongated inclusion having the elongated ratio of over 3 is 0% means that there exists an inclusion having the equivalent circle diameter of 1 μm or more but there exists no inclusion having the elongated ratio of over 3, or the inclusion is an elongated inclusion having the elongated ratio of over 3 but the equivalent circle diameters of all the inclusions are less than 1 μm.

Further, it was confirmed that the maximum equivalent circle diameter of the elongated inclusions is smaller as compared with the average grain diameter of crystals in the structure. This also contributes to the significant improvement in the stretch-flange formability and the bending workability.

In the case where a steel sheet has the controlled formation in which the mass ratio of (Ce+La+Nd+Pr)/S is in the range of 0.2 to 10, and the ratio of the number of the elongated inclusions having the elongated ratio of 3 or less is 50% or more, the steel sheet is correspondingly formed by a spherical compound inclusion having an equivalent circle diameter in the range of 0.5 μm to 5 μm and containing different inclusion phases including the first inclusion phase and the second inclusion phase.

It should be noted that TiN along with the MnS-based inclusions may be multiply precipitated on the fine and hard Ce oxide, La oxide, cerium oxysulfide, and lanthanum oxysulfide. However, as described above, it was confirmed that TiN has little effect on the stretch-flange formability and the bending workability, and hence, TiN is not the target of MnS-based inclusion in the high-strength steel sheet according to this embodiment.

Next, the condition for the existence of inclusions in the high-strength steel sheet according to this embodiment described above is set using number density of the inclusion per unit volume.

The distribution of grain diameters of inclusions was obtained through a SEM evaluation on an electrolyzed surface using a speed method. The SEM evaluation on the electrolyzed surface using the speed method was performed such that: a surface of a test piece was polished, and was subjected to electrolyzation using the speed method; and the surface of the test piece was directly observed with the SEM observation, thereby evaluating the size or number density of the inclusion. Note that the speed method represents a method of electrolyzing the surface of the test piece using 10% acetyl acetone-1% tetramethyl ammonium chloride-methanol, and extracting the inclusions. As for the amount of electrolysis, electrolyzation was performed under the condition that electric charge of the surface of the test piece per 1 $cm^2$ area reached 1 C (coulomb). The SEM image of the surface electrolyzed as described above was subjected to image processing, thereby obtaining a frequency (number of pieces) distribution in terms of equivalent circle diameter. On the basis of the frequency distribution of the grain diameter, the average equivalent circle diameter was obtained. Further, the number density of inclusions per unit volume was calculated by dividing the frequency by the area of the observed view and the depth obtained from the amount of electrolysis. Further, the ratio of number was also calculated.

In order to determine a composition effective in suppressing the elongation of MnS-based inclusions, composition analysis was performed on spherical compound inclusions having an equivalent circle diameter in the range of 0.5 μm to 5 μm and containing different inclusion phases including the first inclusion phase and the second inclusion phase.

Since the observation becomes easy if the equivalent circle diameter of the inclusions is 0.5 μm or more, the target of the observation was set at the equivalent circle diameter of 0.5 μm or more for the convenience purpose. However, if the observation is possible, it may be possible to include the inclusions having the equivalent circle diameter of less than 0.5 μm.

As a result, it was found that the stretch-flange formability and the bending workability improve, by forming the inclusions having the equivalent circle diameter of 0.5 μm or more and the elongated ratio of 3 or less so as to contain the total amount of at least one element of Ce, La, Nd, and Pr in the range of 0.5% to 95% in average composition.

In the case where the average amount of the total of the at least one element of Ce, La, Nd, and Pr contained is less than 0.5 mass % in the inclusions having the equivalent circle diameter of 0.5 μm or more and the elongated ratio of 3 or less, the ratio of the number of the compound inclusions containing different inclusion phases including the first inclusion phase and the second inclusion phase largely decreases, while the ratio of the number of the MnS-based elongated inclusions, which are likely to be the starting point of the occurrence of cracking, excessively increases correspondingly. Thus, the stretch-flange formability and the bending workability deteriorate.

On the other hand, in the case where the average amount of the total of the at least one element of Ce, La, Nd, and Pr contained exceeds 95% in the inclusions having the equivalent circle diameter of 0.5 μm or more and the elongated ratio of 3 or less, at least one of cerium oxysulfide, lanthanum oxysulfide, neodymium oxysulfide, praseodymium oxysulfide is largely generated, which leads to coarsened inclusions having the equivalent circle diameter of approximately 50 μm or more. Thus, the stretch-flange formability and the bending workability deteriorate.

Next, the structure of the steel sheet will be described.

According to the high-strength steel sheet according to this embodiment, the fine MnS-based inclusions are precipitated in the cast slab, and are dispersed in the steel sheet as the fine spherical inclusions, which do not deform during rolling and are less likely to be the starting point of the occurrence of cracking, so that the stretch-flange formability and the bending workability can be improved. Thus, the micro-structure of the steel sheet is not particularly limited.

Although the micro-structure of the steel sheet is not particularly limited, it may be possible to employ any structure from among a steel sheet having a structure of a phase formed mainly by bainitic ferrite, a composite-structure steel sheet having a main phase of a ferrite phase and a second phase of a martensite phase and a bainite phase, and a composite-structure steel sheet formed by ferrite, retained austenite and a low-temperature transformation phase (formed by martensite or bainite).

Further, by sufficiently applying heat at approximately 1250° C. before the hot rolling, the carbides, the nitrides, and the carbonitrides generated through casting are once dissolved in solid solution to increase acid-soluble Ti in the steel. Then, with the effect obtained from solute Ti or carbonitrides of Ti, it is possible to form fine crystal grains, so that the crystal grain diameter in the steel sheet can be reduced to be 10 μm or less.

Thus, any of the structures described above are favorable because it is possible to reduce the crystal grain diameter to 10 μm or less, and the hole-expandability and the bending workability can be improved. In the case where the average grain diameter exceeds 10 μm, the degree of improvement in the ductility and the bending workability reduces. In order to improve the hole-expandability and the bending workability, it is more preferable to set the crystal grain diameter to 8 μm or less. However, in general, in the case where excellent stretch-flange formability is required, for example, in the case of application for underbody components, it is desirable and preferable that the ferrite or bainite phase be the maximum area-ratio phase, although the ductility be slightly lower.

Next, conditions for producing the steel sheet will be described.

According to a method of producing molten steel for the high-strength steel sheet according to this embodiment, alloys such as C, Si, and Mn are further added to the molten steel decarbonized by blowing in a converter or by further using a vacuum degassing device, and the molten steel is agitated, thereby performing deoxidation and component adjustment.

As for S, desulfurization may not be performed in the refinement process as described above, and thus, the desulfurization process can be omitted. However, in the case where desulfurization of the molten steel is necessary in the secondary refinement to produce the ultra-low sulfur steel with approximately S≤20 ppm, it may be possible to perform desulfurization to adjust the components.

It is preferable that, after the elapse of approximately 3 minutes from the addition of Si described above, Al be added to perform Al deoxidation, and then, the rising time of approximately 3 minutes be set so as to allow $Al_2O_3$ to rise to the surface and be separated. Ti is added after the Al deoxidation.

Thereafter, at least one element of Ce, La, Nd, and Pr is added, and components are adjusted so as to satisfy 70≥100×(Ce+La+Nd+Pr)/acid-soluble Al≥2, and (Ce+La+Nd+Pr)/S being in the range of 0.2 to 10 on the basis of mass.

In the case where a selective element is added, the selective element is added before the addition of the at least one element of Ce, La, Nd, and Pr, agitation is sufficiently performed, and the at least one element of Ce, La, Nd, and Pr is added. Depending on application, the at least one element of Ce, La, Nd, and Pr may be added after components of the selective element are adjusted.

Then, agitation is sufficiently performed, and Ca is added. The thus obtained molten steel is subjected to continuous casting to produce a cast slab.

The continuous casting not only includes an ordinal slab continuous casting having a thickness of approximately 250 mm, but also includes a bloom, a billet, and thin slab continuous casting having a thinner die-thickness than that of ordinal slab continuous-casting devices, for example, a thickness of 150 mm or less.

Hot rolling conditions for producing the high-strength hot-rolled steel sheet will be described.

Since carbonitrides or other inclusions in the steel need to be once dissolved in solid solution, it is important to set a heating temperature for a slab before hot rolling to over 1200° C.

By making the carbonitrides dissolved in solid solution, it is possible to obtain a ferrite phase, which is favorable to improve the ductility in the cooling process after the rolling. On the other hand, in the case where the heating temperature for the slab before the hot rolling exceeds 1250° C., the surface of the slab is significantly oxidized. In particular, wedge-shaped surface defects appear after descaling due to selective oxidation of the grain boundaries, deteriorating the quality of the surface after the rolling. Thus, it is preferable to set the upper limit of the heating temperature to 1250° C.

After being heated in the temperature range described above, the slab is subjected to the normal hot rolling. In this hot rolling process, the temperature at the time of completion of the finishing rolling is important to control the structure of the steel sheet. In the case where the temperature at the time of completion of the finishing rolling is less than Ar3 point+30° C., the diameter of the crystal grain in the surface layer portion is likely to coarsen, which is not favorable in terms of bending workability. On the other hand, in the case where this temperature exceeds the Ar3 point+200° C., the diameter of the austenite grain after the completion of the rolling coarsens, which makes it difficult to control the structure and the ratio of the phase generated during cooling. Thus, the upper limit of the temperature is set preferably to the Ar3 point+200° C.

Further, depending on the targeted structure configuration, a condition for the hot rolling is selected from among a condition in which an average cooling rate for the steel sheet after the finishing rolling is set in the range of 10° C./sec to 100° C./sec, and the coiling temperature is set in the range of 450° C. to 650° C., and a condition in which the steel sheet is air cooled at approximately 5° C./sec until the temperature reaches 680° C. after the finishing rolling, and is cooled thereafter at the cooling rate of 30° C./sec or more, and the coiling temperature is set to 400° C. or less. By controlling the cooling rate and the coiling temperature after the rolling, it is possible to obtain a steel sheet having one or more structures of polygonal ferrite, bainitic ferrite, and a bainite phase, and the corresponding ratio under the former rolling condition, and a DP steel sheet having a compound structure including the large amount of polygonal ferrite phase, which are excellent in ductility, and the martensite phase under the latter rolling condition.

In the case where the average cooling rate described above is less than 10° C./sec, pearlite, which is not favorable in terms of the stretch-flange formability, is likely to be generated, which is not preferable. Although setting of the upper limit of the cooling rate is not necessary from viewpoint of controlling of the structure, the excessively high cooling rate possibly causes the cooling state of the steel sheet to be nonuniform. Further, a large amount of cost is required to manufacture the equipment that can provide such a high cooling rate, which leads to increase in prices of the steel sheet. In view of the facts described above, it is preferable to set the upper limit of the cooling rate to 100° C./sec.

The high-strength cold-rolled steel sheet according to this embodiment is produced by subjecting a steel sheet to hot rolling, coiling, pickling, and skin pass, then cold rolling the steel sheet, and applying annealing to the steel sheet. In the annealing processes, batch annealing, continuous annealing or other processes are applied, thereby obtaining the final cold-rolled steel sheet.

It is needless to say that the high-strength steel sheet according to this embodiment may be used as a steel sheet for electroplating. Application of electroplating does not change the mechanical properties of the high-strength steel sheet according to this embodiment.

EXAMPLES

Example 1

Next, Examples according to the present invention along with Comparative Examples will be described.

Molten steels having chemical components shown in Table 1 and Table 2 were produced through a converter and RH processes. At this time, in the case where the molten steels were not subjected to a desulfurization process in the secondary refinement, S was set in the range of 0.003 mass % to 0.011 mass %. In the case where the molten steels were subjected to the desulfurization process, S was set so as to satisfy S≤20 ppm.

Si was added to adjust components as shown in Table 1 and Table 2. After approximately 3 minutes to 5 minutes elapsed from the addition of Si, Al was added to perform Al deoxidation, and then, rising time in the range of approximately 3 minutes to 6 minutes was set so as to allow $Al_2O_3$ to rise to the surface and be separated.

Thereafter, depending on charges of experiments, at least one element of Ce, La, Nd, and Pr was added to adjust components so as to satisfy 70≥100×(Ce+La+Nd+Pr)/acid-soluble Al≥2, and (Ce+La+Nd+Pr)/S being in the range of 0.2 to 10 on the basis of mass.

Depending on charges of experiments in which selective elements were added, the selective elements were added before the addition of at least one element of Ce, La, Nd, and Pr, agitation was sufficiently performed, and the at least one element of Ce, La, Nd, and Pr was added. Depending on application, the at least one element of Ce, La, Nd, and Pr may be added after components of the selective element were adjusted. Then, agitation was sufficiently performed, and Ca was added. The thus obtained molten steel was subjected to continuous casting to produce an ingot.

For the continuous casting, a normal slab continuous-casting device with a thickness of approximately 250 mm was used.

The ingot subjected to the continuous casting was heated to temperatures in the range of over 1200° C. to 1250° C. under hot rolling conditions shown in Table 3.

Then, the ingot was subjected to rough rolling, and then to finishing rolling. Temperatures at the time of completion of the finishing rolling were set to be not less than Ar3 point+30° C. and not more than Ar3 point+200° C. In this specification, the Ar3 point was calculated using a normal expression obtained from each of the components.

The average cooling rate for the steel sheet after the finishing rolling was set in the range of 10° C./sec to 100° C./sec. Further, depending on charges of experiments, in the case where the coiling temperature was set in the range of 450° C. to 650° C., the steel sheet was air cooled at approximately 5° C./sec until the temperature reaches 680° C. after the finishing rolling, and was cooled thereafter at a cooling rate of 30° C./sec or more.

With the cooling being applied as described above, it was possible to obtain a steel sheet having one or more structures of polygonal ferrite, bainitic ferrite, and a bainite phase.

On the other hand, depending on charges of experiments, coiling was performed at 400° C. or less, and it was possible to obtain a DP steel sheet having a compound structure of a polygonal ferrite phase and a martensite phase.

A high-strength cold-rolled steel sheet was obtained, by subjecting the steel sheet to processes such as hot rolling, coiling, pickling, and skin pass to cold roll the hot-rolled steel sheet, and applying continuous annealing to form a cold-rolled steel sheet. Further, to obtain a steel sheet for electroplating, the steel sheet for electroplating was formed in an electro-plate line or hot-dip zinc plating line.

Table 1 and Table 2 show chemical components of the slab.

Table 3 shows conditions for hot rolling. Under the conditions, a hot-rolled plate with a thickness of 3.2 mm was obtained.

TABLE 1

(mass %)

| | Steel number | C | Si | Mn | P | S | T.O | N | Acid-soluble Al |
|---|---|---|---|---|---|---|---|---|---|
| Example A1 | A1 | 0.10 | 1.0 | 1.1 | 0.015 | 0.0050 | 0.0020 | 0.0020 | 0.015 |
| Comp. Ex A1 | A2 | 0.10 | 1.0 | 1.1 | 0.015 | 0.0050 | 0.0020 | 0.0020 | 0.015 |
| Example A2 | A3 | 0.25 | 1.8 | 2.2 | 0.010 | 0.0025 | 0.0015 | 0.0050 | 0.040 |
| Comp. Ex A2 | A4 | 0.25 | 1.8 | 2.2 | 0.010 | 0.0025 | 0.0015 | 0.0050 | 0.040 |
| Example A3 | A5 | 0.10 | 1.0 | 2.2 | 0.020 | 0.0005 | 0.0025 | 0.0040 | 0.025 |
| Comp. Ex A3 | A6 | 0.10 | 1.0 | 2.2 | 0.020 | 0.0005 | 0.0025 | 0.0040 | 0.025 |
| Example A4 | A7 | 0.10 | 1.0 | 2.2 | 0.020 | 0.0001 | 0.0025 | 0.0040 | 0.025 |
| Comp. Ex A4 | A8 | 0.10 | 1.0 | 2.2 | 0.020 | 0.0001 | 0.0025 | 0.0040 | 0.025 |
| Example A5 | A9 | 0.10 | 0.50 | 2.6 | 0.005 | 0.0060 | 0.0025 | 0.0030 | 0.020 |
| Comp. Ex A5 | A10 | 0.10 | 0.50 | 2.6 | 0.005 | 0.0060 | 0.0025 | 0.0030 | 0.020 |
| Example A6 | A11 | 0.04 | 0.90 | 1.3 | 0.050 | 0.0100 | 0.0050 | 0.0050 | 0.010 |
| Comp. Ex A6 | A12 | 0.04 | 0.90 | 1.3 | 0.050 | 0.0100 | 0.0050 | 0.0050 | 0.010 |
| Example A7 | A13 | 0.10 | 0.10 | 0.95 | 0.023 | 0.0050 | 0.0020 | 0.0025 | 0.040 |
| Comp. Ex A7 | A14 | 0.10 | 0.10 | 0.95 | 0.023 | 0.0110 | 0.0020 | 0.0025 | 0.040 |
| Example A8 | A15 | 0.04 | 0.10 | 1.45 | 0.018 | 0.0030 | 0.0035 | 0.0025 | 0.400 |
| Comp. Ex A8 | A16 | 0.04 | 0.10 | 1.45 | 0.018 | 0.0030 | 0.0035 | 0.0025 | 0.400 |
| Example A9 | A17 | 0.07 | 1.3 | 1.38 | 0.016 | 0.0040 | 0.0018 | 0.0021 | 0.042 |
| Comp. Ex A9 | A18 | 0.07 | 1.3 | 1.38 | 0.016 | 0.0040 | 0.0018 | 0.0021 | 0.042 |
| Example A10 | A19 | 0.25 | 1.8 | 2.2 | 0.010 | 0.0025 | 0.0015 | 0.0050 | 0.040 |
| Comp. Ex A10 | A20 | 0.25 | 1.8 | 2.2 | 0.010 | 0.0025 | 0.0052 | 0.0050 | 0.040 |
| Example A11 | A21 | 0.10 | 1.0 | 2.2 | 0.045 | 0.0060 | 0.0045 | 0.0030 | 0.025 |
| Comp. Ex A11 | A22 | 0.10 | 1.0 | 2.2 | 0.045 | 0.0060 | 0.0045 | 0.0030 | 0.025 |
| Example A12 | A23 | 0.10 | 1.0 | 2.2 | 0.045 | 0.0060 | 0.0045 | 0.0030 | 0.025 |
| Comp. Ex A12 | A24 | 0.10 | 1.0 | 2.2 | 0.045 | 0.0060 | 0.0045 | 0.0030 | 0.025 |
| Example A13 | A25 | 0.10 | 0.50 | 2.6 | 0.015 | 0.0090 | 0.0010 | 0.0030 | 0.015 |
| Comp. Ex A13 | A26 | 0.10 | 0.50 | 2.6 | 0.015 | 0.0009 | 0.0010 | 0.0030 | 0.015 |
| Example A14 | A27 | 0.10 | 0.50 | 2.6 | 0.010 | 0.0030 | 0.0045 | 0.0030 | 0.020 |
| Comp. Ex A14 | A28 | 0.10 | 0.50 | 2.6 | 0.010 | 0.0030 | 0.0045 | 0.0030 | 0.020 |
| Example A15 | A29 | 0.25 | 1.8 | 2.2 | 0.010 | 0.0050 | 0.0020 | 0.0050 | 0.025 |
| Comp. Ex A15 | A30 | 0.25 | 1.8 | 2.2 | 0.010 | 0.0050 | 0.0020 | 0.0050 | 0.025 |
| Example A16 | A31 | 0.04 | 0.90 | 1.3 | 0.010 | 0.0040 | 0.0020 | 0.0030 | 0.040 |
| Comp. Ex A16 | A32 | 0.04 | 0.90 | 1.3 | 0.010 | 0.0040 | 0.0020 | 0.0030 | 0.040 |
| Example A17 | A33 | 0.06 | 0.69 | 1.38 | 0.010 | 0.0005 | 0.0035 | 0.0020 | 0.026 |
| Comp. Ex A17 | A34 | 0.06 | 0.69 | 1.38 | 0.010 | 0.0005 | 0.0035 | 0.0020 | 0.026 |
| Example A18 | A35 | 0.06 | 0.69 | 1.38 | 0.010 | 0.0020 | 0.0020 | 0.0020 | 0.026 |
| Comp. Ex A18 | A36 | 0.06 | 0.69 | 1.38 | 0.010 | 0.0020 | 0.0020 | 0.0020 | 0.015 |
| Example A19 | A37 | 0.06 | 0.20 | 1.5 | 0.015 | 0.0100 | 0.0045 | 0.0022 | 0.015 |
| Comp. Ex A19 | A38 | 0.06 | 0.20 | 1.5 | 0.015 | 0.0100 | 0.0045 | 0.0022 | 0.015 |

TABLE 2

(mass %)

| | Steel number | Cr | Nb | V | Cu | Ni | Mo | Zr | B | Ca | Ce | La | Nd | Pr | 100 × (Ce + La + Nd + Pr)/ Acid soluble Al | (Ce + La + Nd + Pr)/S |
|---|---|---|---|---|---|---|---|---|---|---|---|---|---|---|---|---|
| Example A1 | A1 | | | | | | | | | 0.0025 | 0.0020 | 0.0010 | 0.0005 | 0.0005 | 26.7 | 0.8 |
| Comp. Ex A1 | A2 | | | | | | | | | 0.0025 | 0.0005 | 0.0003 | | | 5.3 | 0.16 |
| Example A2 | A3 | | | | | | | | | 0.0025 | 0.0020 | 0.0010 | 0.0005 | 0.0005 | 10.0 | 1.6 |
| Comp. Ex A2 | A4 | | | | | | | | | 0.0025 | 0.0003 | 0.0001 | | | 1.0 | 0.16 |
| Example A3 | A5 | | | | | | | | | 0.0010 | 0.0015 | 0.0008 | | | 9.2 | 4.6 |
| Comp. Ex A3 | A6 | | | | | | | | | 0.0055 | 0.0015 | 0.0008 | | | 9.2 | 4.6 |
| Example A4 | A7 | | | | | | | | | 0.0008 | 0.0007 | 0.0003 | | | 4.0 | 10 |
| Comp. Ex A4 | A8 | | | | | | | | | 0.0055 | 0.0007 | 0.0003 | | | 4.0 | 10 |
| Example A5 | A9 | | | | | | | | | 0.0040 | 0.0020 | 0.0010 | 0.0005 | 0.0005 | 20.0 | 0.67 |
| Comp. Ex A5 | A10 | | | | | | | | | 0.0040 | 0.0006 | 0.0005 | | | 5.5 | 0.18 |
| Example A6 | A11 | | | | | | | | | 0.0050 | 0.0040 | 0.0016 | 0.0008 | 0.0005 | 69.0 | 0.69 |
| Comp. Ex A6 | A12 | | | | | | | | | 0.0050 | 0.0045 | 0.0030 | | | 75.0 | 0.75 |
| Example A7 | A13 | | | | | | | | | 0.0020 | 0.0020 | 0.0010 | 0.0005 | 0.0005 | 10.0 | 0.8 |
| Comp. Ex A7 | A14 | | | | | | | | | 0.0020 | 0.0010 | 0.0005 | 0.0003 | 0.0003 | 5.3 | 0.19 |
| Example A8 | A15 | | 0.020 | 0.010 | 0.1 | 0.05 | | | | 0.0023 | 0.0020 | 0.0010 | 0.0005 | 0.0005 | 1.0 | 1.3 |
| Comp. Ex A8 | A16 | | 0.020 | 0.010 | 0.1 | 0.05 | | | | 0.0023 | 0.0005 | 0.0002 | | | 0.18 | 0.23 |
| Example A9 | A17 | | | | | | | | | 0.0022 | 0.0020 | 0.0010 | 0.0005 | 0.0005 | 9.5 | 1.0 |
| Comp. Ex A9 | A18 | | | | | | | | | 0.0022 | 0.0007 | | | | 1.7 | 0.18 |
| Example A10 | A19 | | | | | | | | | 0.0010 | 0.0025 | 0.0010 | | | 8.8 | 1.4 |
| Comp. Ex A10 | A20 | | | | | | | | | 0.0010 | 0.0035 | | | | 8.8 | 1.4 |
| Example A11 | A21 | 0.03 | 0.03 | 0.02 | 1.5 | 1 | 0.15 | 0.005 | 0.002 | 0.0015 | 0.0022 | 0.0010 | 0.0005 | 0.0005 | 16.8 | 0.70 |
| Comp. Ex A11 | A22 | 0.03 | 0.03 | 0.02 | 1.5 | 1 | 0.16 | 0.005 | 0.002 | 0.0004 | 0.0022 | 0.0010 | 0.0005 | 0.0005 | 16.8 | 0.70 |
| Example A12 | A23 | 0.03 | 0.03 | 0.10 | 0.8 | 0.07 | 0.15 | 0.005 | 0.002 | 0.0015 | 0.0060 | 0.0035 | | | 38.0 | 1.58 |
| Comp. Ex A12 | A24 | 0.03 | 0.03 | 0.10 | 0.8 | 0.07 | 0.15 | 0.005 | 0.002 | 0.0015 | 0.0060 | 0.0035 | 0.0005 | 0.0005 | 42.0 | 1.75 |
| Example A13 | A25 | 1 | 0.04 | | | | | | 0.005 | 0.0020 | 0.0060 | 0.0035 | 0.0003 | 0.0002 | 66.7 | 1.1 |
| Comp. Ex A13 | A26 | 1 | 0.04 | | | | | | 0.005 | 0.0020 | 0.0060 | 0.0035 | 0.0003 | 0.0002 | 66.7 | 11 |
| Example A14 | A27 | 0.6 | 0.04 | | | | | | 0.003 | 0.0010 | 0.0050 | | | | 25.0 | 1.7 |
| Comp. Ex A14 | A28 | 0.6 | 0.04 | | | | | | 0.003 | 0.0004 | 0.0050 | | | | 25.0 | 1.7 |
| Example A15 | A29 | | | | | | | | | 0.0015 | | 0.0050 | | | 20.0 | 1.0 |
| Comp. Ex A15 | A30 | | | | | | | | | 0.0060 | | 0.0050 | | | 20.0 | 1.0 |
| Example A16 | A31 | | 0.04 | | | | | | | 0.0010 | | | 0.0050 | | 12.5 | 1.3 |
| Comp. Ex A16 | A32 | | 0.04 | | | | | | | 0.0010 | | | 0.0005 | | 1.3 | 0.13 |
| Example A17 | A33 | 0.03 | | | | | | | | 0.0010 | | | | 0.0050 | 19.2 | 10.0 |
| Comp. Ex A17 | A34 | 0.03 | | | | | | | | 0.0010 | | | | 0.0110 | 42.3 | 22.0 |
| Example A18 | A35 | | 0.02 | | | | | | | 0.0020 | | | 0.003 | 0.0020 | 19.2 | 2.5 |
| Comp. Ex A18 | A36 | | 0.02 | | | | | | | 0.0020 | | | 0.007 | 0.0040 | 73.3 | 5.5 |
| Example A19 | A37 | | | | | | | | | 0.0010 | 0.0030 | 0.0020 | | | 33.3 | 0.5 |
| Comp. Ex A19 | A38 | | | | | | | | | 0.0010 | 0.0070 | 0.0040 | | | 73.3 | 1.1 |

TABLE 3

| Condi-tion | Heating temperature (° C.) | Temperature at completion of finishing rolling (° C.) | Cooling rate after finishing rolling (° C./sec) | Coiling temperature (° C.) | Steel number to be applied |
|---|---|---|---|---|---|
| A | 1250 | 845 | 75 | 450 | (A5-A10), (A15, A16), (A21, A22), (A25, A26), (A35, A36) |
| B | 1250 | 860 | 30 | 400 | (A1-A4), (A13, A14), (A17-A20), (A23, A24), (A29, A30), (A30, A34) |
| C | 1250 | 825 | 45 | 450 | (A11, A12), (A27, A28), (A31, A32), (A37, A38) |

In Table 1 and Table 2, steel numbers A1, A3, A5, A7, A9, A11, A13, A15, A17, A19, A21, A23, A25, A27, A29, A31, A33, A35, and A37 are configured so as to have compositions that fall within the range of the high-strength steel sheet according to the present invention, whereas steel numbers A2, A4, A6, A8, A10, A12, A14, A16, A18, A20, A22, A24, A26, A28, A30, A32, A34, A36, and A38 are configured as slabs having, on the basis of mass, the ratio of (Ce+La+Nd+Pr)/acid-soluble Al, the ratio of (Ce+La+Nd+Pr)/S, and the concentrations of S, T.O, Ca, and Ce+La+Nd+Pr adjusted so as to fall outside the range of the high-strength steel sheet according to the present invention.

It should be noted that, for comparison purposes, in Table 1 and Table 2, steel number A1 and steel number A2, steel number A3 and steel number A4, steel number A5 and steel number A6, steel number A7 and steel number A8, steel number A9 and steel number A10, steel number A11 and steel number A12, steel number A13 and steel number A14, steel number A15 and steel number A16, steel number A17 and steel number A18, steel number A19 and steel number A20, steel number A21 and steel number A22, steel number A23 and steel number A24, steel number A25 and steel number A26, steel number A27 and steel number A28, steel number A29 and steel number A30, steel number A31 and steel number A32, steel number A33 and steel number A34, steel number A35 and steel number A36, and steel number A37 and steel number A38 are configured so as to have almost the same composition except that the compositions such as Ce+La are different.

Further, in Table 3, as condition A, a heating temperature was set to 1250° C., a temperature at the completion of finishing rolling was set to 845° C., a cooling rate after finishing rolling was set to 75° C./sec, and a coiling temperature was set to 450° C. As condition B, the heating temperature was set to 1250° C., the temperature at the completion of finishing rolling was set to 860° C., the steel sheet was air cooled at approximately 5° C./sec until the temperature reaches 680° C. after the finishing rolling, and was cooled thereafter at a cooling rate of 30° C./sec or more, and the coiling temperature was set to 400° C. As condition C, the heating temperature was set to 1250° C., the temperature at the completion of finishing rolling was set to 825° C., the cooling rate after the finishing rolling was set to 45° C./sec, and the coiling temperature was set to 450° C.

Condition B was applied to steel number A1 and steel number A2.

Condition B was applied to steel number A3 and steel number A4.

Condition A was applied to steel number A5 and steel number A6.

Condition A was applied to steel number A7 and steel number A8.

Condition A was applied to steel number A9 and steel number A10.

Condition C was applied to steel number A11 and steel number A12.

Condition B was applied to steel number A13 and steel number A14.

With these applications of conditions, the effects of chemical components can be compared under the same producing conditions.

The thus obtained steel sheets were examined in terms of basic characteristics including strength (MPa), ductility (%), stretch-flange formability (λ%), and limit bending radius (mm) for bending workability.

To obtain existence states of elongated inclusions in the steel sheets, examination was made on the number density per area of inclusions having a size of 2 μm or less, the ratio of number of inclusions having an elongated ratio of 3 or less, the number density per volume, and the average equivalent circle diameter (hereinafter, the average is referred to as an arithmetic mean) through observation using an optical microscope or observation using a SEM by targeting the observation at all the inclusions having a size of approximately 1 μm or more.

Further, to obtain existence states of non-elongated inclusions in the steel sheet, examination was made on the ratio of number of and the number density per volume of a compound inclusion having a formation having two or more inclusion phases containing different components and including a first group inclusion phase containing at least one element of Ce, La, Nd, and Pr, further containing Ca, and containing at least one of O and S, and a second group inclusion phase further containing at least one element of Mn, Si, and Al, and the average value of total amount of at least one element of Ce, La, Nd, and Pr contained in the inclusions having an elongated ratio of 3 or less, by targeting the observation at all the inclusions having a size of approximately 1 μm or more.

It should be noted that the reason that inclusions having a size of approximately 1 μm or more were targeted in the observation is because of easiness of the observation and also because the inclusions having a size of less than approximately 1 μm do not have any effect on the deterioration in the stretch-flange formability or bending workability.

Table 4 shows results of the examinations for each combination between steel and rolling condition.

TABLE 4

| | Steel number | Condition | Strength (MPa) | Elongation (%) | Ratio of number of compound inclusion of Ce, La, Nd, Pr, Si, Al, Ca, Mn, Ca, O, and S having equivalent circle diameter of 0.5 to 5.0 μm (%) | Ratio of number of inclusion having equivalent circle diameter of 1 μm or more and elongated ratio of 3 or less (%) | Average concentration of total of at least one element of Ce, La, Nd, and Pr in inclusion having equivalent circle diameter of 0.5 to 5 μm (%) | Average grain diameter of crystal in metal structure (μm) | Hole expanding value λ | Limit bending radius (mm) |
|---|---|---|---|---|---|---|---|---|---|---|
| Example A1 | A1 | B | 460 | 41 | 45 | 70 | 35 | 10 | 180 | 0.5 |
| Comp. Ex A1 | A2 | B | 460 | 41 | 3 | 3 | 0.15 | 15 | 70 | 2 |
| Example A2 | A3 | B | 1205 | 15 | 54 | 75 | 31 | 4 | 84 | 0.5 |
| Comp. Ex A2 | A4 | B | 1210 | 14 | 3 | 3 | 0.4 | 11 | 28 | 3.5 |
| Example A3 | A5 | A | 1000 | 17 | 66 | 75 | 27 | 8 | 90 | 0.5 |
| Comp. Ex A3 | A6 | A | 990 | 16 | 24 | 23 | 0.4 | 24 | 60 | 3 |
| Example A4 | A7 | A | 1000 | 17 | 70 | 77 | 29 | 8 | 92 | 0.5 |
| Comp. Ex A4 | A8 | A | 990 | 16 | 24 | 23 | 0.4 | 24 | 60 | 3 |
| Example A5 | A9 | A | 985 | 18 | 35 | 65 | 47 | 7 | 93 | 0.5 |
| Comp. Ex A5 | A10 | A | 990 | 17 | 3 | 2 | 0.2 | 21 | 62 | 2.5 |
| Example A6 | A11 | C | 800 | 24 | 57 | 73 | 35 | 8 | 146 | 0.5 |
| Comp. Ex A6 | A12 | C | 795 | 25 | 14 | 2 | 0.1 | 16 | 71 | 2.5 |
| Example A7 | A13 | B | 450 | 40 | 60 | 74 | 56 | 7 | 192 | 0.5 |
| Comp. Ex A7 | A14 | B | 450 | 40 | 2 | 2 | 0.2 | 17 | 72 | 3 |
| Example A8 | A15 | A | 605 | 26 | 34 | 64 | 15 | 10 | 173 | 0.5 |
| Comp. Ex A8 | A16 | A | 605 | 26 | 1 | 3 | 0.3 | 20 | 67 | 3 |
| Example A9 | A17 | B | 600 | 27 | 38 | 77 | 42 | 2 | 172 | 0.5 |
| Comp. Ex A9 | A18 | B | 600 | 27 | 4 | 28 | 0.2 | 11 | 74 | 3 |
| Example A10 | A19 | B | 1205 | 15 | 47 | 76 | 68 | 3 | 84 | 0.5 |

TABLE 4-continued

| | Steel number | Con-dition | Strength (MPa) | Elongation (%) | Ratio of number of compound inclusion of Ce, La, Nd, Pr, Si, Al, Ca, Mn, Ca, O, and S having equivalent circle diameter of 0.5 to 5.0 μm (%) | Ratio of number of inclusion having equivalent circle diameter of 1 μm or more and elongated ratio of 3 or less (%) | Average concentration of total of at least one element of Ce, La, Nd, and Pr in inclusion having equivalent circle diameter of 0.5 to 5 μm (%) | Average grain diameter of crystal in metal structure (μm) | Hole expanding value λ | Limit bending radius (mm) |
|---|---|---|---|---|---|---|---|---|---|---|
| Comp. Ex | A20 | B | 1210 | 14 | 12 | 1 | 0.4 | 16 | 27 | 3.5 |
| Example A11 | A21 | A | 1010 | 17 | 57 | 73 | 38 | 7 | 88 | 0.5 |
| Comp. Ex | A22 | A | 1000 | 16 | 21 | 8 | 0.3 | 12 | 31 | 4 |
| Example A12 | A23 | B | 1000 | 17 | 68 | 76 | 91 | 7 | 95 | 0.5 |
| Comp. Ex | A24 | B | 998 | 17 | 27 | 22 | 96 | 11 | 64 | 3 |
| Example A13 | A25 | A | 995 | 18 | 55 | 66 | 77 | 2 | 94 | 0.5 |
| Comp. Ex | A26 | A | 1000 | 17 | 24 | 24 | 97 | 12 | 57 | 2.5 |
| Example A14 | A27 | C | 990 | 17 | 68 | 76 | 88 | 4 | 96 | 0.5 |
| Comp. Ex | A28 | C | 990 | 17 | 4 | 26 | 96 | 15 | 45 | 3 |
| Example A15 | A29 | B | 800 | 25 | 55 | 75 | 54 | 3 | 141 | 0.5 |
| Comp. Ex | A30 | B | 805 | 24 | 10 | 17 | 0.3 | 12 | 92 | 2.5 |
| Example A16 | A31 | C | 805 | 24 | 47 | 63 | 91 | 8 | 146 | 0.5 |
| Comp. Ex | A32 | C | 800 | 25 | 1 | 3 | 0.14 | 16 | 56 | 2.5 |
| Example A17 | A33 | B | 605 | 27 | 37 | 67 | 67 | 3 | 174 | 0.5 |
| Comp. Ex | A34 | B | 605 | 27 | 25 | 25 | 97 | 11 | 103 | 2 |
| Example A18 | A35 | A | 605 | 25 | 36 | 66 | 71 | 4 | 155 | 0.5 |
| Comp. Ex | A36 | A | 605 | 25 | 24 | 23 | 98 | 14 | 87 | 2 |
| Example A19 | A37 | C | 497 | 22 | 45 | 67 | 78 | 7 | 175 | 0.5 |
| Comp. Ex | A38 | C | 495 | 19 | 21 | 13 | 96 | 17 | 86 | 2 |

The strength and the ductility were obtained through a tensile test with Japanese Industrial Standards (JIS) No. 5 test piece taken from the steel sheet in a direction parallel to the rolling direction. The stretch-flange formability was evaluated such that a punched hole having a diameter of 10 mm and opened at the center of a steel sheet with 150 mm×150 mm was pressed and expanded with a conical punch having an angle of 60°, a hole diameter D (mm) was measured at the time when a through-thickness crack occurred, and a hole-expanding value λ was obtained from $\lambda=(D-10)/10$, thereby evaluating the stretch-flange formability with the hole-expanding value 2. The limit bending radius (mm) used as an index indicating the bending workability was obtained by taking a bending test piece, and carrying out a V-bending test using a die unit equipped with a die and a punch. The die used has a recessed portion with a V-shaped cross section and an angle of aperture of 60°. The punch used has an elevated portion that matches the recessed portion of the die. Various punches were prepared in which bending radii of a needle portion at a top end portion were varied in 0.5-mm steps, and were subjected to bending tests to obtain the minimum radius of curvature of the needle portion at the top end portion of the punch at which a crack occurs at a bent portion of the subjected test piece. This minimum radius of curvature was evaluated as the limit bending radius.

It should be noted that the test piece used was a No. 1 test piece specified in JIS, which was obtained by equally cutting both sides of a raw sheet (hot rolled sheet) and had a parallel portion of 25 mm, a radius of curvature R of 100 mm, and a thickness of 3.0 mm.

As for inclusions, the major axis and the minor axis of 50 inclusions having an equivalent circle diameter of 1 μm or more and randomly selected were measured through SEM observation. Further, with a quantitative analysis function of the SEM, composition analysis was performed for the randomly selected 50 inclusions having the equivalent circle diameter of 1 μm or more. These measurement results were used to obtain the ratio of number of inclusions having an elongated ratio of 3 or less, the average equivalent circle diameter of the inclusions having the elongated ratio of 3 or less, the ratio of number of compound inclusions, and the average value of the total of at least one element of Ce, La, Nd, and Pr in the inclusions having the elongated ratio of 3 or less. Further, the number density of inclusions per volume was calculated for each formation with SEM evaluation on electrolyzed surfaces using the speed method.

As can be clearly understood from Table 3, with steel numbers A1, A3, A5, A7, A9, A11, A13 and other odd steel numbers to which the method according to the present invention was applied, it was possible to reduce the number of the elongated MnS-based inclusions in the steel sheet by generating the compound inclusion specified in the present invention. In other words, fine spherical compound inclusions having the equivalent circle diameter in the range of 0.5 μm to 5 μm existed in the steel sheet, and components of these compound inclusions were formed by inclusion phases containing two or more inclusion phases having different components and selected from among the first group inclusion phase of [Ce, La, Nd, Pr]—Ca—[O, S] and the second group inclusion phase of [Ce, La, Nd, Pr]—Ca—[O, S]—[Mn, Si, Al], which are specified in the present invention. Further, the ratio of the number of the spherical compound inclusions having the equivalent circle diameter in the range of 0.5 μm to 5 μm relative to the number of all the inclusions having the equivalent circle diameter in the range of 0.5 μm to 5 μm was 30% or more. The ratio number of elongated inclusions existing in the steel sheet and having the equivalent circle diameter of 1 μm or more and the major axis/ minor axis of 3 or less relative to the number of all the inclusions having the equivalent circle diameter of 1 μm or more was 50% or more. The average content percentage of the total of at least one element of Ce, La, Nd, and Pr in the inclusions was in the range of 0.5% to 95%. Note that, in any structures of the steel sheets, the average crystal grain diameter fell within the range of 1 μm to 8 μm, and were almost equal between the present invention and Comparative Examples.

added after addition of Ce from among Ce, La, Nd, and Pr. In Comparative Example A20, Ce is added after addition of Ca, and in this case, inclusions had a formation in which MnS and oxide or oxysulfide formed by Ce were precipitated in CaS. Unlike the inclusions according to the present invention containing two or more inclusion phases having different components, in this case, the inclusions had a composition in which the elongation ratio of the inclusions was high and the hole-expanding ratio reduced as compared with Example according to the present invention.

TABLE 5

(mass %)

| | Steel number | C | Si | Mn | P | S | N | T.O | Acid-soluble Al | Ca | Ce | 100 × Ce/ Acid-soluble Al | Ce/S |
|---|---|---|---|---|---|---|---|---|---|---|---|---|---|
| Example A20 | A39 | 0.03 | 0.39 | 0.8 | 0.020 | 0.0025 | 0.0025 | 0.002 | 0.024 | 0.001 | 0.0040 | 16.7 | 1.6 |
| Comp. Ex A20 | A40 | 0.05 | 0.4 | 0.6 | 0.020 | 0.0025 | 0.0024 | 0.002 | 0.025 | 0.001 | 0.0040 | 16.0 | 1.6 |

TABLE 6

| | Steel number | Condition | Strength (MPa) | Elongation (%) | Ratio of number of compound inclusion of Ce, La, Nd, Pr, Si, Al, Ca, Mn, Ca, O, and S having equivalent circle diameter of 0.5 to 5 μm (%) | Ratio of number of inclusion having equivalent circle diameter of 1 μm or more and elongated ratio of 3 or less (%) | Average concentration of total of at least one element of Ce, La, Nd and Pr in inclusion having equivalent circle diameter of 0.5 to 5 μm (%) | Average grain diameter of crystal in metal structure (μm) | Hole expanding value λ | Limit bending radius (mm) |
|---|---|---|---|---|---|---|---|---|---|---|
| Example A20 | 39A | B | 451 | 35 | 68 | 95 | 88 | 7 | 170 | 0.5 |
| Comp. Ex A20 | 40A | B | 450 | 35 | 23 | 76 | 86 | 8 | 140 | 2 |

As a result, the steel sheets of steel numbers A1, A3, A5, A7, A9, A11, A13 and other odd steel numbers, which are steels according to the present invention, exhibited excellent stretch-flange formability and bending workability as compared with comparative steels. On the other hand, as for comparative steels (steel numbers A2, A4, A6, A8, A10, A12, A14 and other even steel numbers), the average crystal grain diameter exceeded 10 μm, there were formed elongated inclusions that little contained Ce, La, Nd, or Pr and had major axis/minor axis of 3 or more, in other words, elongated MnS-based inclusions, and inclusions distributed in a state different from that specified in the present invention. As a result, the MnS-based inclusions elongated during working of the steel sheets served as the starting point of the occurrence of cracking, which led to a deterioration in the stretch-flange formability and the bending workability.

Table 5 and Table 6 show comparison results of the inclusion composition and the hole-expanding ratio between Example A20 according to the present invention and Comparative Example A20, the order of addition of Ca and at least one element of Ce, La, Nd, and Pr being changed between Example A20 and Comparative Example A20. In Example A20 according to the present invention, Ca was Table 7 and Table 8 show results of the composition of inclusions and the hole-expanding ratio of Comparative Example A21 that did not have Ca added after addition of two elements of Ce and La in comparison with Example A21 according to the present invention (Ca is added after addition of two elements of Ce and La). In the case where Ca is not added after addition of two elements of Ce and La, an immersion nozzle in a continuous casting equipment clogged during casting, not all the molten steel in the ladle were not able to be completely casted, and casting could not be performed with the latter ladle, causing production troubles. Although products could be obtained by applying processes after hot rolling to slabs being processed but not completed, the inclusions in the products had MnS precipitated in oxide or oxysulfides formed by two elements of Ce and La, and unlike the inclusions according to the present invention containing two or more inclusion phases having different components, the inclusions in the above-described products had a composition in which the elongation ratio of the inclusions was high and the hole-expanding ratio reduced as compared with Example A21 according to the present invention.

TABLE 7

(mass %)

| | Steel number | C | Si | Mn | P | S | N | T.O | Acid-soluble Al | Ca | Cu | Ni | Ce | La | 100 × (Ce + La + Nd + Pr)/ Acid-soluble Al | (Ce + La + Nd + Pr)/S |
|---|---|---|---|---|---|---|---|---|---|---|---|---|---|---|---|---|
| Example A21 | A41 | 0.10 | 1.0 | 1.1 | 0.015 | 0.0050 | 0.0020 | 0.0040 | 0.05 | 0.0025 | 0.0020 | 0.0010 | 0.0050 | 0.0040 | 0.18 | 1.8 |
| Comp. Ex A21 | A42 | 0.11 | 0.9 | 0.2 | 0.015 | 0.0050 | 0.0020 | 0.0043 | 0.05 | — | 0.0020 | 0.0010 | 0.0050 | 0.0040 | 0.18 | 1.6 |

TABLE 8

| | Steel number | Condition | Strength (MPa) | Elongation (%) | Ratio of number of compound inclusion of Ce, La, Nd, Pr, Si, Al, Ca, Mn, Ca, O, S having equivalent circle diameter of 0.5 to 5 μm (%) | Ratio of number of inclusion having equivalent circle diameter of 1 μm or more and elongated ratio of 3 or less (%) | Average concentration of total of at least one element of Ce, La, Nd and Pr in inclusion having equivalent circle diameter of 0.5 to 5 μm (%) | Average grain diameter of crystal in metal structure (μm) | Hole expanding value λ | Limit bending radius (mm) |
|---|---|---|---|---|---|---|---|---|---|---|
| Example A21 | A41 | B | 460 | 41 | 51 | 93 | 52 | 10 | 180 | 0.5 |
| Comp. Ex A21 | A42 | B | 460 | 40 | 2 | 7 | 0.4 | 16 | 80 | 5 |

Example 2

Next, Examples according to the present invention along with Comparative Examples will be described.

Molten steels having chemical components shown in Table 9 and Table 10 were produced through a converter and RH processes. At this time, in the case where the molten steels were not subjected to a desulfurization process in the secondary refinement, S was set in the range of 0.003 mass % to 0.011 mass %. In the case where the molten steels were subjected to the desulfurization process, S was set so as to satisfy S≤20 ppm.

Si was added to adjust components as shown in Table 9 and Table 10. After approximately 3 minutes to 5 minutes elapsed from the addition of Si, Al was added to perform Al deoxidation, and then, rising time in the range of approximately 3 minutes to 6 minutes was set so as to allow $Al_2O_3$ to rise to the surface and be separated. Then, Ti was added.

Thereafter, depending on charges of experiments, at least one element of Ce, La, Nd, and Pr was added to adjust components so as to satisfy 70≥100×(Ce+La+Nd+Pr)/acid-soluble Al≥2, and (Ce+La+Nd+Pr)/S being in the range of 0.2 to 10 on the basis of mass.

Depending on charges of experiments in which selective elements were added, the selective elements were added before the addition of at least one element of Ce, La, Nd, and Pr, agitation was sufficiently performed, and the at least one element of Ce, La, Nd, and Pr was added. Depending on application, the at least one element of Ce, La, Nd, and Pr may be added after components of the selective element were adjusted.

Then, agitation was sufficiently performed, and Ca was added. The thus obtained molten steel was subjected to continuous casting to produce an ingot. For the continuous casting, a normal slab continuous-casting device with a thickness of approximately 250 mm was used. The ingot subjected to the continuous casting was heated to temperatures in the range of over 1200° C. to 1250° C. under hot rolling conditions shown in Table 11. Then, the ingot was subjected to rough rolling, and then to finishing rolling. Temperatures at the time of completion of the finishing rolling were set to be not less than Ar3 point+30° C. and not more than Ar3 point+200° C. In this specification, the Ar3 point was calculated using a normal expression obtained from each of the components.

The average cooling rate for the steel sheet after the finishing rolling was set in the range of 10° C./sec to 100° C./sec. Further, depending on charges of experiments, in the case where the coiling temperature was set to temperatures in the range of 450° C. to 650° C., the steel sheet was air cooled at approximately 5° C./sec until the temperature reaches 680° C. after the finishing rolling, and was cooled thereafter at a cooling rate of 30° C./sec or more.

With the cooling described above, it was possible to obtain a steel sheet having one or more structures of polygonal ferrite, bainitic ferrite, and a bainite phase.

Depending on charges of experiments, coiling was performed at 400° C. or less, and it was possible to obtain a DP steel sheet having a compound structure of a polygonal ferrite phase and a martensite phase.

A high-strength cold-rolled steel sheet was obtained, by subjecting the steel sheet to processes such as hot rolling, coiling, pickling, and skin pass to cold roll the hot-rolled steel sheet, and applying continuous annealing to form a cold-rolled steel sheet. Further, to obtain a steel sheet for electroplating, the steel sheet for electroplating was formed in an electro-plate line or hot-dip zinc plating line.

Slabs having chemical components shown in Table 9 and Table 10 were subjected to hot rolling under conditions shown in Table 11 to form a hot-rolled sheet having a thickness of 3.2 mm.

TABLE 9

(mass %)

| | Steel number | C | Si | Mn | P | S | T.O | N | Acid-soluble Al | Acid-soluble Ti |
|---|---|---|---|---|---|---|---|---|---|---|
| Example B1 | B1 | 0.06 | 0.7 | 1.38 | 0.01 | 0.0040 | 0.0020 | 0.0020 | 0.028 | 0.026 |
| Comp. Ex B1 | B2 | 0.06 | 0.7 | 1.38 | 0.01 | 0.0040 | 0.0020 | 0.0021 | 0.028 | 0.026 |
| Example B2 | B3 | 0.06 | 0.7 | 1.38 | 0.010 | 0.0005 | 0.0015 | 0.0020 | 0.028 | 0.025 |
| Comp. Ex B2 | B4 | 0.06 | 0.7 | 1.38 | 0.010 | 0.0005 | 0.0015 | 0.0021 | 0.028 | 0.025 |
| Example B3 | B5 | 0.06 | 0.7 | 1.38 | 0.010 | 0.0001 | 0.0015 | 0.0020 | 0.028 | 0.025 |
| Comp. Ex B3 | B6 | 0.06 | 0.7 | 1.38 | 0.010 | 0.0001 | 0.0015 | 0.0021 | 0.028 | 0.025 |
| Example B4 | B7 | 0.04 | 0.03 | 1.35 | 0.015 | 0.0025 | 0.0010 | 0.0024 | 0.300 | 0.056 |
| Comp. Ex B4 | B8 | 0.04 | 0.03 | 1.35 | 0.015 | 0.0025 | 0.0010 | 0.0024 | 0.300 | 0.056 |
| Example B5 | B9 | 0.06 | 0.2 | 1.5 | 0.015 | 0.0100 | 0.0025 | 0.0022 | 0.033 | 0.020 |
| Comp. Ex B5 | B10 | 0.06 | 0.2 | 1.5 | 0.015 | 0.0100 | 0.0025 | 0.0023 | 0.032 | 0.020 |
| Example B6 | B11 | 0.06 | 0.68 | 1.38 | 0.010 | 0.0040 | 0.0025 | 0.0020 | 0.014 | 0.026 |
| Comp. Ex B6 | B12 | 0.06 | 0.69 | 1.38 | 0.010 | 0.0040 | 0.0025 | 0.0021 | 0.014 | 0.026 |
| Example B7 | B13 | 0.04 | 0.95 | 1.3 | 0.010 | 0.0020 | 0.0015 | 0.0020 | 0.028 | 0.13 |
| Comp. Ex B7 | B14 | 0.04 | 0.95 | 1.3 | 0.010 | 0.0020 | 0.0015 | 0.0020 | 0.028 | 0.13 |
| Example B8 | B15 | 0.06 | 0.68 | 1.38 | 0.010 | 0.0010 | 0.0050 | 0.0020 | 0.020 | 0.025 |
| Comp. Ex B8 | B16 | 0.06 | 0.69 | 1.38 | 0.010 | 0.0010 | 0.0050 | 0.0021 | 0.013 | 0.025 |
| Example B9 | B17 | 0.06 | 0.20 | 1.50 | 0.015 | 0.0100 | 0.0020 | 0.0022 | 0.033 | 0.020 |
| Comp. Ex B9 | B18 | 0.06 | 0.20 | 1.50 | 0.015 | 0.0150 | 0.0020 | 0.0023 | 0.032 | 0.020 |
| Example B10 | B19 | 0.06 | 0.15 | 1.95 | 0.015 | 0.0020 | 0.0015 | 0.0020 | 0.011 | 0.080 |
| Comp. Ex B10 | B20 | 0.06 | 0.15 | 1.95 | 0.015 | 0.0020 | 0.0015 | 0.0020 | 0.011 | 0.080 |
| Example B11 | B21 | 0.1 | 0.25 | 2.00 | 0.010 | 0.0030 | 0.0035 | 0.0020 | 0.030 | 0.020 |
| Comp. Ex B11 | B22 | 0.1 | 0.25 | 2.00 | 0.010 | 0.0030 | 0.0035 | 0.0021 | 0.030 | 0.020 |
| Example B12 | B23 | 0.1 | 0.6 | 2.2 | 0.010 | 0.0030 | 0.0030 | 0.0035 | 0.025 | 0.020 |
| Comp. Ex B12 | B24 | 0.1 | 0.6 | 2.2 | 0.010 | 0.0030 | 0.0030 | 0.0035 | 0.025 | 0.020 |

TABLE 10

(mass %)

| | Steel number | Cr | Nb | V | Cu | Ni | Mo | Zr | B | Ca | Ce | La | Nd | Pr | 100 × (Ce + La + Nd + Pr)/ Acid-soluble Al | (Ce + La + Nd + Pr)/S |
|---|---|---|---|---|---|---|---|---|---|---|---|---|---|---|---|---|
| Example B1 | B1 | | | | | | | | | 0.0022 | 0.0020 | 0.0010 | 0.0005 | 0.0005 | 14.3 | 1 |
| Comp. Ex B1 | B2 | | | | | | | | | 0.0022 | 0.0007 | | | | 2.5 | 0.18 |
| Example B2 | B3 | | | | | | | | | 0.0010 | 0.0025 | 0.0010 | | | 12.5 | 7 |
| Comp. Ex B2 | B4 | | | | | | | | | 0.0010 | 0.0040 | 0.0020 | | | 21.4 | 12.0 |
| Example B3 | B5 | | | | | | | | | 0.0008 | 0.0007 | 0.0003 | | | 3.6 | 10.0 |
| Comp. Ex B3 | B6 | | | | | | | | | 0.0055 | 0.0007 | 0.0003 | | | 3.6 | 10.0 |
| Example B4 | B7 | | 0.008 | | | | | | | 0.0010 | 0.0020 | 0.0010 | | | 1.0 | 1.2 |
| Comp. Ex B4 | B8 | | 0.008 | | | | | | | 0.0010 | 0.0005 | | | | 0.17 | 0.20 |
| Example B5 | B9 | | | | | | | | | 0.0015 | 0.0022 | 0.0010 | 0.0005 | 0.0005 | 12.7 | 0.42 |
| Comp. Ex B5 | B10 | | | | | | | | | 0.0003 | 0.0022 | 0.0010 | 0.0005 | 0.0005 | 13.1 | 0.42 |
| Example B6 | B11 | | 0.02 | 0.09 | 0.1 | 0.05 | | | | 0.0015 | 0.0060 | 0.0035 | | | 67.9 | 2.38 |
| Comp. Ex B6 | B12 | | 0.02 | 0.09 | 0.1 | 0.05 | | | | 0.0015 | 0.0060 | 0.0035 | 0.0005 | 0.0005 | 75.0 | 2.63 |
| Example B7 | B13 | | 0.04 | | | | | | | 0.0020 | 0.0022 | 0.0010 | 0.0005 | 0.0005 | 15.0 | 2.1 |
| Comp. Ex B7 | B14 | | 0.04 | | | | | | | 0.0004 | 0.0022 | 0.0010 | 0.0005 | 0.0005 | 15.0 | 2.1 |
| Example B8 | B15 | 0.03 | | | | | | | | 0.0020 | 0.0060 | 0.0035 | 0.0003 | 0.0002 | 50.0 | 10.0 |
| Comp. Ex B8 | B16 | 0.03 | | | | | | | | 0.0020 | 0.0060 | 0.0035 | 0.0003 | 0.0002 | 76.9 | 10.0 |
| Example B9 | B17 | | | | 0.2 | 0.1 | | | | 0.0010 | 0.0025 | | | | 7.6 | 0.3 |
| Comp. Ex B9 | B18 | | | | 0.2 | 0.1 | | | | 0.0010 | 0.0025 | | | | 7.8 | 0.17 |
| Example B10 | B19 | | 0.040 | | | | | | | 0.0020 | 0.0020 | 0.0010 | | | 27.3 | 1.5 |
| Comp. Ex B10 | B20 | | 0.040 | | | | | | | 0.0020 | 0.0060 | 0.0035 | | | 86.4 | 4.8 |
| Example B11 | B21 | 0.03 | 0.030 | 0.020 | 1.5 | 1 | 0.15 | 0.005 | 0.002 | 0.0015 | | 0.0050 | | | 16.7 | 1.7 |
| Comp. Ex B11 | B22 | 0.03 | 0.030 | 0.020 | 1.5 | 1 | 0.15 | 0.005 | 0.002 | 0.0015 | | 0.0005 | | | 1.7 | 0.17 |
| Example B12 | B23 | 1 | 0.04 | | 0.8 | 0.07 | | | 0.005 | 0.0020 | 0.0015 | 0.0008 | 0.0004 | 0.0003 | 12.0 | 1.0 |
| Comp. Ex B12 | B24 | 1 | 0.04 | | 0.8 | 0.07 | | | 0.005 | 0.0002 | 0.0015 | 0.0008 | 0.0004 | 0.0003 | 12.0 | 1.0 |

In Table 9 and Table 10, steel numbers B1, B3, B5, B7, B9, B11, B13, B15, B17, B19, B21, and B23 are configured so as to have compositions that fall within the range of the high-strength steel sheet according to the present invention, whereas steel numbers B2, B4, B6, B8, B10, B12, B14, B16, B18, B20, B22, and B24 are configured as slabs having, on the basis of mass, the ratio of (Ce+La+Nd+Pr)/acid-soluble Al, the ratio of (Ce+La+Nd+Pr)/S, and the concentrations of S, T.O, Ca, and Ce+La+Nd+Pr adjusted so as to fall outside the range of the high-strength steel sheet according to the present invention.

It should be noted that, for comparison purposes, in Table 9, steel number B1 and steel number B2, steel number B3 and steel number B4, steel number B5 and steel number B6, steel number B7 and steel number B8, steel number B9 and steel number B10, steel number B11 and steel number B12, steel number B13 and steel number B14, steel number B15 and steel number B16, steel number B17 and steel number B18, steel number B19 and steel number B20, steel number B21 and steel number B22, and steel number B23 and steel number B24 are configured so as to have almost the same composition except that the compositions such as Ce+La are different.

Further, in Table 10, as condition D, a heating temperature was set to 1250° C., a temperature at the completion of finishing rolling was set to 845° C., a cooling rate after finishing rolling was set to 75° C./sec, and a coiling temperature was set to 450° C. As condition E, the heating temperature was set to 1250° C., the temperature at the completion of finishing rolling was set to 860° C., the steel sheet was air cooled at approximately 5° C./sec until the temperature reaches 680° C. after the finishing rolling, and was cooled thereafter at a cooling rate of 30° C./sec or more, and the coiling temperature was set to 400° C. As condition F, the heating temperature was set to 1250° C., the temperature at the completion of finishing rolling was set to 825° C., the cooling rate after the finishing rolling was set to 45° C./sec, and the coiling temperature was set to 450° C.

Condition D was applied to steel number B1 and steel number B2.

Condition E was applied to steel number B3 and steel number B4,

Condition E was applied to steel number B5 and steel number B6.

Condition F was applied to steel number B7 to steel number B10.

Condition D was applied to steel number B11 to steel number B14.

Condition E was applied to steel number B15 and steel number B16.

Condition F was applied to steel number B17 and steel number B18.

Condition D was applied to steel number B19 and steel number B20.

Condition E was applied to steel number B21 and steel number B22.

Condition F was applied to steel number B23 and steel number B24.

With these applications of conditions, the effects of chemical components can be compared under the same producing conditions.

TABLE 11

| Condition | Heating temperature (° C.) | Temperature at completion of finishing rolling (° C.) | Cooling rate after finishing rolling (° C./sec) | Coiling temperature (° C.) |
|---|---|---|---|---|
| D | 1250 | 845 | 75 | 450 |
| E | 1250 | 860 | 30 | 400 |
| F | 1250 | 825 | 45 | 450 |

The thus obtained steel sheets were examined in terms of basic characteristics including strength (MPa), ductility (%), stretch-flange formability (%), and limit bending radius (mm) for bending workability.

To obtain existence states of elongated inclusions in the steel sheets, examination was made on the number density per area of inclusions, and the ratio of number of, the compositions of, and the equivalent circle diameter of inclusions having an elongated ratio of 3 or less, through observation using an optical microscope or observation using a SEM, by targeting the observation at all the inclusions having a size of approximately 0.5 μm or more.

Further, to obtain existence states of non-elongated inclusions in the steel sheet, examination was made on the ratio of number of spherical compound inclusions containing different inclusion phases including a first inclusion phase containing at least one element of Ce, La, Nd, and Pr, further containing Ca, and at least one element of O and S, and a second inclusion phase further containing at least one element of Mn, Si, Ti, and Al, the ratio of number of inclusions having the elongated ratio of 3 or less, and the composition of Ce, La, Nd, and Pr, by targeting the observation at all the inclusions having a size of approximately 0.5 μm or more. Note that the reason that inclusions having a size of approximately 0.5 μm or more were targeted in the observation is because of easiness of the observation and also because the inclusions having a size of less than approximately 0.5 μm do not have any effect on the deterioration in the stretch-flange formability or bending workability.

Table 12 shows results of the examinations for each combination between steel and rolling condition.

TABLE 12

| | Steel number | Condition | Strength (MPa) | Elongation (%) | Ratio of number of compound inclusion of Ce, La, Nd, Pr, Si, Al, Ca, Mn, Ca, O, and S having equivalent circle diameter of 0.5 to 5 μm (%) | Number density of compound oxysulfide having over 5 μm and having spherical or cluster shape (pieces/mm$^2$) | Ratio of number of inclusion having equivalent circle diameter of 1 μm or more and elongated ratio of 3 or less (%) |
|---|---|---|---|---|---|---|---|
| Example B1 | B1 | D | 605 | 25 | 53 | 6 | 70 |
| Comp. Ex B1 | B2 | D | 605 | 25 | 6 | 23 | 3 |
| Example B2 | B3 | E | 605 | 27 | 64 | 5 | 75 |
| Comp. Ex B2 | B4 | E | 605 | 27 | 21 | 10 | 3 |
| Example B3 | B5 | E | 605 | 27 | 78 | 4 | 77 |
| Comp. Ex B3 | B6 | E | 605 | 27 | 21 | 10 | 3 |
| Example B4 | B7 | F | 605 | 24 | 62 | 6 | 74 |
| Comp. Ex B4 | B8 | F | 605 | 24 | 10 | 18 | 2 |
| Example B5 | B9 | F | 497 | 22 | 51 | 7 | 65 |
| Comp. Ex B5 | B10 | F | 495 | 19 | 3 | 25 | 2 |
| Example B6 | B11 | D | 605 | 25 | 61 | 4 | 73 |
| Comp. Ex B6 | B12 | D | 605 | 25 | 14 | 17 | 2 |
| Example B7 | B13 | D | 800 | 22 | 54 | 5 | 68 |
| Comp. Ex B7 | B14 | D | 800 | 21 | 8 | 20 | 3 |
| Example B8 | B15 | E | 605 | 27 | 51 | 6 | 64 |
| Comp. Ex B8 | B16 | E | 605 | 27 | 14 | 15 | 3 |
| Example B9 | B17 | F | 497 | 22 | 97 | 7 | 77 |
| Comp. Ex B9 | B18 | F | 495 | 19 | 4 | 24 | 4 |
| Example B10 | B19 | D | 810 | 21 | 58 | 5 | 69 |
| Comp. Ex B10 | B20 | D | 810 | 20 | 7 | 18 | 3 |

TABLE 12-continued

| | | | | | | | |
|---|---|---|---|---|---|---|---|
| Example B11 | B21 | E | 1005 | 17 | 61 | 7 | 73 |
| Comp. Ex B11 | B22 | E | 995 | 16 | 3 | 11 | 1 |
| Example B12 | B23 | F | 1005 | 18 | 84 | 6 | 77 |
| Comp. Ex B12 | B24 | F | 1005 | 17 | 13 | 13 | 3 |

| | Average concentration of total of at least one element of Ca, La, Nd, and Pr in inclusion having equivalent circle diameter of 0.5 to 5 μm (%) | Average grain diameter of crystal in metal structure (μm) | Hole expanding value λ | Limit bending radius (mm) |
|---|---|---|---|---|
| Example B1 | 31 | 10 | 132 | 0.5 |
| Comp. Ex B1 | 0.15 | 10 | 37 | 2 |
| Example B2 | 48 | 4 | 169 | 0.5 |
| Comp. Ex B2 | 97 | 4 | 33 | 3.5 |
| Example B3 | 49 | 4 | 171 | 0.5 |
| Comp. Ex B3 | 0.4 | 4 | 33 | 3.5 |
| Example B4 | 51 | 5 | 178 | 0.5 |
| Comp. Ex B4 | 0.4 | 5 | 41 | 2.5 |
| Example B5 | 13 | 7 | 180 | 0.5 |
| Comp. Ex B5 | 0.2 | 7 | 75 | 2.5 |
| Example B6 | 35 | 8 | 137 | 0.5 |
| Comp. Ex B6 | 97 | 8 | 35 | 2.5 |
| Example B7 | 45 | 7 | 187 | 0.5 |
| Comp. Ex B7 | 0.1 | 7 | 31 | 3 |
| Example B8 | 48 | 10 | 175 | 0.5 |
| Comp. Ex B8 | 98 | 10 | 31 | 3 |
| Example B9 | 14 | 2 | 187 | 0.5 |
| Comp. Ex B9 | 0.2 | 2 | 74 | 3 |
| Example B10 | 47 | 7 | 160 | 0.5 |
| Comp. Ex B10 | 97 | 7 | 32 | 3 |
| Example B11 | 38 | 7 | 95 | 0.5 |
| Comp. Ex B11 | 0.3 | 7 | 31 | 4 |
| Example B12 | 46 | 7 | 92 | 0.5 |
| Comp. Ex B12 | 0.4 | 7 | 36 | 4 |

The strength and the ductility were obtained through a tensile test with Japanese Industrial Standards (JIS) No. 5 test piece taken from the steel sheet in a direction parallel to the rolling direction. The stretch-flange formability was evaluated such that a punched hole having a diameter of 10 mm and opened at the center of a steel sheet with 150 mm×150 mm was pressed and expanded with a conical punch having an angle of 60°, a hole diameter D (mm) was measured at the time when a through-thickness crack occurred, and a hole-expanding value λ was obtained from $\lambda=(D-10)/10$, thereby evaluating the stretch-flange formability with the hole-expanding value 2. The limit bending radius (mm) used as an index indicating the bending workability was obtained by taking a bending test piece, and carrying out a V-bending test using a die unit equipped with a die and a punch. The die used has a recessed portion with a V shape in cross section and an angle of aperture of 60°. The punch used has an elevated portion that matches the recessed portion of the die. Various punches were prepared in which bending radii of a needle portion at a top end portion were varied in 0.5-mm steps, and were subjected to bending tests to obtain the minimum radius of curvature of the needle portion at the top end portion of the punch at which a crack occurs at a bent portion of the subjected test piece. This minimum radius of curvature was evaluated as the limit bending radius.

It should be noted that the test piece used was a No. 1 test piece specified in JIS, which was obtained by equally cutting both sides of a raw sheet (hot rolled sheet) and had a parallel portion of 25 mm, a radius of curvature R of 100 mm, and a thickness of 3.0 mm.

As for inclusions, the major axis and the minor axis of randomly selected 50 inclusions having an equivalent circle diameter of 1 μm or more were measured through SEM observation. Further, with a quantitative analysis function of the SEM, composition analysis was performed for the randomly selected 50 inclusions having the equivalent circle diameter of 1 μm or more. On the basis of the measurement results, the ratio of number of inclusions having an elongated ratio of 3 or less, the composition analysis of Ce, La, Nd, and Pr, and the average value of the total of at least one element of Ce, La, Nd, and Pr in the inclusions were obtained.

Although not shown in Table 12, with steel numbers B1, B3, B5, B7, B9, B11, B13, B15, B17, B19, B21, and B23 to which the method according to the present invention was applied, it was possible to generate the compound inclusions containing different inclusion phases including the first inclusion phase of [REM]-[Ca]—[O,S] and the second inclusion phase of [Mn,Si,Ti,Al]-[REM]-[Ca]—[O,S], whereby it was possible to reduce the elongated MnS-based inclusion in the steel sheet.

More specifically, although not shown in Table 12, inclusions having the equivalent circle diameter of 2 μm or less existed in the steel sheet; the ratio of the number of the spherical compound inclusions formed by inclusion phases including the first inclusion phase of [REM]-[Ca]—[O,S] and the second inclusion phase of [Mn, Si, Ti, Al]-[REM]-[Ca]—[O,S], the components of these inclusion phases being different from each other, was 50% or more as can be clearly understood from Table 12; the spherical compound inclusions had the size in the range of 0.5 μm to 5 μm; and the average content percentage of the total of at least one element of Ce, La, Nd, and Pr in the inclusions existing in the steel sheet and having elongated ratio of 3 or less was in the range of 0.5% to 95%. The ratio of the number of the elongated inclusions having the equivalent circle diameter of 1 μm or more and the elongated ratio of 3 or less was 50% or more. Note that, in any structures of the steel sheets, the average crystal grain diameter fell within the range of 2 μm to 10 μm, and were 10 μm or less in the present invention.

As a result, the steel sheets numbered B1, B3, B5, B7, B9, B11, B13, B15, B17, B19, B21, and B23 exhibited excellent stretch-flange formability and bending workability as compared with comparative steels.

On the other hand, as for comparative steels (B2, B4, B6, B8, B10, B12, B14, B16, B18, B20, B22, and B24), although the average crystal grain diameters of all the comparative steels were 10 μm or less, the ratio of the number of the small spherical compound inclusions having the size in the range of 0.5 μm to 5 μm and containing different inclusion phases including the first inclusion phase and the second inclusion phase was apparently low, and the distribution state of the compound inclusions was different from that specified in the present invention. Thus, the MnS-based inclusions elongated during processes applied to the steel sheet served as the starting point of the occurrence of cracking, deteriorating the stretch-flange formability and the bending workability.

Table 13 and Table 14 show an example of comparison between a case of the present invention where Ca is added after addition of La (see steel number B25 according to the present invention) and a case where La is added after addition of Ca (see steel number B26 of Comparative Example). In the case where Ca was added after addition of La, the ratio of the number of the spherical inclusions having the size of 5 μm or less increased, the density of inclusions having the size of over 5 μm reduced, and the hole-expandability improved.

TABLE 13

(mass %)

| | Steel number | C | Si | Mn | P | S | N | T.O | Acid-soluble Al | Acid-soluble Ti | Ca | La | 100 × La/Acid-soluble Al | La/S |
|---|---|---|---|---|---|---|---|---|---|---|---|---|---|---|
| Example B13 | B25 | 0.06 | 0.20 | 1.5 | 0.015 | 0.0100 | 0.0020 | 0.002 | 0.033 | 0.02 | 0.001 | 0.0040 | 12.1 | 0.4 |
| Comp. Ex B13 | B26 | 0.06 | 0.20 | 1.5 | 0.015 | 0.0100 | 0.0020 | 0.002 | 0.033 | 0.02 | 0.001 | 0.0040 | 12.1 | 0.4 |

TABLE 14

| | Steel number | Condition | Strength (MPa) | Elongation (%) | Ratio of number of compound inclusion of Ce, La, Nd, Pr, Si, Al, Ca, Mn, Ca, O, S having equivalent circle diameter of 0.5 to 5 μm (%) | Number density of compound oxysulfide having over 5 μm and having a spherical or cluster shape (pieces/mm$^2$) | Ratio of number of inclusion having equivalent circle diameter of 1 μm or more and elongated ratio of 3 or less (%) |
|---|---|---|---|---|---|---|---|
| Example B13 | B25 | F | 497 | 22 | 82 | 6 | 75 |
| Comp. Ex B13 | B26 | F | 497 | 22 | 48 | 15 | 48 |

| | Average concentration of total of at least one element of Ce, La, Nd, Pr in inclusion having equivalent circle diameter of 0.5 to 5 μm (%) | Average grain diameter of crystal in metal structure (μm) | Hole expanding value λ | Limit bending radius (mm) |
|---|---|---|---|---|
| Example B13 | 24 | 7 | 139 | 0.2 |
| Comp. Ex B13 | 0.3 | 7 | 75 | 2 |

Table 15 and Table 16 show examples of a case of the present invention where Ca was added after addition of Ce (see steel number B27) and a case where Ca was not added (steel number B28 of Comparative Example). In the case where Ca was added after addition of Ce, it is confirmed that the ratio of number of spherical inclusions having the size of 5 μm or less increased, and the hole-expandability improved.

TABLE 15

(mass %)

| | Steel number | C | Si | Mn | P | S | N | T.O | Acid-soluble Al | Acid-soluble Ti | Ca | Ce | 100 × Ce/Acid-soluble Al | Ce/S |
|---|---|---|---|---|---|---|---|---|---|---|---|---|---|---|
| Example B14 | B27 | 0.06 | 0.68 | 1.38 | 0.010 | 0.0040 | 0.0020 | 0.0023 | 0.028 | 0.026 | 0.0019 | 0.0028 | 10.0 | 0.7 |
| Comp. Ex B14 | B28 | 0.06 | 0.68 | 1.38 | 0.010 | 0.0040 | 0.0020 | 0.0023 | 0.028 | 0.026 | — | 0.0028 | 10.0 | 0.7 |

TABLE 16

| | Steel number | Condition | Strength (MPa) | Elongation (%) | Ratio of number of compound inclusion of Ce, La, Nd, Pr, Si, Al, Ca, Mn, Ca, O, S having equivalent circle diameter of 0.5 to 5 μm (%) | Number density of oxysulfide having over 5 μm and having a spherical or cluster shape (pieces/mm$^2$) | Ratio of number of inclusion having equivalent circle diameter of 1 μm or more and elongated ratio of 3 or less (%) |
|---|---|---|---|---|---|---|---|
| Example B14 | B27 | D | 605 | 25 | 77 | 6 | 97 |
| Comp. Ex B14 | B28 | D | 605 | 25 | 47 | 28 | 47 |

| | Average concentration of total of at least one element of Ce, La, Nd, and Pr in inclusion having equivalent circle diameter of 0.5 to 5 μm (%) | Average grain diameter of crystal in metal structure (μm) | Hole expanding value λ | Limit bending radius (mm) |
|---|---|---|---|---|
| Example B14 | 35 | 4 | 120 | 0.1 |
| Comp. Ex B14 | 31 | 4 | 92 | 1.5 |

It should be noted that, in the case of steel number B28 in Table 15 and Table 16, the immersion nozzle clogged in the middle of the continuous casting process, not all the molten steel in the ladle was able to be completely casted, and casting could not be performed with the latter ladle, causing the production troubles. Further, processes of the hot rolling or later were applied to slabs being processed but not completed, so that products could be obtained.

INDUSTRIAL APPLICABILITY

According to the present invention, it is possible to obtain a high-strength steel sheet exhibiting improved and excellent stretch-flange formability and bending workability, and a method of producing molten steel for the high-strength steel sheet.

The invention claimed is:

1. A high-strength steel sheet comprising:

C: 0.03 to 0.25 mass %,

Si: 0.1 to 2.0 mass %,

Mn: 0.5 to 3.0 mass %,

P: not more than 0.05 mass %,

T.O: not more than 0.0050 mass %,

S: 0.0001 to 0.01 mass %,

N: 0.0005 to 0.01 mass %, acid-soluble Al: more than 0.01 mass %,

Ca: 0.0005 to 0.0050 mass %, a total of at least one element of Ce, La, Nd, and Pr: 0.001 to 0.01 mass %, and optionally one or more selected from the group consisting of:

acid-soluble Ti: 0.008 to 0.20 mass %,

Nb: 0.01 to 0.10 mass %,

V: 0.01 to 0.10 mass %,

Cu: 0.1 to 2 mass %,

Ni: 0.05 to 1 mass %,

Cr: 0.01 to 1 mass %,

Mo: 0.01 to 0.4 mass %,

B: 0.0003 to 0.005 mass %, and

Zr: 0.001 to 0.01 mass % with a balance including iron and inevitable impurities, wherein:

the steel sheet contains a chemical component on a basis of mass that satisfies $0.7<100\times([Ce]+[La]+[Nd]+[Pr])/[\text{acid-soluble Al}]\leq 70$, and $0.2\leq([Ce]+[La]+[Nd]+[Pr])/[S]\leq 10$, where [Ce] is an amount of Ce contained, [La] is an amount of La contained, [Nd] is an amount of Nd contained, [Pr] is an amount of Pr contained, [acid-soluble Al] is an amount of acid-soluble Al contained, and [S] is an amount of S contained;

the steel sheet has a compound inclusion including a first inclusion phase containing at least one element of Ce, La, Nd, and Pr, containing Ca, and containing at least one element of O and S, and a second inclusion phase having a component different from that of the first inclusion phase and containing at least one element of Mn, Si, Ti and Al;

the compound inclusion forms a spherical compound inclusion having an equivalent circle diameter in a range of 0.5 μm to 5 μm; and a ratio of a number of the spherical compound inclusions relative to a number of all inclusions having the equivalent circle diameter in the range of 0.5 μm to 5 μm is 50% or more.

2. The high-strength steel sheet according to claim 1, wherein the spherical inclusion is an inclusion having an equivalent circle diameter of 1 μm or more, and a ratio of a number of elongated inclusions having a major axis/minor axis of 3 or less relative to a number of all inclusions having the equivalent circle diameter of 1 μm or more is 50% or more.

3. The high-strength steel sheet according to claim 1, wherein the spherical inclusion contains at least one element of Ce, La, Nd, and Pr, a total of which is in a range of 0.5 mass % to 95 mass % in an average composition.

4. The high-strength steel sheet according to claim 1, wherein an average grain diameter of a crystal in a structure of the steel sheet is 10 μm or less.

5. A method of producing molten steel for the high-strength steel sheet according to any one of claims 1 to 4, the method having a refinement process for producing a steel, the refinement process including:

a first process of obtaining a first molten steel including applying processing so as to obtain P of not more than 0.05 mass % and S of not less than 0.0001 mass %, and performing addition or adjustment such that C is not less than 0.03 mass % and not more than 0.25 mass %, Si is not less than 0.1 mass % and not more than 2.0 mass %, Mn is not less than 0.5 mass % and not more than 3.0 mass %, and N is not less than 0.0005 mass % and not more than 0.01 mass %;

a second process of obtaining a second molten steel including performing addition to the first molten steel such that Al is more than 0.01 mass % in acid-soluble Al, and T.O is not more than 0.0050 mass %;

a third process of obtaining a third molten steel including adding at least one element of Ce, La, Nd, and Pr to the second molten steel so as to satisfy on a basis of mass $0.7<100\times([Ce]+[La]+[Nd]+[Pr])/[\text{acid-soluble Al}]\leq 70$, $0.2\leq([Ce]+[La]+[Nd]+[Pr])/[S]\leq 10$, and $0.001\leq[Ce]+[La]+[Nd]+[Pr]\leq 0.01$, where [Ce] is an amount of Ce contained, [La] is an amount of La contained, [Nd] is an amount of Nd contained, [Pr] is an amount of Pr contained, [acid-soluble Al] is an amount of acid-soluble Al contained, and [S] is an amount of S contained; and a fourth process of obtaining a fourth molten steel including adding Ca to or performing adjustment to the third molten steel such that Ca is not less than 0.0005 mass % and not more than 0.0050 mass %.

6. The method of producing molten steel for a high-strength steel sheet according to claim 5, wherein the third process includes, before the at least one element of Ce, La, Nd, and Pr is added to the second molten steel, adding at least one element of Nb and V to the second molten steel such that the second molten steel further contains at least one element of Nb of not less than 0.01 mass % and not more than 0.10 mass % and V of not less than 0.01 mass % and not more than 0.10 mass %.

7. The method of producing molten steel for a high-strength steel sheet according to claim 5, wherein the third process includes, before the at least one element of Ce, La, Nd, and Pr is added to the second molten steel, adding at least one element of Cu, Ni, Cr, Mo, and B to the second molten steel such that the second molten steel further contains at least one element of Cu of not less than 0.1 mass % and not more than 2 mass %, Ni of not less than 0.05 mass % and not more than 1 mass %, Cr of not less than 0.01 mass % and not more than 1 mass %, Mo of not less than 0.01 mass % and not more than 0.4 mass %, and B of not less than 0.0003 mass % and not more than 0.005 mass %.

8. The method of producing molten steel for a high-strength steel sheet according to claim 5, wherein the third process includes, before the at least one element of Ce, La, Nd, and Pr is added to the second molten steel, adding Zr to the second molten steel such that the second molten steel further contains Zr of not less than 0.001 mass % to 0.01 mass %.

9. A high-strength steel sheet comprising:

C: 0.03 to 0.25 mass %,

Si: 0.03 to 2.0 mass %,

Mn: 0.5 to 3.0 mass %,

P: not more than 0.05 mass %,

T.O: not more than 0.0050 mass %,

S: 0.0001 to 0.01 mass %, acid-soluble Ti: 0.008 to 0.20 mass %,

N: 0.0005 to 0.01 mass %, acid-soluble Al: more than 0.01 mass %,

Ca: 0.0005 to 0.005 mass %, and a total of at least one element of Ce, La, Nd, and Pr: 0.001 to 0.01 mass %, with a balance including iron and inevitable impurities, wherein:

the steel sheet contains a chemical component on a basis of mass that satisfies $0.7<100\times([Ce]+[La]+[Nd]+[Pr])/[\text{acid-soluble Al}]\leq 70$, and $0.2\leq([Ce]+[La]+[Nd]+[Pr])/[S]\leq 10$, where [Ce] is an amount of Ce contained, [La] is an amount of La contained, [Nd] is an amount of Nd contained, [Pr] is an amount of Pr contained, [acid-soluble Al] is an amount of acid-soluble Al contained, and [S] is an amount of S contained;

the steel sheet has a compound inclusion including a first inclusion phase containing at least one element of Ce, La, Nd, and Pr, containing Ca, and containing at least one element of O and S, and a second inclusion phase having a component different from that of the first inclusion phase and containing at least one element of Mn, Si, Ti, and Al;

the compound inclusion forms a spherical compound inclusion having an equivalent circle diameter in a range of 0.5 μm to 5 μm;

a ratio of number of the spherical compound inclusion relative to number of all inclusions having the equivalent circle diameter in the range of 0.5 μm to 5 μm is 50% or more; and number density of an inclusion with more than 5 μm is less than 10 pieces/$mm^2$.

10. The high-strength steel sheet according to claim 9, wherein the spherical inclusion is an inclusion having an equivalent circle diameter of 1 μm or more, and a ratio of number of elongated inclusions having a major axis/minor axis of 3 or less relative to number of all inclusions having the equivalent circle diameter of 1 μm or more is 50% or more.

11. The high-strength steel sheet according to claim 9, wherein the spherical inclusion contains at least one element of Ce, La, Nd, and Pr, a total of which is in a range of 0.5 mass % to 95 mass % in an average composition.

12. The high-strength steel sheet according to claim 9, wherein an average grain diameter of a crystal in a structure of the steel sheet is 10 μm or less.

13. The high-strength steel sheet according to any one of claims 9 to 12, further containing at least one element of Nb: 0.005 to 0.10 mass %, and V: 0.01 to 0.10 mass %.

14. The high-strength steel sheet according to any one of claims 9 to 12, further containing at least one element of:

Cu: 0.1 to 2 mass %,

Ni: 0.05 to 1 mass %,

Cr: 0.01 to 1.0 mass %,

Mo: 0.01 to 0.4 mass %, and

B: 0.0003 to 0.005 mass %.

15. The high-strength steel sheet according to any one of claims 9 to 12, further containing Zr: 0.001 to 0.01 mass %.

16. The high-strength steel sheet according to any one of claims 9 to 12, further containing at least one element of:

Nb: 0.005 to 0.10 mass %,

V: 0.01 to 0.10 mass %,

Cu: 0.1 to 2 mass %,

Ni: 0.05 to 1 mass %,

Cr: 0.01 to 1.0 mass %,

Mo: 0.01 to 0.4 mass %,

B: 0.0003 to 0.005 mass %, and

Zr: 0.001 to 0.01 mass %.

17. A method of producing molten steel for the high-strength steel sheet according to any one of claims 9 to 12, having a refinement process for producing a steel, the refinement process including:

a first process of obtaining a first molten steel including:

applying processing so as to obtain P of not more than 0.05 mass % and S of not less than 0.0001 mass % and not more than 0.01 mass %, and performing addition or adjustment such that C is not less than 0.03 mass % and not more than 0.25 mass %, Si is not less than 0.03 mass % and not more than 2.0 mass %, Mn is not less than 0.5 mass % and not more than 3.0 mass %, and N is not less than 0.0005 mass % and not more than 0.01 mass %;

a second process of obtaining a second molten steel including performing addition to the first molten steel such that Al is more than 0.01 mass % in acid-soluble Al, and T.O is not more than 0.0050 mass %;

a third process of obtaining a third molten steel including adding Ti of not less than 0.008 mass % and not more than 0.20 mass % in acid-soluble Ti to the second molten steel;

a fourth process of obtaining a fourth molten steel including adding at least one element of Ce, La, Nd, and Pr to the third molten steel so as to satisfy on a basis of mass $0.7<100\times([Ce]+[La]+[Nd]+[Pr])/[\text{acid-soluble Al}]\leq 70$, $0.2\leq([Ce]+[La]+[Nd]+[Pr])/[S]\leq 10$, and $0.001\leq[Ce]+[La]+[Nd]+[Pr]\leq 0.01$, where [Ce] is an amount of Ce contained, [La] is an amount of La contained, [Nd] is an amount of Nd contained, [Pr] is an amount of Pr contained, [acid-soluble Al] is an amount of acid-soluble Al contained, and [S] is an amount of S contained; and a fifth process of obtaining a fifth molten steel including adding Ca to or performing adjustment to the fourth molten steel such that Ca is not less than 0.0005 mass % and not more than 0.0050 mass %.

18. The method of producing molten steel for a high-strength steel sheet according to claim 17, wherein the third process further includes, before the at least one element of Ce, La, Nd, and Pr is added to the second molten steel, adding at least one element of Nb and V to the second molten steel such that the second molten steel further contains at least one element of Nb of not less than 0.005 mass % and not more than 0.10 mass %, and V of not less than 0.01 and not more than 0.10 mass %.

19. The method of producing molten steel for a high-strength steel sheet according to claim 17, wherein the third process further includes, before the at least one element of Ce, La, Nd, and Pr is added to the second molten steel, adding at least one element of Cu, Ni, Cr, Mo, and B to the second molten steel such that the second molten steel further contains at least one element of Cu of not less than 0.1 mass % and not more than 2 mass %, Ni of not less than 0.05 mass % and not more than 1 mass %, Cr of not less than 0.01 mass % and not more than 1 mass %, Mo of not less than 0.01 mass % and not more than 0.4 mass %, and B of not less than 0.0003 mass % and not more than 0.005 mass %.

20. The method of producing molten steel for a high-strength steel sheet according to claim 17, wherein the third process further includes, before the at least one element of Ce, La, Nd, and Pr is added to the second molten steel, adding Zr to the second molten steel such that the second molten steel further contains Zr of not less than 0.001 mass % and not more than 0.01 mass %.

21. The high-strength steel sheet according to claim 1, comprising acid-soluble Ti: 0.008 to 0.20 mass %, wherein a number density of inclusions with more than 5 μm is less than 10 pieces/$mm^2$.

22. A high-strength steel sheet consisting essentially of:

C: 0.03 to 0.25 mass %,

Si: 0.1 to 2.0 mass %,

Mn: 0.5 to 3.0 mass %,

P: not more than 0.05 mass %,

T.O: not more than 0.0050 mass %,

S: 0.0001 to 0.01 mass %,

N: 0.0005 to 0.01 mass %, acid-soluble Al: more than 0.01 mass %,

Ca: 0.0005 to 0.0050 mass %, a total of at least one element of Ce, La, Nd, and Pr: 0.001 to 0.01 mass %, and optionally one or more selected from the group consisting of:

acid-soluble Ti: 0.008 to 0.20 mass %,

Nb: 0.01 to 0.10 mass %,

V: 0.01 to 0.10 mass %,

Cu: 0.1 to 2 mass %,
Ni: 0.05 to 1 mass %,
Cr: 0.01 to 1 mass %,
Mo: 0.01 to 0.4 mass %,
B: 0.0003 to 0.005 mass %, and
Zr: 0.001 to 0.01 mass %
with a balance of iron and inevitable impurities, wherein:
the steel sheet contains a chemical component on a basis of mass that satisfies
$0.7<100\times([Ce]+[La]+[Nd]+[Pr])/[\text{acid-soluble Al}]\leq 70$, and
$0.2\leq([Ce]+[La]+[Nd]+[Pr])/[S]\leq 10$,
where [Ce] is an amount of Ce contained, [La] is an amount of La contained, [Nd] is an amount of Nd contained, [Pr] is an amount of Pr contained, [acid-soluble Al] is an amount of acid-soluble Al contained, and [S] is an amount of S contained;
the steel sheet has a compound inclusion including a first inclusion phase containing at least one element of Ce, La, Nd, and Pr, containing Ca, and containing at least one element of O and S, and a second inclusion phase having a component different from that of the first inclusion phase and containing at least one element of Mn, Si, Ti, and Al;
the compound inclusion forms a spherical compound inclusion having an equivalent circle diameter in a range of 0.5 μm to 5 μm; and
a ratio of a number of spherical compound inclusions relative to a number of all inclusions having an equivalent circle diameter in the range of 0.5 μm to 5 μm is 50% or more.

23. The high-strength steel sheet according to claim 22, wherein
the spherical compound inclusion is an inclusion having an equivalent circle diameter of 1 μm or more, and
a ratio of a number of elongated inclusions having a major axis/minor axis of 3 or less relative to a number of all inclusions having the equivalent circle diameter of 1 μm or more is 50% or more.

24. The high-strength steel sheet according to claim 22, wherein
the spherical compound inclusion contains at least one element of Ce, La, Nd, and Pr, a total of which is in a range of 0.5 mass % to 95 mass % in an average composition.

25. The high-strength steel sheet according to claim 22, wherein
an average grain diameter of a crystal in a structure of the steel sheet is 10 μm or less.

26. The high-strength steel sheet according to claim 22, comprising acid-soluble Ti: 0.008 to 0.20 mass %, wherein
a number density of inclusions with more than 5 μm is less than 10 pieces/$mm^2$.

* * * * *